US006465956B1

(12) United States Patent
Koshio et al.

(10) Patent No.: US 6,465,956 B1
(45) Date of Patent: Oct. 15, 2002

(54) PLASMA DISPLAY PANEL

(75) Inventors: Chiharu Koshio; Kimio Amemiya; Toshihiro Komaki; Hitoshi Taniguchi; Tatsuro Sakai; Kosuke Masuda, all of Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/466,841

(22) Filed: Dec. 20, 1999

(30) Foreign Application Priority Data

Dec. 28, 1998 (JP) ..... 10-373129
Apr. 26, 1999 (JP) ..... 11-117701
May 26, 1999 (JP) ..... 11-146373

(51) Int. Cl.[7] ..... G09G 3/28; H01J 17/49
(52) U.S. Cl. ..... 313/586; 313/585; 313/587
(58) Field of Search ..... 313/586, 585, 313/584, 587; 345/41, 60, 55

(56) References Cited

U.S. PATENT DOCUMENTS 5,952,782 A * 9/1999 Nanto et al. ..... 313/584
6,084,349 A * 7/2000 Ueoka et al. ..... 313/584 X
6,232,717 B1 * 5/2001 Oida et al. ..... 313/584 X

FOREIGN PATENT DOCUMENTS

EP 0823722 A2 2/1998
EP 0920048 A2 6/1999

* cited by examiner

*Primary Examiner*—Ashok Patel
(74) *Attorney, Agent, or Firm*—Arent Fox Kintner Plotkin & Kahn

(57) ABSTRACT

A plasma display panel includes a front substrate and a rear substrate, a plurality of row electrode pairs provided on the inner surface of the front substrate, a dielectric layer provided on the inner surface of the front substrate for coverring the row electrode pairs, a plurality of column electrodes provided on the inner surface of the rear substrate, a partition wall assembly provided between the front substrate and the rear substrate, said partition wall assembly including a plurality of longitudinal partition walls and a plurality of lateral partition walls, forming a plurality of discharge cells. In particular, the dielectric layer has a plurality of projection portions located corresponding to and protruding toward the lateral partition walls of the partition wall assembly, in a manner such that there would be no slots formed between the dielectric layer and the lateral partition walls.

28 Claims, 38 Drawing Sheets

V1-V1 SECTION

V1-V1 SECTION

V2-V2 SECTION

W1-W1 SECTION

W2-W2 SECTION

V3-V3 SECTION

V4-V4 SECTION

W3-W3 SECTION

W4-W4 SECTION

V5-V5 SECTION

V6-V6 SECTION

V7-V7 SECTION

V8-V8 SECTION

W5-W5 SECTION

W6-W6 SECTION

V9-V9 SECTION

V10-V10 SECTION

V11-V11 SECTION

V12-V12 SECTION

W7-W7 SECTION

W8-W8 SECTION

W9—W9 SECTION

W10—W10 SECTION

V 1 3 — V 1 3 SECTION

V-V SECTION

W-W SECTION

PLASMA DISPLAY PANEL

BACKGROUND OF THE INVENTION

The present invention relates to a surface discharge type AC-driven plasma display panel, particularly to the discharge cell structure of such plasma display panel.

Recently, there has been appeared in the market a new type of display device which is large in size and small in thickness, with one example being a surface discharge type AC-driven plasma display panel.

FIG. 47 is a plane view schematically indicating a surface discharge type AC-driven plasma display panel made according to a prior art. FIG. 48 is a sectional view taken along line V—V in FIG. 47, FIG. 49 is a sectional view taken along line W—W in FIG. 47.

As shown in FIGS. 47–49, the conventional plasma display panel has a front glass substrate 1 (serving as a displaying surface), a plurality of row electrode pairs (X', Y'), a dielectric layer 2 covering the row electrode pairs (X', Y'), a protection layer 3 consisting of MgO covering the dielectric layer 2.

Referring to FIG. 47, each row electrode pair (X', Y') includes a pair of transparent electrodes (Xa', Ya') consisting of ITO transparent electrically conductive film and having a relatively large width, and a pair of bus electrodes (Xb', Yb') consisting of a metal film having a relatively small width. The bus electrodes (Xb', Yb') are provided to compensate for the electric conductivity of the transparent electrodes (Xa', Ya').

Further, two row electrodes forming each row electrode pair (X', Y') are arranged in parallel with each other, forming a discharge gap g' therebetween, thereby forming one displaying line L for the plasma display panel (matrix display).

Referring to FIGS. 48 and 49, the conventional plasma display panel has a rear glass substrate 4 arranged space-apart from the front glass substrate 1, thereby forming an electric discharge space S' therebetween. Further, the display panel includes a plurality of column electrodes D' arranged orthogonal to the row electrodes (X', Y'), a plurality of belt-like partition walls 5 provided between and in parallel with the column electrodes D', a fluorescent layer 6 including three kinds of original color portions 6(R), 6(G), 6(B). In detail, the fluorescent layer 6 is so provided that it covers the side surfaces of the partition walls 5 and the column electrodes D'.

In this way, the row electrode pairs (X', Y') are intersected with the column electrodes D', while the discharge space S' is divided by the partition walls 5 into a plurality of smaller sections, thereby forming a plurality of electric discharge cells C' serving as a plurality of light emission units, as shown in FIG. 47.

A displaying process of the surface discharge type AC-driven plasma display panel having the structure shown in FIGS. 47–48 will be described in the following.

At first, an addressing operation is conducted so that an electric discharge is effected selectively among the discharge cells C' between the row electrode pairs (X', Y') and the column electrodes D. As a result, a plurality of lit-up cells (discharge cells C' where wall charges have been formed in the dielectric layer 2) and a plurality of extinguished cells (discharge cells C' where wall charges are not formed in the dielectric layer 2) are distributed on the panel corresponding to a picture to be displayed.

Subsequently, discharge sustaining pulses are simultaneously applied to all the displaying lines L in a manner such that the row electrode pairs (X', Y') will alternatively receive the discharge sustaining pulses. In this manner, surface discharge phenomenon will occur in lit-up cells once the discharge sustaining pulses are applied thereto.

At this moment, since ultraviolet light will be generated due to the surface discharge in the lit-up cells, the fluorescent layer 6 (R, G, B) will be excited to effect light emission, thereby displaying a picture on the plasma display panel.

In the above-described surface discharge type AC-driven plasma display panel, since a fluorescent layer 6 has been provided to cover not only the column electrodes D' but also the side faces of the belt-like partition walls 5, a light emission area within each discharge cell C' has been increased, thus increasing the brightness of a picture being displayed on the panel.

However, with the above-described surface discharge type AC-driven plasma display panel, if it is desired to improve the fineness of a displayed picture by reducing the size of each discharge cell C', a total surface area of the fluorescent layer 6 will also be undesirably reduced, resulting in a deterioration in the brightness of the displayed picture.

To cope with the above problem, it is allowed to consider making narrow the pitch between each row electrode pair (X','). This, however, would cause a problem called discharge interference between every two adjacent discharge cells C', hence resulting in some misdischarges.

SUMMARY OF THE INVENTION

It is a first object of the present invention to provide an improved plasma display panel capable of ensuring an improved fineness for a picture being displayed on the panel, without causing the above-mentioned problems such as a decrease in a displaying brightness and some misdischarges in discharge cells.

It is a second object of the present invention to provide an improved plasma display panel capable of preventing a reflection of an external light incident on the panel, thereby improving the contrast of a picture being displayed on the panel.

It is a third object of the present invention to provide an improved plasma display panel capable having an improved resolution.

It is a fourth object of the present invention to provide an improved plasma display panel capable of preventing a warpage in partition walls (which are provided to divide a discharge space into a plurality of discharge cells), thereby preventing a possible deformation in the predetermined shape of the discharge cells.

It is a fifth object of the present invention to provide an improved plasma display panel capable of preventing the formation of unwanted slots between a front glass substrate and a rear glass substrate, thereby avoiding any possible defect caused by such slots in the display panel.

According to the present invention, there is provided a plasma display panel comprising: a front substrate; a plurality of row electrode pairs provided on the inner surface of the front substrate, said row electrode pairs being arranged in parallel with one another and extending in the row direction of the panel, with each row electrode pair forming a displaying line; a dielectric layer provided on the inner surface of the front substrate for coverring the row electrode pairs; a rear substrate arranged in parallel with and space-apart from the front substrate, forming a discharge space therebetween; a plurality of column electrodes provided on the inner surface of the rear substrate, said column electrodes being arranged in parallel with one another and extending in the column direction of the panel, in a manner such that at each intersection of a row electrode pair with a column electrode there is formed a light emission unit; a partition wall assembly provided between the front substrate and the rear substrate, said partition wall assembly including a plurality of longitudinal partition walls and a plurality of lateral partition walls, thereby dividing the discharge space into a plurality of discharge cells. In particular, the dielectric layer has a plurality of projection portions located corresponding to and protruding toward the lateral partition walls of the partition wall assembly, in a manner such that there would be no slots formed between the dielectric layer and the lateral partition walls.

In one more aspect of the present invention, a slot is formed between the dielectric layer and each longitudinal partition wall of the partition wall assembly.

In one more aspect of the present invention, a fluorescent layer is formed to cover side faces of the longitudinal partition walls and the lateral partition walls and exposed portions of another dielectric layer formed on the inner surface of the rear substrate.

In one more aspect of the present invention, the partition wall assembly has a two-layer structure, one of which is a light absorbing layer located closer. to the front substrate, and the other of which is a light reflecting layer located closer to the rear substrate.

In one more aspect of the present invention, each row electrode pair has two row electrodes each having a light absorbing layer facing the front substrate.

In one more aspect of the present invention, each of the two row electrodes forming one electrode pair has a plurality of protruding portions, forming a plurality of discharge gaps between mutually facing protruding portions of the two row electrodes.

In one more aspect of the present invention, a mutual positional relationship between two row electrodes of a row electrode pair is alternatively changed from one displaying line to another, two mutually adjacent row electrodes of every two mutually adjacent displaying lines are connected to an identical common electrode main body.

In one more aspect of the present invention, protruding portions of two mutually adjacent row electrodes of every two mutually adjacent displaying lines are connected with each other.

In one more aspect of the present invention, there are formed a plurality of lateral light absorbing straps on the inner surface of the front substrate, with each lateral light absorbing strap being positioned between two mutually adjacent row electrodes of every two mutually adjacent displaying lines.

In one more aspect of the present invention, there are formed a plurality of longitudinal light absorbing straps on the inner surface of the front substrate, with each longitudinal light absorbing strap being positioned corresponding to one longitudinal partition wall.

In one more aspect of the present invention, a light absorbing layer is formed on the inner surface of the front substrate layer, said light absorbing layer having the same pattern corresponding to the lateral and longitudinal partition walls of the partition wall assembly.

In one more aspect of the present invention, protruding portions of two row electrodes forming one displaying line have mutually facing head portions which are inclined with respect to the row direction of the panel.

In one more aspect of the present invention, each displaying line includes a plurality of discharge cells repeatedly arranged in the order of R, G, B, each column includes a plurality of same color discharge cells, with every three discharge cells (R, G, B) arranged in a display line forming one picture element.

In one more aspect of the present invention, each displaying line includes a plurality of discharge cells repeatedly arranged in the order of R, G, B, one displaying line being deviated in the row direction from its adjacent displaying line by one discharge cell, with every three discharge cells (R, G, B) arranged in a display line forming one picture element.

In one more aspect of the present invention, each displaying line includes a plurality of discharge cells repeatedly arranged in the order of R, G, B, one displaying line being deviated in the row direction from its adjacent displaying line by half width of one discharge cell, with every three discharge cells (R, G, B) arranged in a display line forming one picture element.

In one more aspect of the present invention, each displaying line includes a plurality of discharge cells repeatedly arranged in the order of R, G, B, one displaying line being deviated in the row direction from its adjacent displaying line by 1.5 times the width of one discharge cell, in a manner such that each pitch element may also be formed by three discharge cells (R, G, B) which together form a triangular configuration bridging over two mutually adjacent displaying lines.

In one more aspect of the present invention, each lateral partition wall of the partition wall assembly is divided into two portions by an elongated slot extending in the row direction of the panel.

In one more aspect of the present invention, each divided portion of each lateral partition wall has substantially the same width as that of each longitudinal partition wall of the partition wall assembly.

In one more aspect of the present invention, a plurality of light absorbing straps are formed on the inner surface of the front substrate, in positions corresponding to the elongated slots.

In one more aspect of the present invention, a plurality of light absorbing straps are formed on the inner surface of the front substrate, in positions corresponding to the longitudinal partition walls of the partition wall assembly.

In one more aspect of the present invention, at least the longitudinal partition walls of the partition wall assembly have a two-layer structure, one of which is a light absorbing layer facing toward the front substrate, and the other of which is a light reflecting layer facing toward the rear substrate.

In one more aspect of the present invention, each of two row electrodes of a row electrode pair includes an elongated main body portion extending in the row direction of the panel and a plurality of protruding portions extending in the column direction of the panel, so that a plurality of discharge gaps are formed between mutually facing protruding portions of two elongated main body portions. In particular, each elongated main body portion is made by a metal film. Further, each protruding portion is formed by a transparent electrically conductive film, with its base end connected to an elongated main body portion.

In one more aspect of the present invention, a light absorbing layer is formed on each elongated main body portion so that said light absorbing layer is interposed between the inner surface of the front substrate and the elongated main body portion.

In one more aspect of the present invention, one elongated main body portion is shared by two mutually adjacent row electrodes of two mutually adjacent displaying lines.

In one more aspect of the present invention, the outermost corner portions of each lateral partition wall are removed so as to form inclined surfaces thereon.

In one more aspect of the present invention, outer end portions of partition wall assembly are formed in positions not facing the projection portions of the dielectric layer.

In one more aspect of the present invention, outer end portions of each pair of lateral partition walls are combined with each other in positions not facing the projection portions of the dielectric layer.

In one more aspect of the present invention, the partition wall assembly is made of a light transmissible material.

In one more aspect of the present invention, each of two row electrodes of one row electrode pair has a plurality of protruding portions, thereby forming a plurality of discharge gaps between mutually facing protruding portions of the two row electrodes. Further, a mutual positional relationship between two row electrodes of one row electrode pair is alternatively changed from one displaying line to another. Moreover, one common electrode main body portion is shared by two mutually adjacent row electrodes of two mutually adjacent displaying lines.

The above objects and features of the present invention will become better understood from the following description with reference to the accompanying drawings.

DETAILED DESCRIPTION OF THE PREFERRED EMBODIMENTS

First Embodiment

Figure 1:
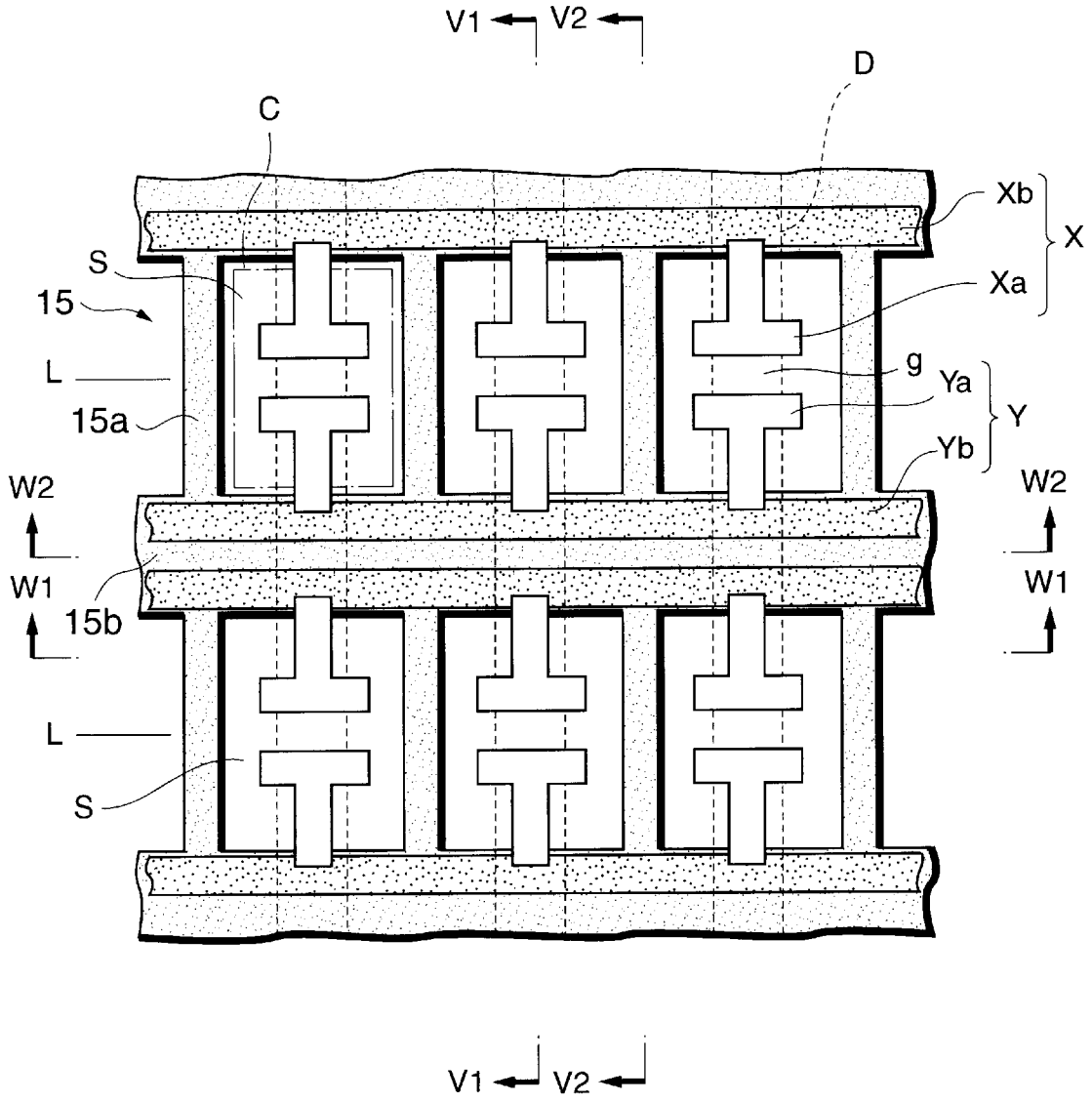
FIG. 1 is a plane view indicating a plasma display panel according to a first embodiment of the present invention.

A first embodiment of the present invention is illustrated in FIGS. 1–5.

Referring to FIGS. 1–5, a surface discharge type AC-driven plasma display panel of the present invention has a front glass substrate 10 serving as a displaying surface for the panel, a plurality of row electrode pairs (X,Y) mutually parallelly disposed on the inner surface of the front glass substrate 10.

Each row electrode X includes a plurality of T-shaped transparent electrodes Xa consisting of a transparent electrically conductive film made of ITO, and an elongated bus electrode Xb consisting of a metal film which is connected with one end of each T-shaped transparent electrode Xa.

Similarly, each row electrode Y includes a plurality of T-shaped transparent electrodes Ya consisting of a transparent electrically conductive film made of ITO, and an elongated bus electrode Yb consisting of a metal film which is connected with one end of each T-shaped transparent electrode Ya.

Further, two row electrodes (X, Y) forming a row electrode pair are arranged in parallel to each other, with a plurality of discharge gaps g formed between the T-shaped transparent electrodes Xa and the T-shaped transparent electrodes Ya, thereby forming one displaying line L for the plasma display panel (matrix display).

The T-shaped transparent electrodes Xa, Ya are formed on the inner surface of the front glass substrate 10 by vapor-depositing ITO thereon, followed by a patterning treatment with the use of a photolithographic method.

On the other hand, each elongated bus electrode Xb includes a black colour electrically conductive layer Xb' (facing the front glass substrate 10) and a main electrically conductive layer Xb". Similarly, each elongated bus electrode Yb includes a black colour electrically conductive layer Yb' (facing the front glass substrate 10) and a main electrically conductive layer Yb".

These bus electrodes Xb, Yb are formed by at first applying a silver paste (in which a black pigment has been mixed) to the inner surface of the front glass substrate 10, followed by a drying treatment, thereby obtaining a dried black color paste layer. Further, a silver paste is applied to the dried black color paste layer, followed by a patterning treatment with the use of a photolithographic method, and further through a sintering treatment, thus forming the bus electrodes Xb, Yb on the inner surface of the front glass substrate 10.

Further, a dielectric layer 11 is formed on the inner surface of the front glass substrate 10 in a manner such that it covers up all the row electrode pairs (X,Y). Moreover, the dielectric layer 11 includes a plurality of projection portions 11A located in positions corresponding to every two mutually adjacent bus electrodes Xb, Yb.

The dielectric layer 11 may be formed by at first preparing an amount of low melting point glass paste and then forming the paste into several layers of films each having a predetermined thickness, followed by laminating the films and a sintering treatment. The projection portions 11A may be formed by screen-printing (with a predetermined thickness) a similar low melting point glass paste on to the dielectric layer 11, followed by a similar sintering treatment.

Then, a protection layer 12 consisting of MgO is formed on the dielectric layer 11, thus coverring the projection portions 11A.

On the other hand, the plasma display panel has a rear glass substrate 13 arranged in parallel with and space-apart from the front glass substrate 10. A plurality of column electrodes D are provided on the inner surface of the rear glass substrate 13, and arranged orthogonal to the row electrode pairs (X, Y), in positions corresponding to the T-shaped transparent electrodes Xa, Ya.

The column electrodes D are formed by vapor-depositing an Al alloy (such as Al—Mn alloy) on to the inner surface of the rear glass substrate 13, followed by a patterning treatment with the use of a photolithographic method.

Figure 2:
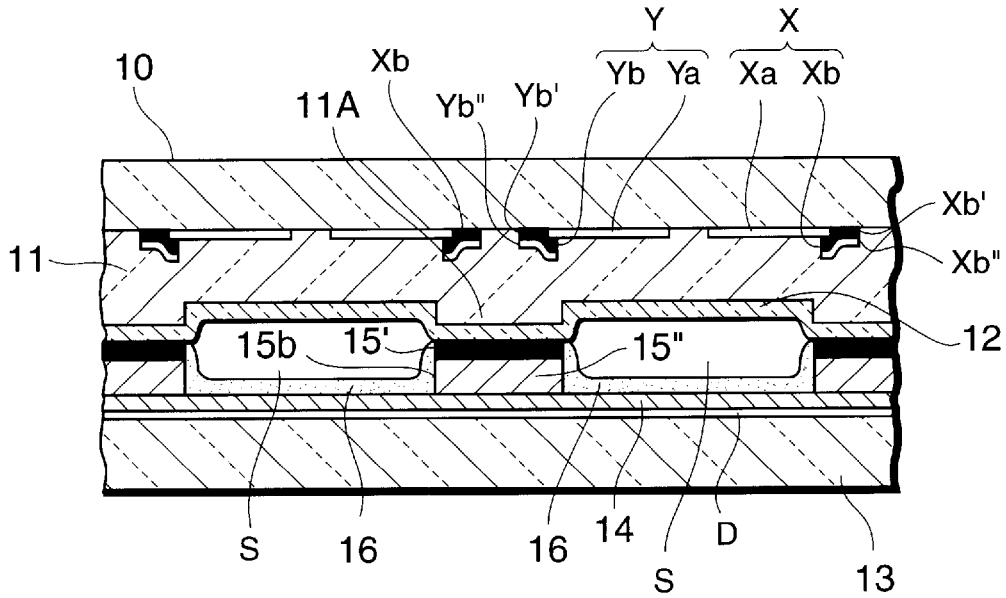
FIG. 2 is a cross sectional view taken along a line V1—V1 in FIG. 1.
Figure 4:
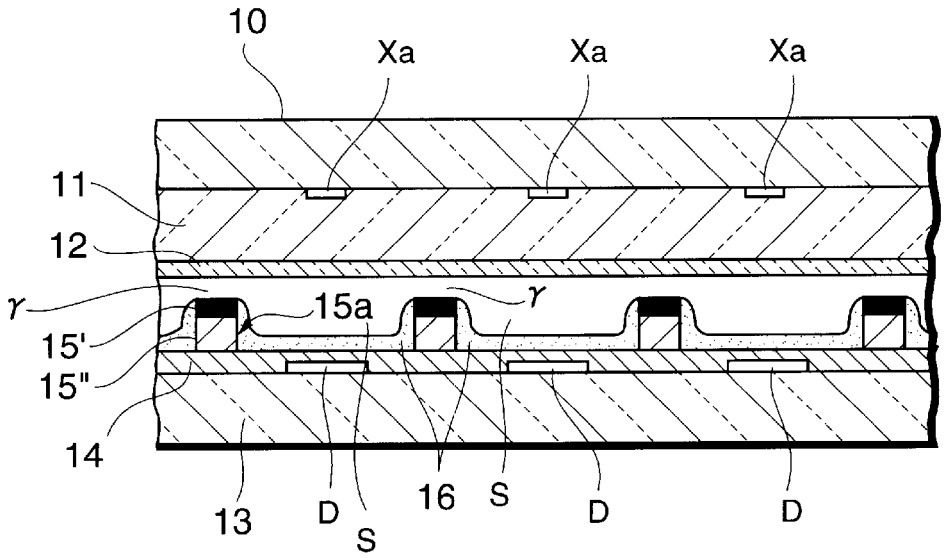
FIG. 4 is a cross sectional view taken along a line W1—W1 in FIG. 1.

Further, a white color dielectric layer 14 is formed on the inner surface of the rear glass substrate 13 so as to cover up all the column electrodes D. Moreover, a plurality of mutually orthogonal partition walls 15*a*, 15*b* are formed on the dielectric layer 14, thus forming a #-like partition wall assembly 15, as shown in FIGS. 1, 2 and 4.

The white color dielectric layer 14 may be formed by applying a glass paste (in which a white pigment has been mixed) to the inner surface of the rear glass substrate 13 and the column electrodes D, followed by a drying treatment.

The partition walls 15*a* are longitudinal partition walls arranged in the column direction of the panel, while the partition walls 15*b* are lateral partition walls arranged in the row direction of the panel and located in positions corresponding to the projection portions 11A of the dielectric layer 11.

By virtue of the #-like partition wall assembly 15, an electric discharge space formed between the front glass substrate 10 and the rear glass substrate 13 is divided into a plurality of smaller discharge spaces S (FIG. 1) each enclosing a pair of mutually facing T-shaped transparent electrodes Xa, Ya between a pair of row electrodes (X, Y).

In detail, each of the partition walls 15*a* and 15*b* has a two-layer structure including a black color layer (light absorbing layer) 15' (facing the front glass substrate 10) and a white color layer (light reflecting layer) 15" (facing the rear glass substrate 13).

The #-like partition wall assembly 15 may be formed in the following process. At first, a low melting point glass paste uniformly containing a white color pigment and a low melting point glass paste uniformly containing a black color pigment are applied successively to the dielectric layer 14, followed by a drying treatment. Then, a #-like mask is employed to selectively cut the thus formed white glass layer and the black glass layer by virtue of a sand blast treatment, thereby forming the desired #-like partition wall assembly 15.

As shown in FIG. 4, a gap r is formed between each longitudinal partition wall 15*a* and the protection layer 12. On the other hand, as shown in FIG. 2, there is not any gap formed between the lateral partition walls 15*b* and the protection layer 12.

A fluorescent layer 16 is formed in a manner such that it covers the side surfaces (facing the discharge spaces S) of the longitudinal partition walls 15*a* and the lateral partition walls 15*b*, further covers the exposed portions (facing the discharge spaces S) of the dielectric layer 14.

The fluorescent layer 16 is arranged such that its different color portions (R, G, B) are arranged repeatedly in the discharge spaces S in the row direction of the panel.

Then, a noble gas is sealed into the discharge spaces S.

In a plasma display panel constituted in the above manner, the row electrode pairs (X, Y) are used to form displaying lines L for a matrix display, while the discharge spaces S formed by the #-like partition wall assembly 15 are used to form discharge cells C.

The operation of the plasma display panel made according to the present embodiment may be performed in the same manner as in the above-discussed prior art.

Namely, at first, an addressing operation is conducted so that an electric discharge is effected selectively among the discharge cells C between the row electrode pairs (X, Y) and the column electrodes D. As a result, a plurality of lit-up cells (discharge cells C where wall charges have been formed in the dielectric layer 11) and a plurality of extinguished cells (discharge cells C where wall charges are not formed in the dielectric layer 11) are distributed on the panel corresponding to a picture to be displayed.

Subsequently, discharge sustaining pulses are simultaneously applied to all the displaying lines L in a manner such that the row electrode pairs (X, Y) will alternatively receive the discharge sustaining pulses. In this manner, surface discharge phenomenon will occur in lit-up cells once the discharge sustaining pulses are applied.

At this moment, since ultraviolet light will be generated due to the surface discharge in the lit-up cells, the fluorescent layer 16 (R, G, B) will be excited to effect light emission, thereby displaying a picture on the plasma display panel.

In the plasma display panel of the present embodiment, since a fluorescent layer 16 is provided on the dielectric layer 14 to cover not only the exposed portions of the dielectric layer 14 but also all the side faces (facing the discharge spaces S) of the partition wall assembly 15, the surface area of the fluorescent layer 16, i.e., a light emission area within each discharge cell C has been increased, thus increasing the brightness of a picture being displayed on the panel.

At this time, even if the size of each discharge cell C is made smaller in order to increase a fineness and a clarity of a picture being displayed, it is still allowed to ensure a required brightness for a picture.

Further, as shown in FIG. 1, since the T-shaped transparent electrodes Xa, Ya of each row electrode pair (X, Y) are facing each other and are independently enclosed in discharge cells C (i.e., one discharge cell C contains one pair of transparent electrodes Xa, Ya), even if the size of each discharge cell C is made smaller in order to increase a fineness and a clarity of a picture being displayed, it is sure to prevent a discharge interference from one discharge cell to an adjacent discharge cell in the row direction of the panel (along each displaying line L).

Figure 5:
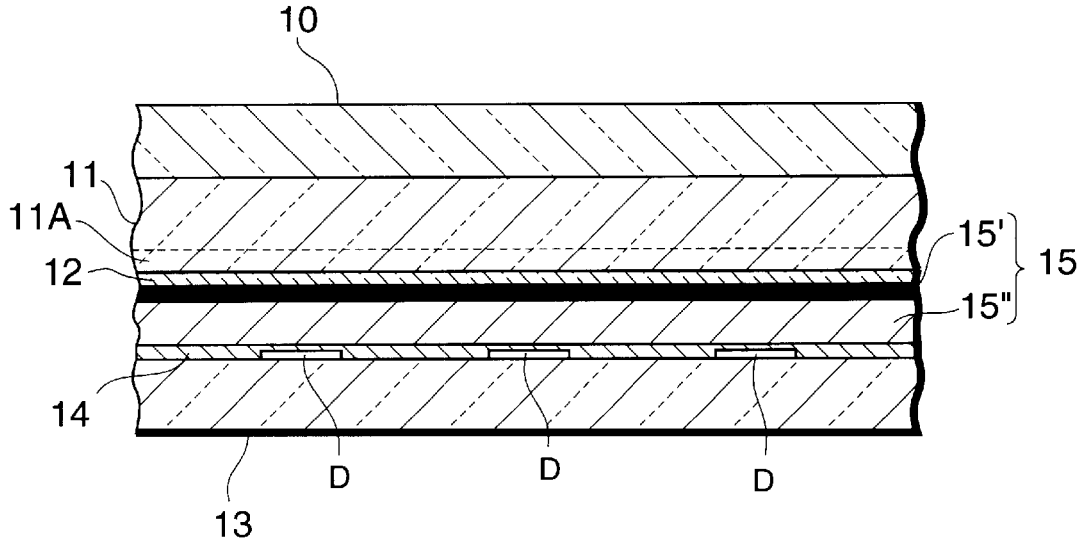
FIG. 5 is a cross sectional view taken along a line W2—W2 in FIG. 1.

Moreover, since the projection portions 11A are formed on the dielectric layer 11, and since the protection layer 12 covering the projection portions 11A are in tight contact with the lateral partition walls 15*b*, mutually adjacent discharge spaces S of mutually adjacent cells C in the column direction of the panel are isolated from each other (FIGS. 2 and 5). Therefore, it is also sure to prevent a discharge interference from one discharge cell to an adjacent discharge cell in the column direction of the panel.

Figure 3:
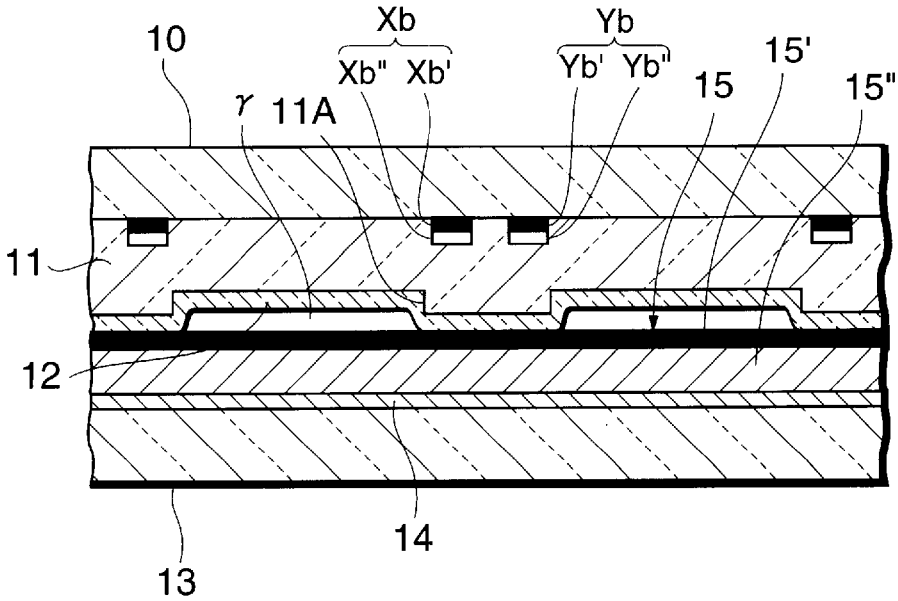
FIG. 3 is a cross sectional view taken along a line V2—V2 in FIG. 1.

On the other hand, as shown in FIGS. 3 and 4, the upper surface of each longitudinal partition wall 15*a* is facing some areas (not having projections 11A) of the dielectric layer 11, forming a slot r between the upper surface of each longitudinal partition wall 15*a* and the protection layer 12. In this way, mutually adjacent discharge spaces S of mutually adjacent discharge cells C in the row direction of the panel (along each displaying line L) are connected with one another through the slots r, thereby producing a priming effect enabling a kind of chain discharge (discharging continuously from one cell to another), thus ensuring a stabilized discharge in the plasma display panel.

In addition, since the black color electrically conductive layers Xb', Yb' (facing the front glass substrate 10) are formed in the manner as shown in FIGS. 2 and 3, it is sure to prevent a reflection of an external light coming from the outside through the front glass substrate 10, thereby enabling an improvement in the contrast of a picture being displayed on the plasma display panel.

Further, since the dielectric layer 14 formed on the inner surface of the rear glass substrate 13 is white in color, lights emitted by the fluorescent layer 16 are reflected towards the front glass substrate 10, thereby preventing the light from escaping towards the rear glass substrate 13, thus increasing the brightness of a picture being displayed on the panel.

Moreover, the dielectric layer 14 can also serve as a protection layer during a sand blast treatment.

In addition, since the black color layer 15' is formed on the partition assembly 15, it is further sure to prevent a reflection of an external light coming from the outside through the front glass substrate 10, thereby enabling a further improvement in the contrast of a picture being displayed on the plasma display panel.

Further, since the side faces of the partition wall assembly 15 are mainly formed by the white color layer 15", lights emitted by the fluorescent layer 16 are reflected towards the front glass substrate 10, thus increasing the brightness of a picture being displayed on the panel.

Second Embodiment

Figure 6:
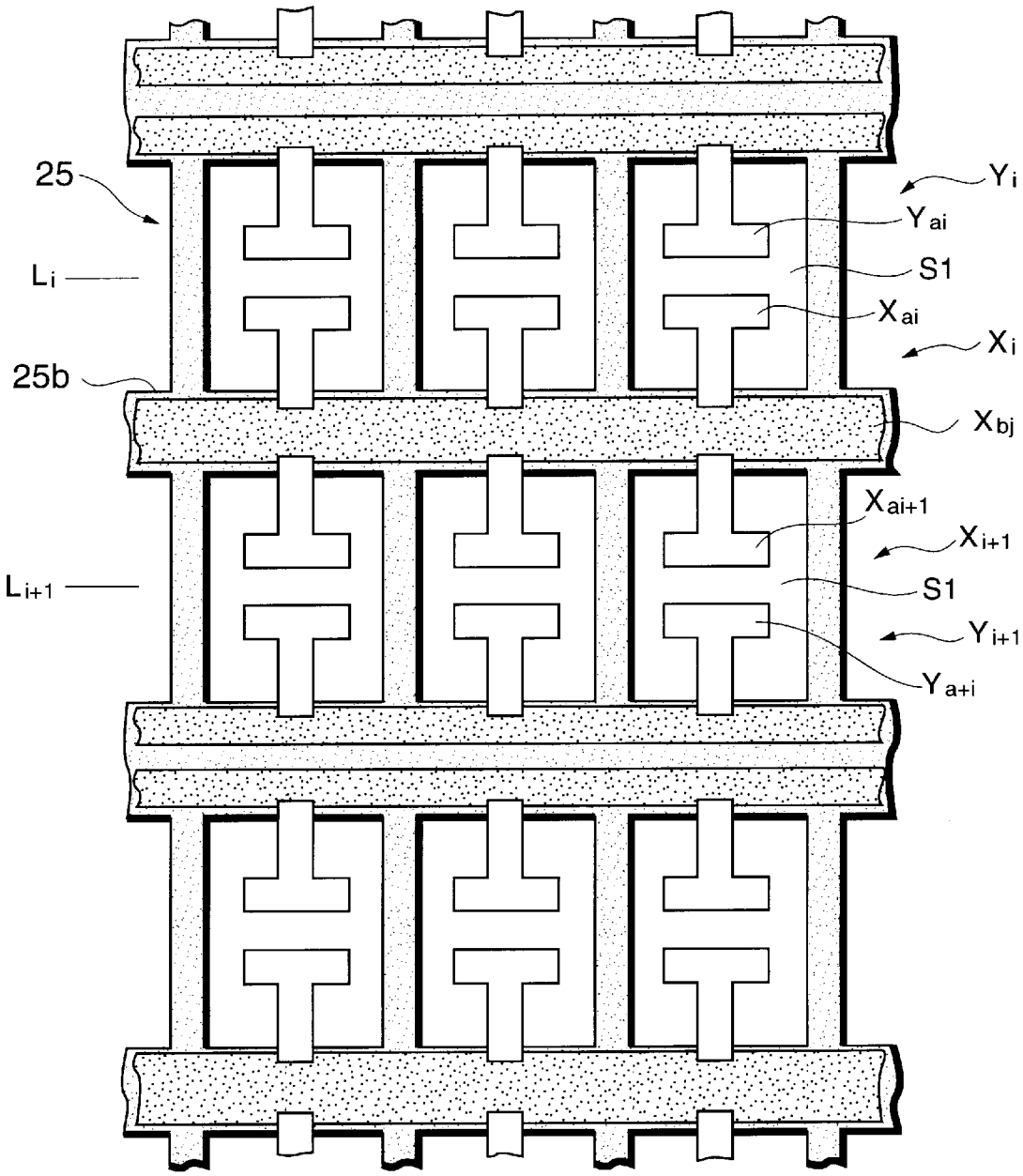
FIG. 6 is a plane view indicating a plasma display panel according to a second embodiment of the present invention.

A second embodiment of the present invention is illustrated in FIG. 6.

As shown in FIG. 6, a plasma display panel according to the second embodiment includes a plurality of displaying lines Li, Li+1 . . . , along which there are disposed row electrodes (Xi, Yi) in accordance with an arrangement of (Yi, Xi), (Xi+1, Yi+1) . . . in the column direction of the panel.

In this way, T-shaped transparent electrodes (Xai, Xai+1) of mutually adjacent row electrodes (Xi, Xi+1) are allowed to be connected to a common (elongated) bus electrode Xbj, thus enabling a total area occupied by the elongated bus electrodes to be smaller than that in the plasma display panel of the first embodiment (FIGS. 1–5).

Further, each lateral wall 25*b* of a #-like partition wall assembly 25 is allowed to be narrower in its width than that in the plasma display panel of the first embodiment (FIGS. 1–5), thus ensuring each discharge space S1 to be larger than that in the first embodiment, thereby making it possible to increase a total surface area of a fluorescent layer within each discharge space S1, thus desirably increasing the brightness of the plasma display panel.

Moreover, with the use of the common (elongated) bus electrodes Xbj, it is allowed to reduce a discharge current during an electric discharge of the plasma display panel.

In addition, it is also possible that mutually adjacent T-shaped transparent electrodes (Xai, Xai+1) of mutually adjacent row electrodes (Xi, Xi+1) may be connected to each other at the end portions thereof.

Third Embodiment

Figure 7:
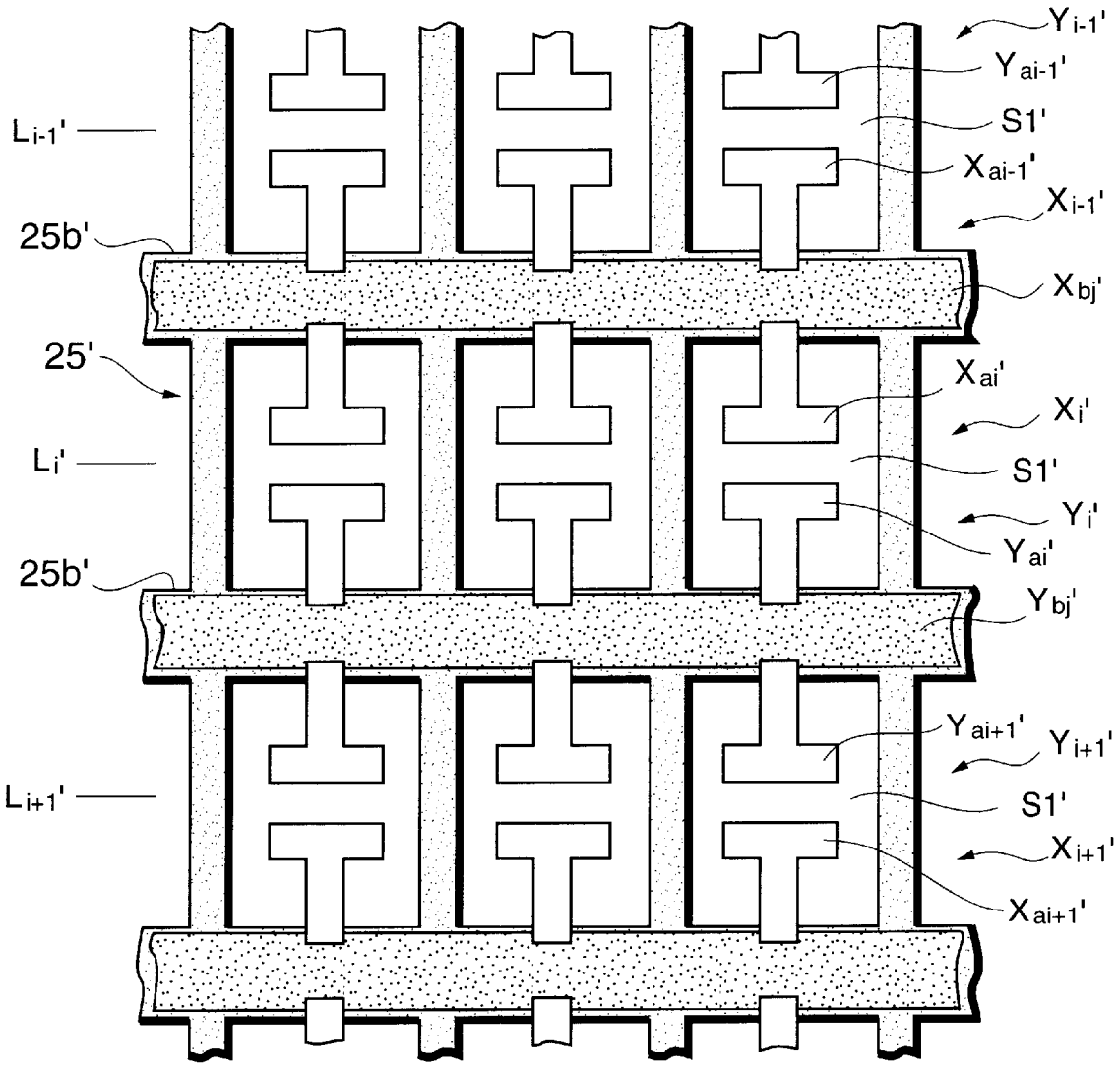
FIG. 7 is a plane view indicating a plasma display panel according to a third embodiment of the present invention.

A third embodiment of the present invention is illustrated in FIG. 7.

As shown in FIG. 7, a plasma display panel according to the third embodiment includes a plurality of displaying lines Li—1', Li', Li+1' . . . , along which there are disposed row electrodes (Xi', Yi'), in accordance with an arrangement of (Yi−1', Xi—1'), (Xi', Yi'), (Yi+1', Xi+1') . . . in the column direction of the panel.

In fact, T-shaped transparent electrodes (Xai−1', Xai') of mutually adjacent row electrodes (Xi−1', Xi') are allowed to be connected to a common (elongated) bus electrode Xbj', transparent electrodes (Yai', Yai+1') of mutually adjacent row electrodes (Yi', Yi+1') are allowed to be connected to a common (elongated) bus electrode Ybj'.

In this way, with respect to mutually adjacent displaying lines (Li−1', Li'), mutually adjacent row electrodes (Xi−1', Xi') are allowed to use a common bus electrode Xbj'. Similarly, with respect to mutually adjacent displaying lines (Li', Li+1'), mutually adjacent row electrodes (Yi', Yi+1') are allowed to use a common bus electrode Ybj'. Such arrangement enables a total area occupied by elongated bus electrodes to be smaller than that in the plasma display panel of the second embodiment (FIG. 6).

Further, each lateral partition wall 25*b*' of a #-like partition wall assembly 25' is allowed to be narrower in its width than that in the plasma display panel of the first embodiment (FIGS. 1–5), thus ensuring each discharge space S1' to be larger than that in the first embodiment, thereby making it possible to increase a total surface area of a fluorescent layer within each discharge space S1', thus desirably increasing the brightness of the plasma display panel.

Moreover, with the use of common bus electrodes Xbj', Ybi', it is possible to reduce a discharge current during an electric discharge of the plasma display panel.

Figure 8:
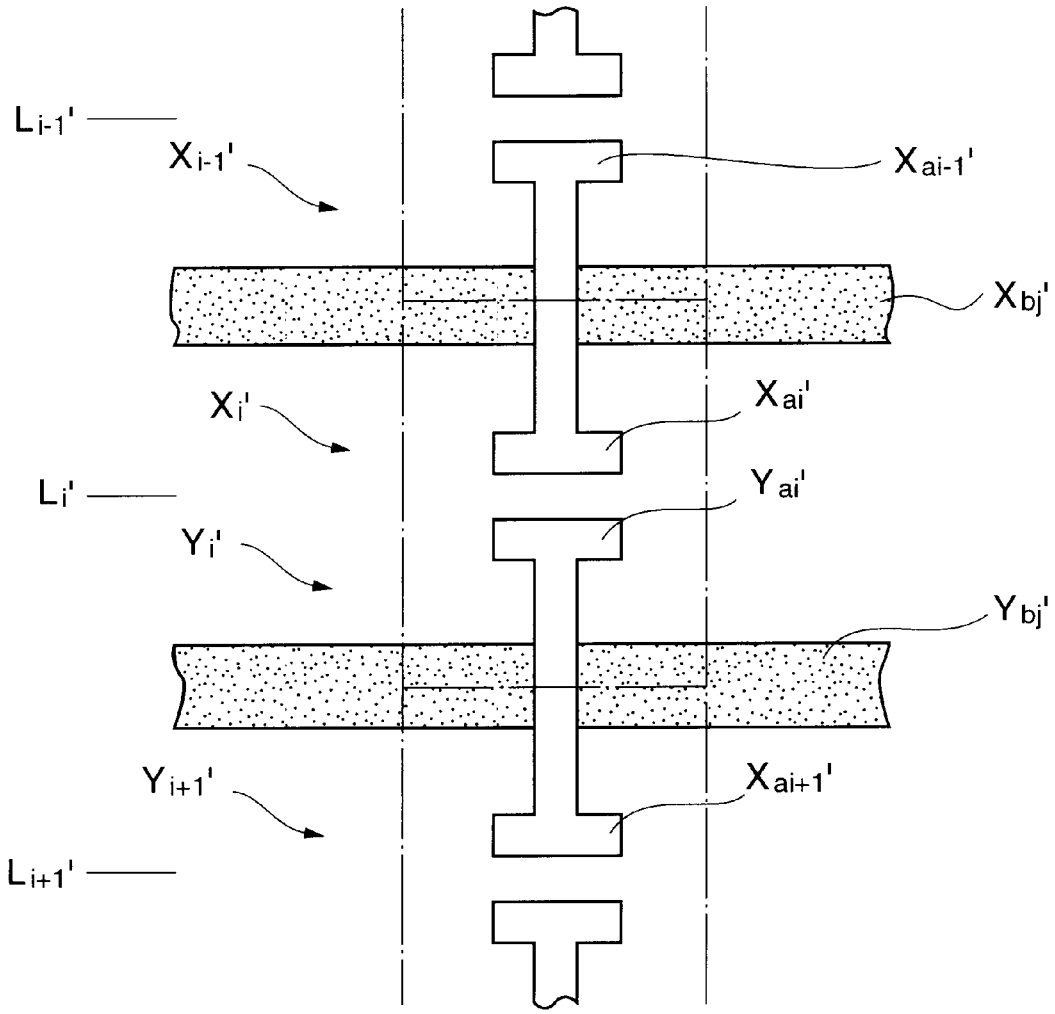
FIG. 8 is a plane view indicating a modified example of the third embodiment shown in FIG. 7.
Figure 9:
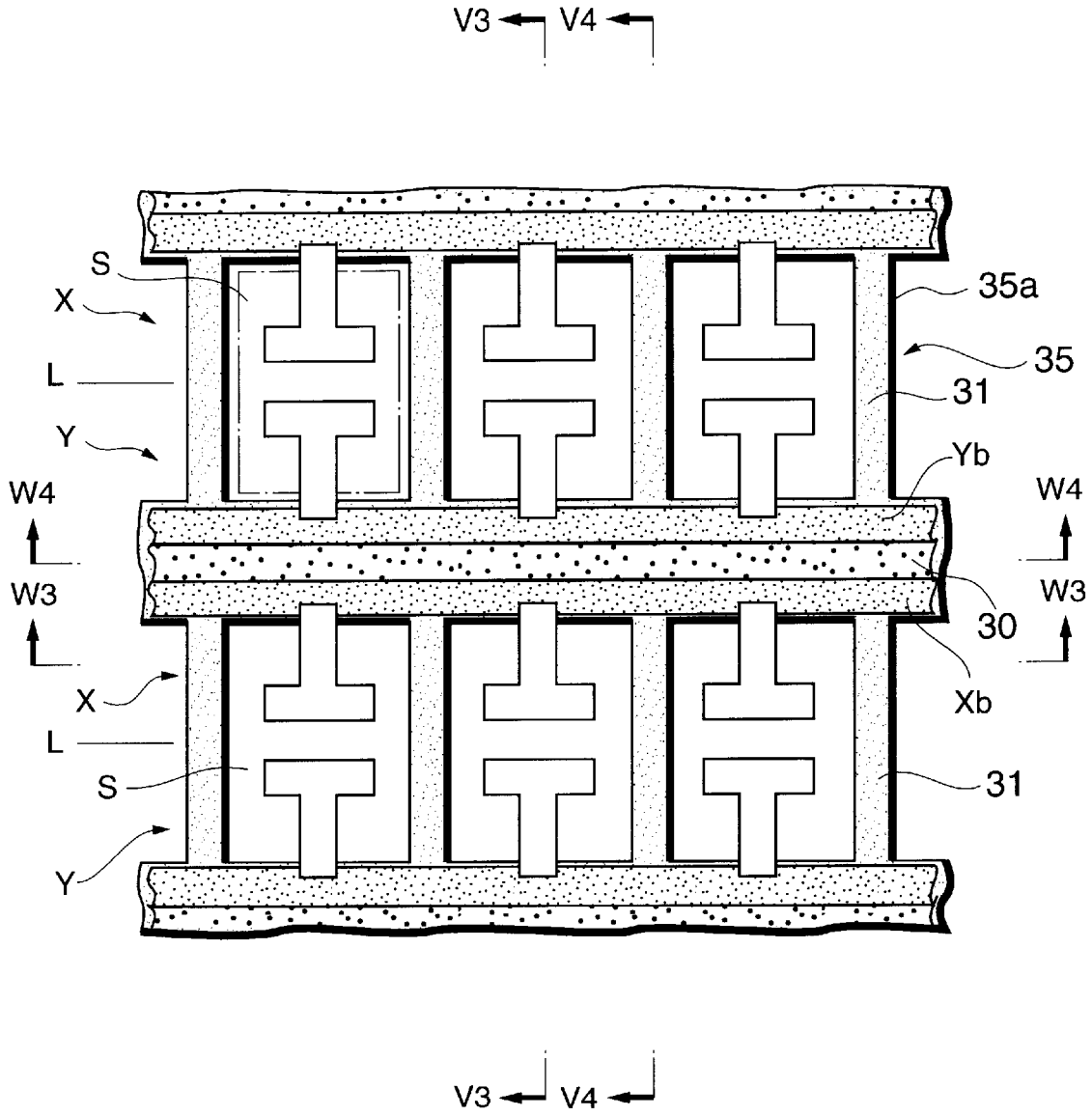
FIG. 9 is a plane view indicating a plasma display panel according to a fourth embodiment of the present invention.
Figure 10:
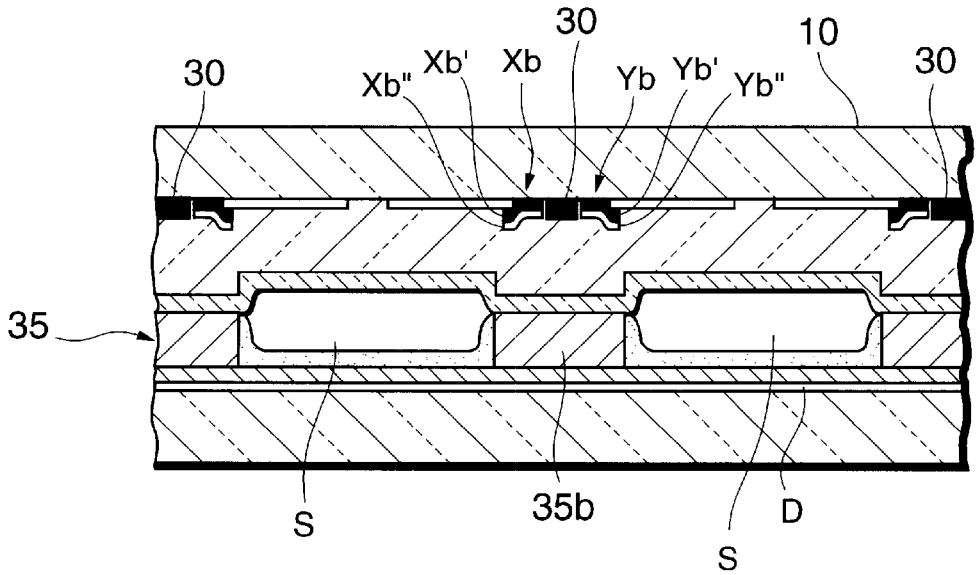
FIG. 10 is a cross sectional view taken along a line V3—V3 in FIG. 9.
Figure 11:
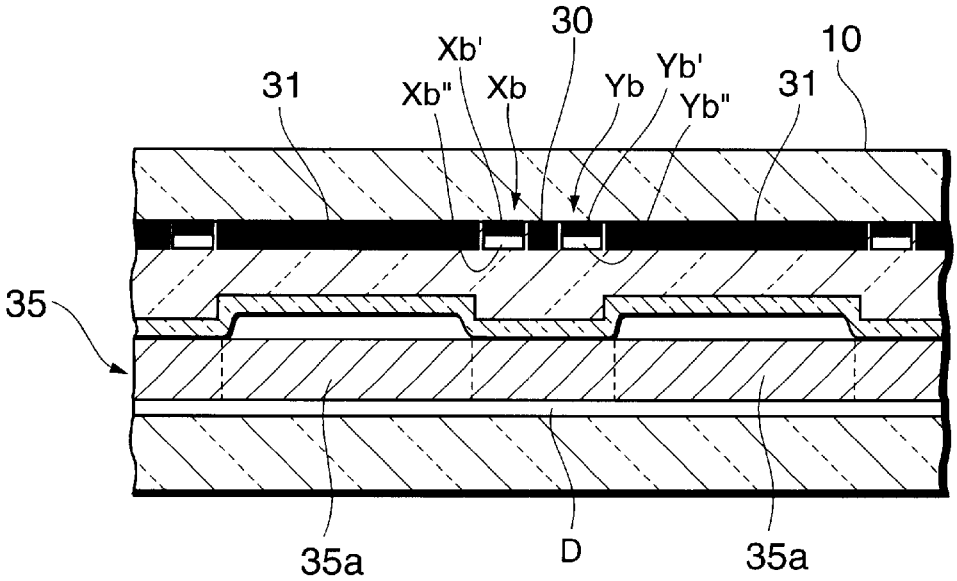
FIG. 11 is a cross sectional view taken along a line V4—V4 in FIG. 9.
Figure 12:
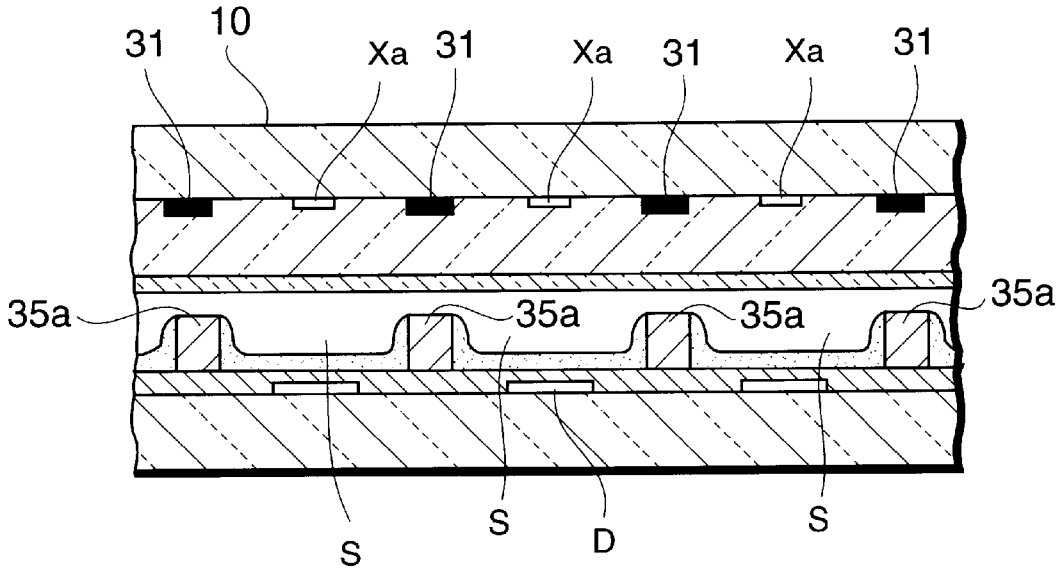
FIG. 12 is a cross sectional view taken along a line W3—W3 in FIG. 9.
Figure 13:
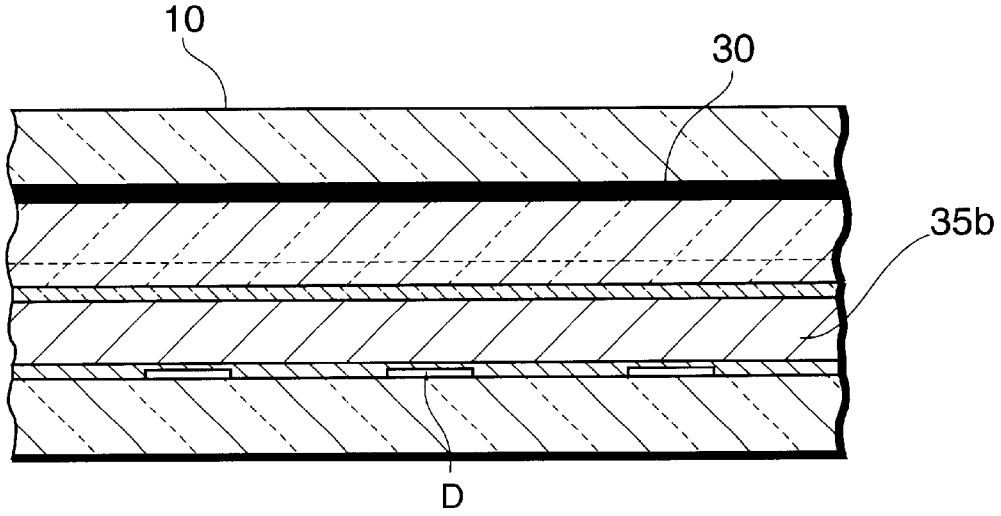
FIG. 13 is a cross sectional view taken along a line W4—W4 in FIG. 9.

In addition, as shown in FIG. 8, it is possible that mutually adjacent T-shaped transparent electrodes (Xai−1', Xai') of mutually adjacent row electrodes (Xi−1', Xi') may be integrally connected to each other at the end portions thereof. Similarly, it is also possible that mutually adjacent T-shaped transparent electrodes (Yai', Xai+1') of mutually adjacent row electrodes (Yi', Yi+1') may be integrally connected to each other at the end portions thereof.

Fourth Embodiment

A fourth embodiment of the present invention is illustrated in FIGS. 9–13.

As shown in FIGS. 9–13, a plasma display panel according to the fourth embodiment is almost the same as the plasma display panel of the first embodiment (FIGS. 1–5) except the following differences.

Namely, the inner surface of the front glass substrate 10 has formed thereon a plurality of lateral light absorbing straps (light blocking straps) 30 and a plurality of longitudinal light absorbing straps (light blocking straps) 31. In detail, the lateral light absorbing straps 30 are so arranged that each of them is disposed between mutually adjacent (elongated) bus electrodes Yb, Xb of mutually adjacent row electrodes (X, Y). On the other hand, longitudinal light absorbing straps 31 are so formed that each of them is facing a longitudinal partition wall 35*a* of a #-like partition wall assembly 35.

The #-like partition wall assembly 35 has a single-layer structure white in color, which is a difference between the fourth embodiment and the first embodiment.

In this way, all the portions on the inner surface of the front glass substrate 10 except those facing the discharge spaces S are covered up by the light absorbing straps 30, 31 and the black color electrically conductive layers Xb', Yb' (as in the first embodiment). Therefore, it is sure to prevent a reflection of an external light coming from outside through the front glass substrate 10, thereby enabling an improvement in the contrast of a picture being displayed on the plasma display panel.

Nevertheless, it is also allowed to provide only one sort of the two kinds of the light absorbing straps 30, 31, i.e., it is also possible to provide either the lateral straps 30 or the longitudinal straps 31.

Further, on the inner surface of the front glass substrate 10, there may be formed many pieces of different color filters (not shown) corresponding to different color portions (R, G, B) of the fluorescent layer 16 (located in the discharge spaces S).

At this time, the two kinds of the light absorbing straps 30, 31 may be located in positions corresponding to slots formed between the different color filters facing the discharge spaces S.

Fifth Embodiment

Figure 14:
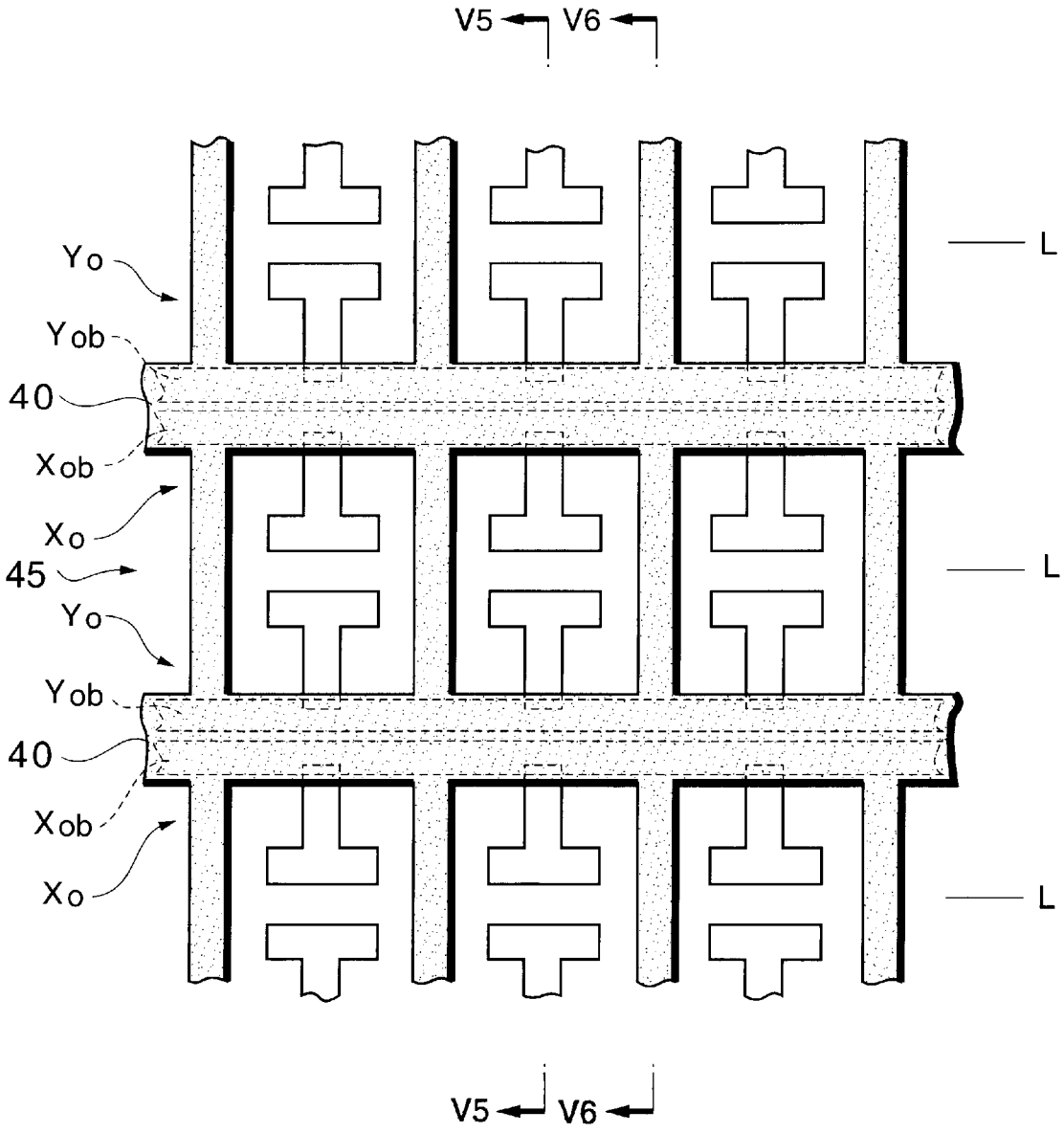
FIG. 14 is a plane view indicating a plasma display panel according to a fifth embodiment of the present invention.
Figure 15:
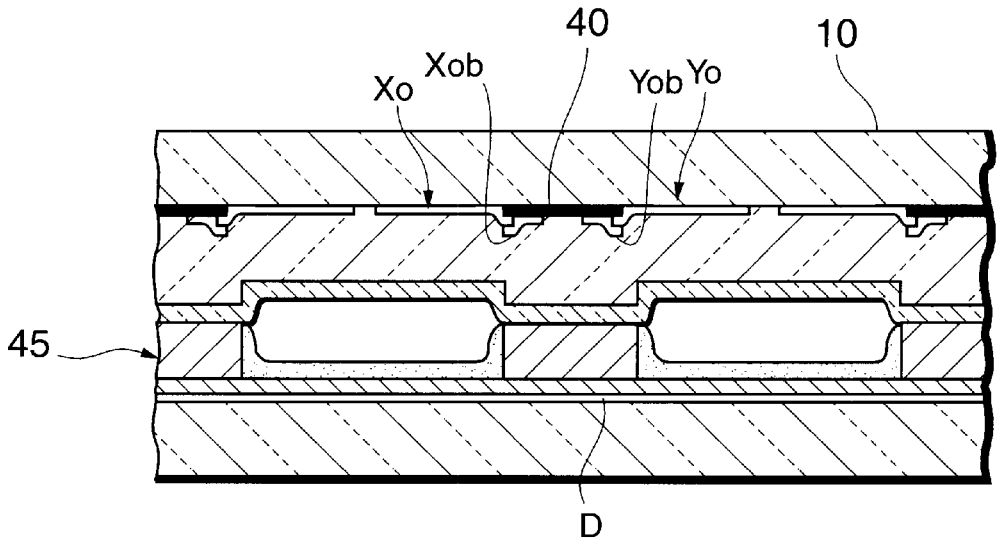
FIG. 15 is a cross sectional view taken along a line V5—V5 in FIG. 14.
Figure 16:
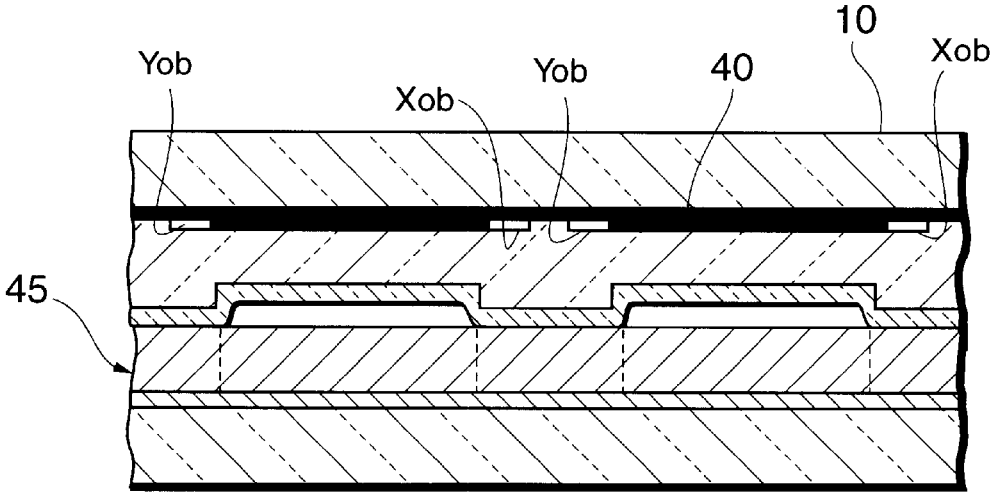
FIG. 16 is a cross sectional view taken along a line V6—V6 in FIG. 14.

A fifth embodiment of the present invention is illustrated in FIGS. 14–16.

As shown in FIGS. 14–16, a plasma display panel according to the fifth embodiment is almost the same as the plasma display panel of the first embodiment (FIGS. 1–5) except the following differences.

Namely, the inner surface of the front glass substrate 10 has formed thereon a #-like light absorbing layers 40 corresponding to the entire (all portions of) #-like partition wall assembly 45.

Bus electrodes Xob, Yob of row electrodes Xo, Yo are each formed by only one layer which is an electrically conductive layer, located under the light absorbing layers 40.

In this way, since the inner surface of the front glass substrate 10 is covered by the light absorbing layers 40 except the portions facing the discharge spaces S, it is sure to prevent a reflection of an external light coming from outside through the front glass substrate 10, thereby enabling an improvement in the contrast of a picture being displayed on the plasma display panel.

Sixth Embodiment

Figure 17:
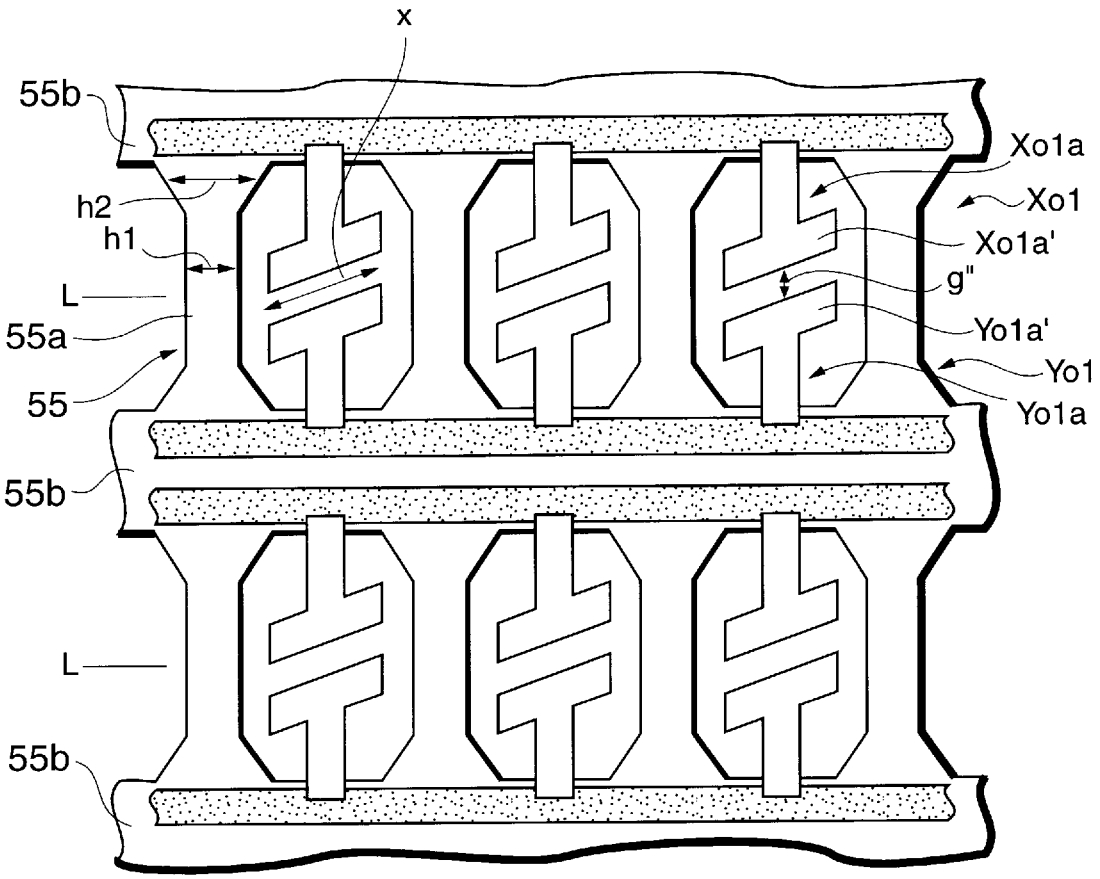
FIG. 17 is a plane view indicating a plasma display panel according to a sixth embodiment of the present invention.

A sixth embodiment of the present invention is illustrated in FIG. 17.

As shown in FIG. 17, a plasma display panel according to the sixth embodiment has a partition wall assembly 55 including longitudinal partition walls 55*a* and lateral partition walls 55*b*.

In particular, each longitudinal partition wall 55*a* has a width h1 which is larger than that in any of the previous embodiments. Further, each end portion of each length (extending between two lateral partition walls 55*b*) of each longitudinal partition wall 55*a* becomes larger towards a lateral partition wall 55*b*.

Moreover, T-shaped transparent electrodes Xo1*a*, Yo1*a* of row electrodes Xo1, Yo1 have head portions Xo1*a*', Yo1*a*' which are inclined with respect to the displaying lines L and are facing each other with gaps g" formed therebetween.

In this way, if each longitudinal partition wall 55*a* has a larger width, and if a black color layer is formed on the longitudinal partition wall 55*a* (in the same manner as in the first embodiment shown in FIGS. 1–5), and further, if black color light blocking straps (or layers) are formed on. the inner surface of the front glass substrate 10 in positions corresponding to the partition wall assembly 55 (in the same manner as in the fourth and fifth embodiments shown in FIGS. 9–16), these black color layers (or straps) may be made larger in their areas, thereby making it more exact to prevent a reflection of an external light coming from outside.

Referring again to FIG. 17, each discharge gap g" has a length x which is required to be 200–250 microns in order to reduce a discharge starting voltage. If the length is longer than 250 microns or shorter than 200 microns, the discharge starting voltage will undesirably increase.

Seventh Embodiment

Figure 18:
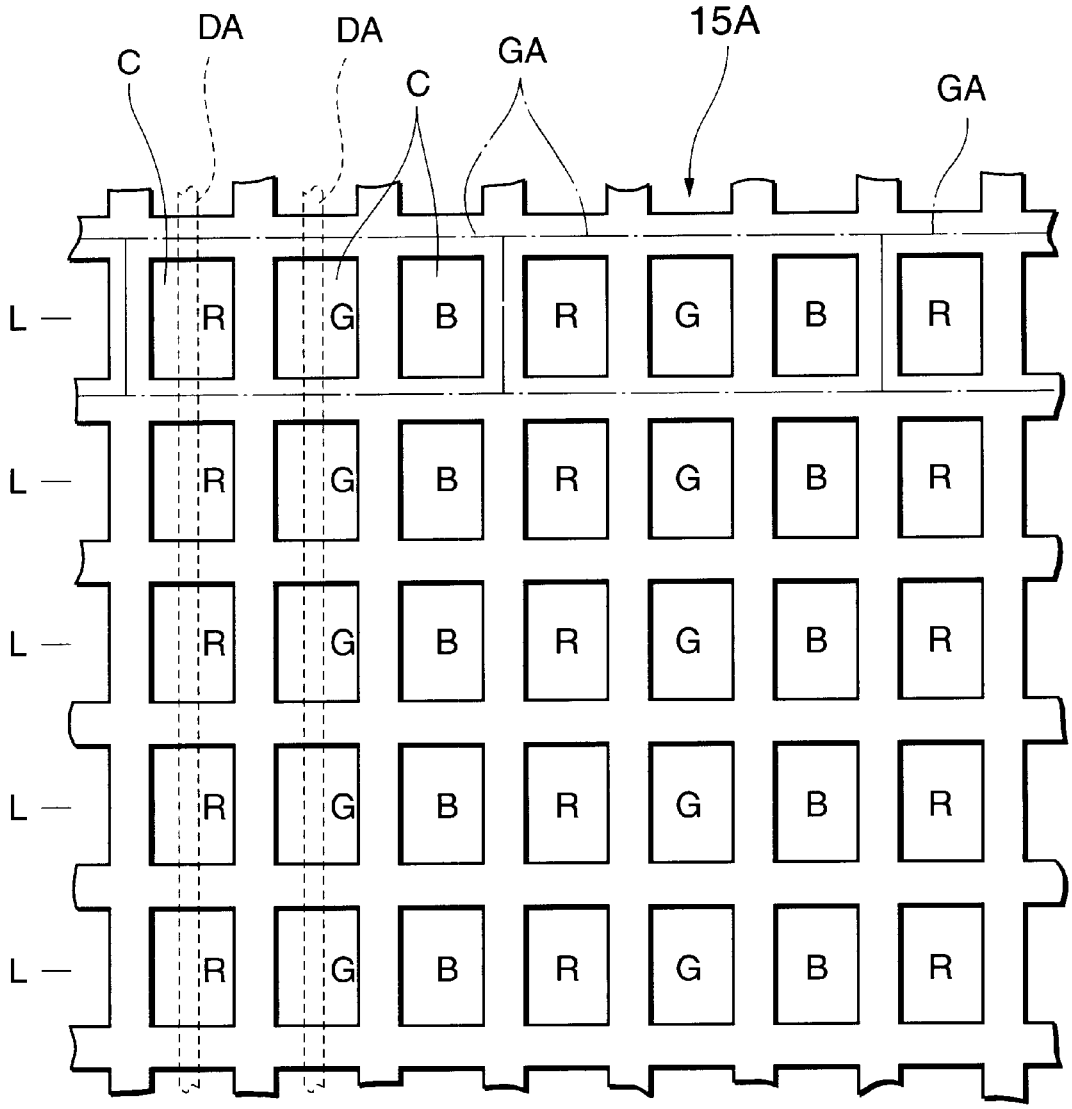
FIG. 18 is a plane view indicating a plasma display panel according to a seventh embodiment of the present invention.

A seventh embodiment of the present invention is illustrated in FIG. 18.

FIG. 18 is a plane view schematically indicating how a plurality of picture elements are formed by virtue of a plurality of discharge cells C including three kinds of colors R, G, B.

As shown in FIG. 18, a plurality of discharge cells C are formed by virtue of a #-like partition wall assembly 15A. DA is used to represent column electrodes.

The discharge cells C are arranged in each displaying line L (row direction) in the order of R, G, B repeatedly, and in each column (column direction) there are arranged a plurality of discharge cells belonging to only one kind of color.

In fact, every three discharge cells C (R, G, B) arranged in a display line L will form one picture element GA. Thus, a plurality of picture elements GA are aligned in the column direction.

Eighth Embodiment

Figure 19:
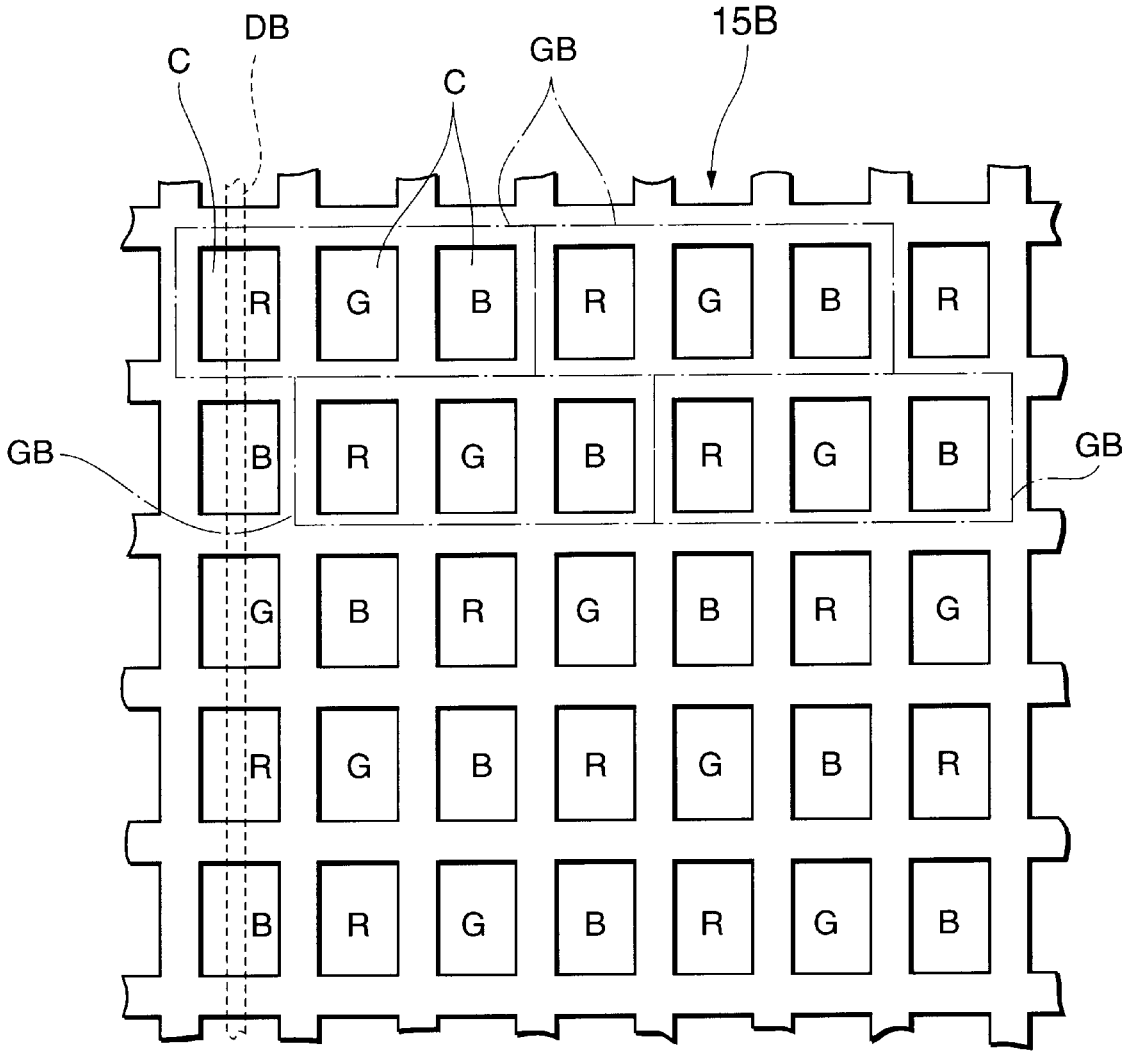
FIG. 19 is a plane view indicating a plasma display panel according to an eighth embodiment of the present invention.

An eighth embodiment of the present invention is illustrated in FIG. 19.

FIG. 19 is also a plane view schematically indicating how a plurality of picture elements are formed by virtue of a plurality of discharge cells C including three kinds of colors R, G, B.

As shown in FIG. 19, a plurality of discharge cells C are formed by virtue of a #-like partition wall assembly 15B. DB is used to represent column electrodes.

The discharge cells C are arranged in each displaying line L (row direction) in the order of R, G, B repeatedly, but with one displaying line L being deviated from its adjacent displaying line L by one discharge cell C in the row direction (arranged in a manner shown in FIG. 19).

In fact, every three discharge cells C (R, G, B) arranged in a display line L will form one picture element GB. Thus, when viewed in the column direction, one picture element GB is deviated from its adjacent (in column direction) picture element GB by one discharge cell C in the row direction.

In this way, since one picture element GB is deviated (when viewed in the column direction) from its adjacent (in column direction) picture element GB by one discharge cell C in the row direction, it is possible to improve the resolution of a picture being displayed on the panel.

Ninth Embodiment

Figure 20:
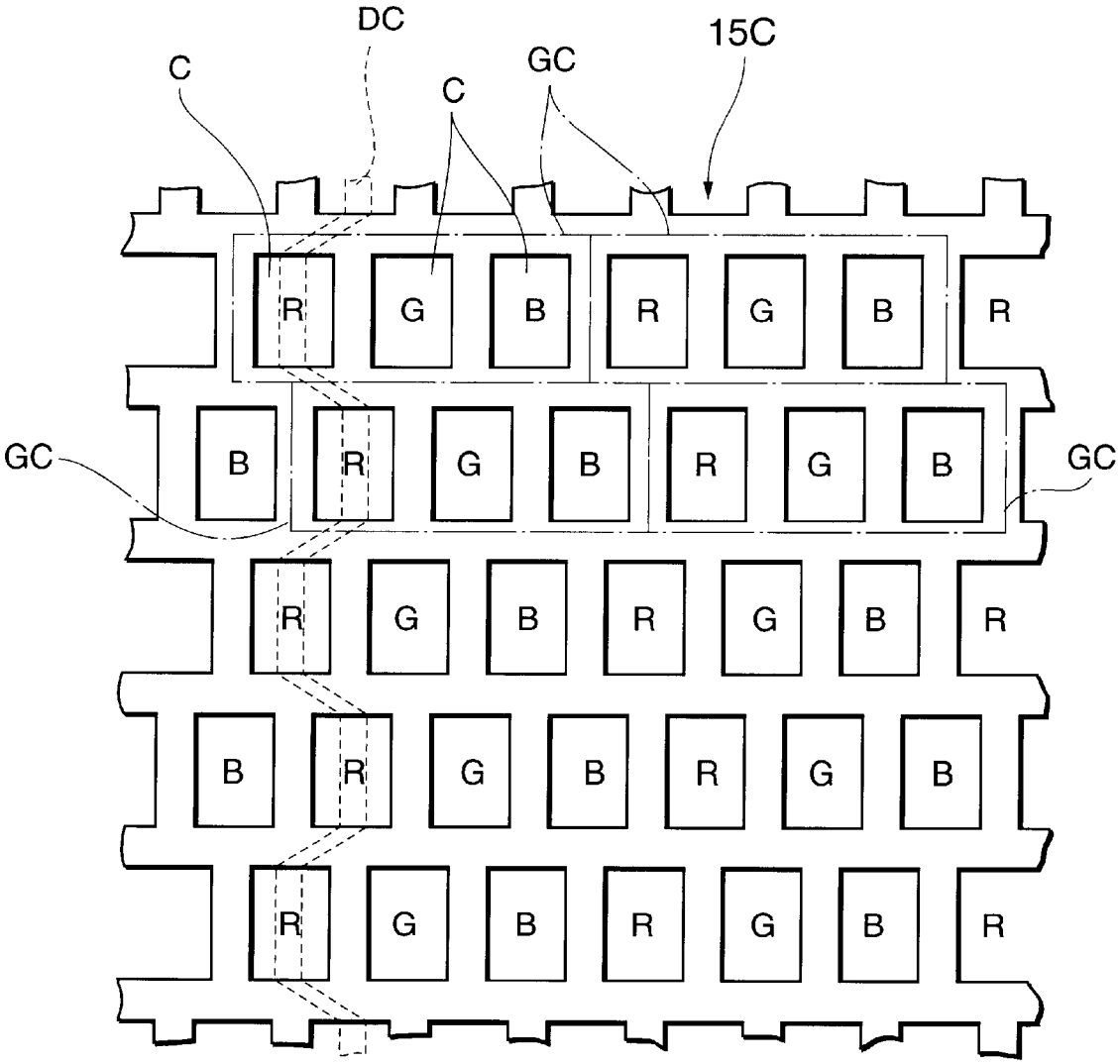
FIG. 20 is a plane view indicating a plasma display panel according to a ninth embodiment of the present invention.

A ninth embodiment of the present invention is illustrated in FIG. 20.

FIG. 20 is also a plane view schematically indicating how a plurality of picture elements are formed by virtue of a plurality of discharge cells C including three kinds of colors R, G, B.

As shown in FIG. 20, a plurality of discharge cells C are formed by virtue of a #-like partition wall assembly 15C. DC is used to represent column electrodes.

In particular, when viewed in the column direction, two mutually adjacent (in column direction) discharge cells C are deviated from each other by half width of one cell C in the row direction.

Accordingly, each of color portions R, G, B of one displaying line L is deviated from a corresponding color portion of an adjacent displaying line L by half width of one cell C in the row direction.

For this reason, the column electrodes DC are formed in a zigzag configuration as shown in FIG. 20, thereby permitting the formation of the arrangement of discharge cells C shown in FIG. 20.

In this manner, since each picture element GC consists of three discharge cells C (R, G, B) arranged in the row direction, each of color portions R, G, B of one picture element on one displaying line L is deviated (in the row direction) from a corresponding color portion of a corresponding picture element of an adjacent displaying line L by half width of one cell C, it is allowed to further improve the resolution of a picture being displayed on the panel.

Tenth Embodiment

Figure 21:
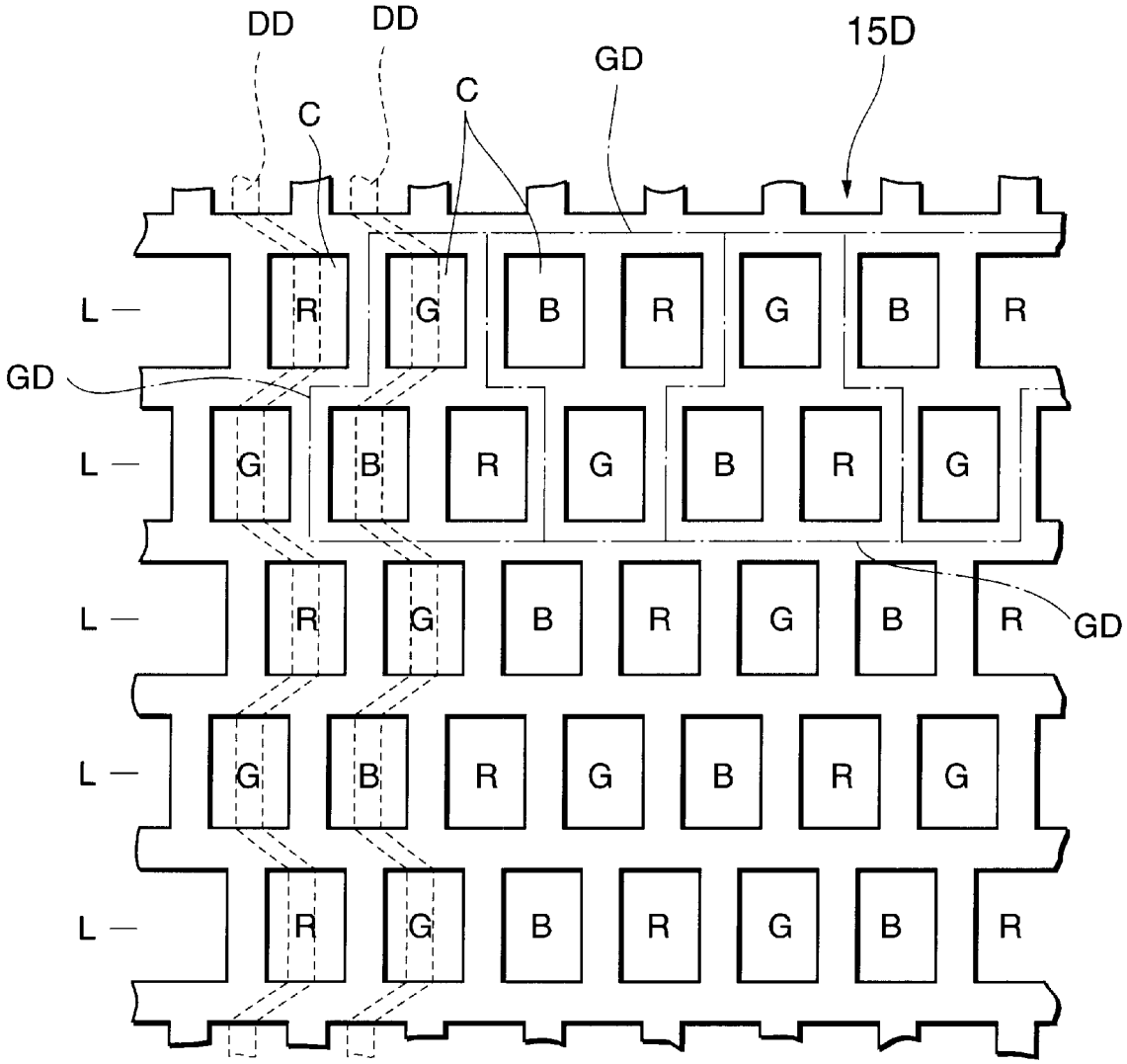
FIG. 21 is a plane view indicating a Plasma display panel according to a tenth embodiment of the present invention.

A tenth embodiment of the present invention is illustrated in FIG. 21.

FIG. 21 is also a plane view schematically indicating how a plurality of picture elements are formed by virtue of a plurality of discharge cells C including three kinds of colors R, G, B.

As shown in FIG. 21, a plurality of discharge cells C are formed by virtue of a #-like partition wall assembly 15D. DD is used to represent column electrodes.

In particular, when viewed in the column direction, two mutually adjacent (in column direction) discharge cells C are deviated from each other by half width of one cell C in the row direction.

In more detail, each of color portions R, G, B of one displaying line L is deviated (in the row direction) from a corresponding color portion of an adjacent displaying line L by 1.5 times the width of one cell C.

Accordingly, similar to the ninth embodiment, the column electrodes DD are formed in a zigzag configuration as shown in FIG. 21, thereby permitting the formation of the arrangement of discharge cells C shown in FIG. 21.

In this manner, as shown in FIG. 21, each pitch element GD may also be formed by three discharge cells (R, G, B)

which together form a triangular configuration bridging over two mutually adjacent displaying lines L, thereby further improving the resolution of a picture being displayed on the panel.

Eleventh Embodiment

An eleventh embodiment of the present invention is illustrated in FIGS. 22–26.

Referring to FIGS. 22–26, a surface discharge type AC-driven plasma display panel according to the eleventh embodiment of the present invention has a front glass substrate 10 serving as a displaying surface for the panel, a plurality of row electrode pairs (X,Y) parallelly disposed on the inner surface of the front glass substrate 10.

Each row electrode X includes a plurality of T-shaped transparent electrodes Xa each consisting of a transparent electrically conductive film made of ITO, and an elongated bus electrode Xb consisting of a metal film which is connected with one end of each T-shaped transparent electrode Xa.

Similarly, each row electrode Y includes a plurality of T-shaped transparent electrodes Ya each consisting of a transparent electrically conductive film made of ITO, and an elongated bus electrode Yb consisting of a metal film which is connected with one end of each T-shaped transparent electrode Ya.

Further, two row electrodes (X, Y) forming each row electrode pair are arranged in parallel to each other, with a plurality of discharge gaps g formed between the T-shaped transparent electrodes Xa, Ya, thereby forming one displaying line L for the display panel (matrix display).

The T-shaped transparent electrodes Xa, Ya are formed on the inner surface of the front glass substrate 10 by vapor-depositing ITO thereon, followed by a patterning treatment with the use of a photolithographic method.

On the other hand, each elongated bus electrode Xb includes a black colour electrically conductive layer Xb' (facing the front glass substrate 10) and a main electrically conductive layer Xb". Similarly, each elongated bus electrode Yb includes a black colour electrically conductive layer Yb' (facing the front glass substrate 10) and a main electrically conductive layer Yb".

The elongated bus electrodes Xb, Yb are formed by at first applying a silver paste (in which a black pigment has been mixed) to the inner surface of the front glass substrate 10, followed by a drying treatment, thereby obtaining a dried black color paste layer. Further, a silver paste is applied to the dried black color paste layer, followed by a patterning treatment with the use of a photolithographic method, and further through a sintering treatment, thus forming the bus electrodes Xb, Yb on the inner surface of the front glass substrate 10.

Further, the inner surface of the front glass substrate 10 has formed thereon a plurality of lateral light absorbing straps (light blocking straps) 60 and a plurality of longitudinal light absorbing straps (light blocking straps) 61. In detail, the lateral light absorbing straps 60 are so arranged that each of them is disposed between mutually adjacent (elongated) bus electrodes Yb, Xb of mutually adjacent row electrodes (X, Y). On the other hand, longitudinal light absorbing straps 61 are so formed that each of them is facing a longitudinal partition wall 65*a* of a partition wall assembly 65.

Further, a dielectric layer 11 is formed on the inner surface of the front glass substrate 10 in a manner such that it covers up all the row electrode pairs (X,Y). Moreover, the dielectric layer 11 includes a plurality of projection portions 11A located in positions corresponding to every two adjacent bus electrodes Xb, Yb.

The dielectric layer 11 may be formed by at first preparing an amount of low melting point glass paste and then forming the paste into several layers of films each having a predetermined thickness, followed by laminating the films and a sintering treatment. The projection portions 11A may be formed by screen-printing (with a predetermined thickness) a similar low melting point glass paste on to the dielectric layer 11, followed by a similar sintering treatment.

Then, a protection layer 12 consisting of MgO is formed on the dielectric layer 11.

Similarly, the plasma display panel has a rear glass substrate 13 arranged in parallel with and space-apart from the front glass substrate 10. A plurality of column electrodes D are provided on the inner surface of the rear glass substrate 13, and arranged orthogonal to the row electrode pairs (X, Y), in positions corresponding to the T-shaped transparent electrodes Xa, Ya.

The column electrodes D are formed by vapor-depositing an Al alloy (such as Al—Mn alloy) on the inner surface of the rear glass substrate 13, followed by a patterning treatment with the use of a photolithographic method.

Further, a white color dielectric layer 14 is formed on the inner surface of the rear glass substrate 13 so as to cover up all the column electrodes D, and a plurality of mutually orthogonal partition walls 65*a*, 65*b* are formed on the dielectric layer 14, thereby forming a desired partition wall assembly 65.

The white color dielectric layer 14 may be formed by applying a glass paste (in which a white pigment has been mixed) to the inner surface of the rear glass substrate 13 and the column electrodes D, followed by a drying treatment.

The longitudinal partition walls 65*a* are arranged in the column direction of the panel, while the lateral partition walls 65*b* are arranged in the row direction of the panel corresponding to the projection portions 11A of the dielectric layer 11.

By virtue of the partition wall assembly 65, an electric discharge space formed between the front glass substrate 10 and the rear glass substrate 13 is divided into a plurality of smaller discharge spaces S (FIG. 22) each enclosing a pair of T-shaped transparent electrodes Xa, Ya between a pair of row electrodes (X, Y).

The partition wall assembly 65 may be formed in the following process. At first, a low melting point glass paste uniformly containing white color pigment is applied to the dielectric layer 14, followed by a drying treatment so as to form a white glass layer. Then, a ladder-like mask is employed to selectively cut the white glass layer with the use of a sand blast treatment, thereby forming a desired partition wall assembly 65 (including several ladder-like structures).

Figure 23:
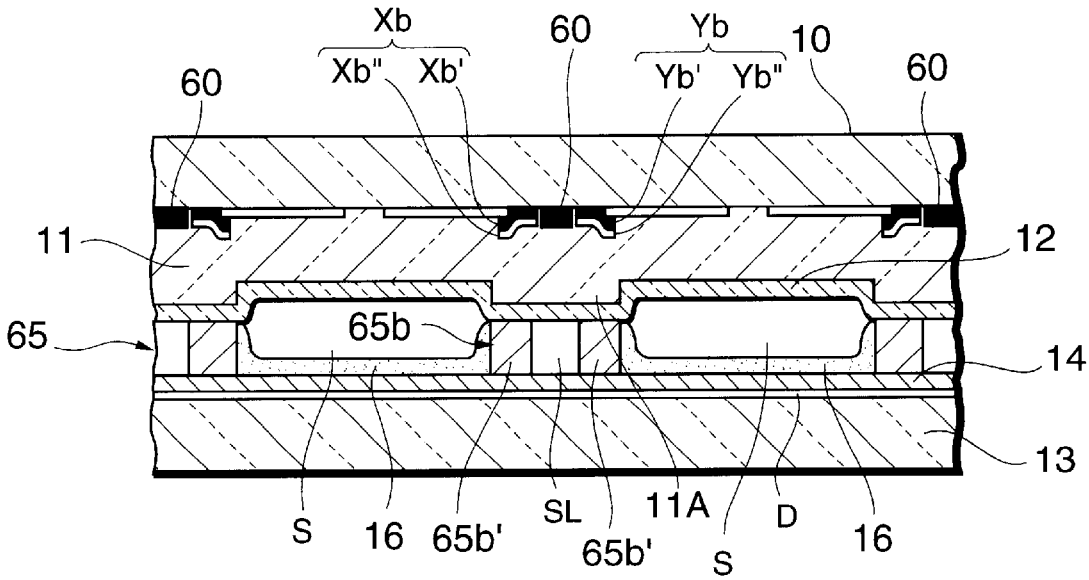
FIG. 23 is a cross sectional view taken along a line V7—V7 in FIG. 22.
Figure 25:
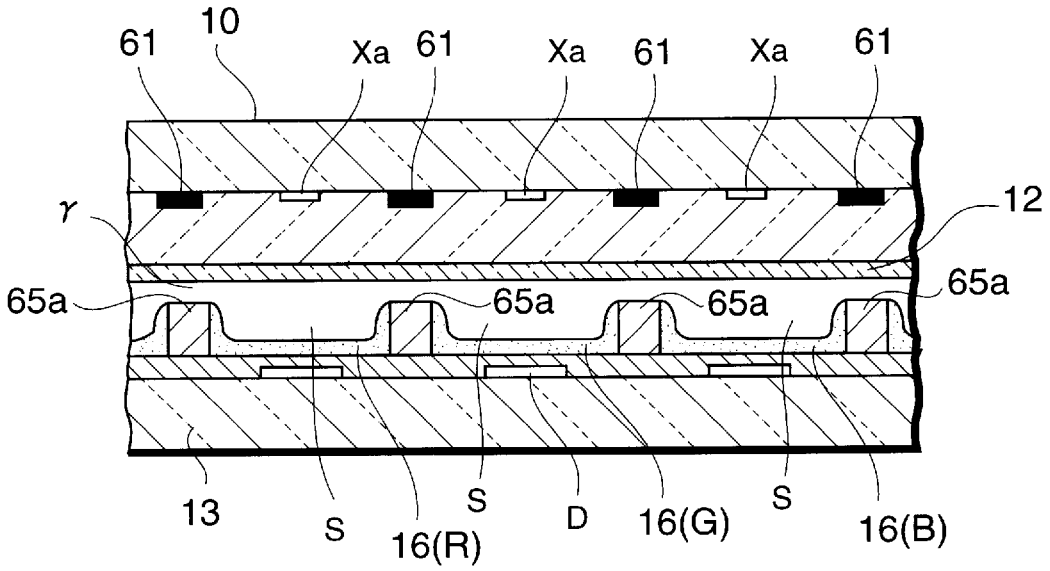
FIG. 25 is a cross sectional view taken along a line W5—W5 in FIG. 22.
Figure 26:
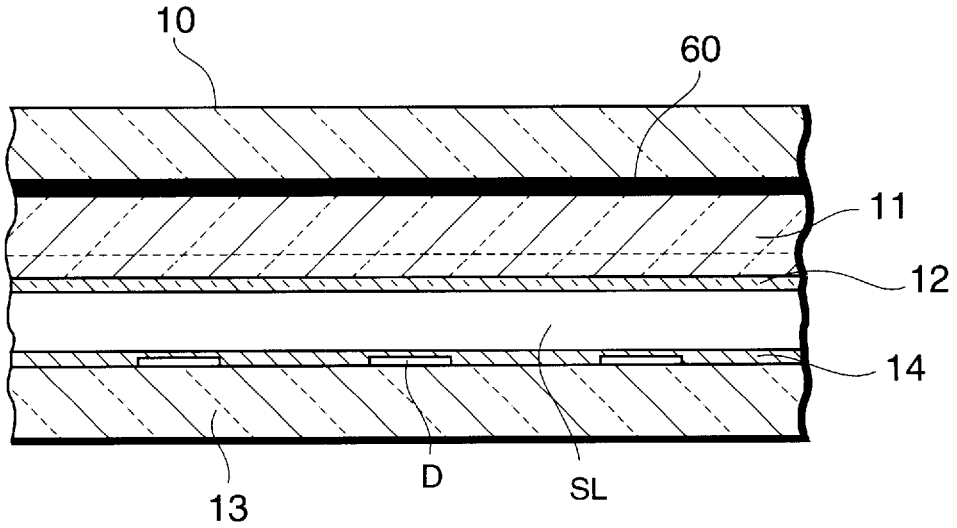
FIG. 26 is a cross sectional view taken along a line W6—W6 in FIG. 22.

As shown in FIG. 25, a gap r is formed between each longitudinal partition wall 65*a* and the protection layer 12. On the other hand, as shown in FIG. 23, there is no any gap formed between the lateral partition walls 65*b* and the protection layer 12.

A fluorescent layer 16 is formed in a manner such that it covers the side surfaces (facing the discharge spaces S) of the longitudinal partition walls 65*a* and the lateral partition walls 65*b*, further covers the exposed portions (facing the discharge spaces S) of the dielectric layer 14.

However, the colors of the fluorescent layer 16 are so arranged that R, G, B are arranged repeatedly in the discharge spaces S in the row direction of the panel.

Then, a noble gas is sealed into the discharge spaces S.

Figure 22:
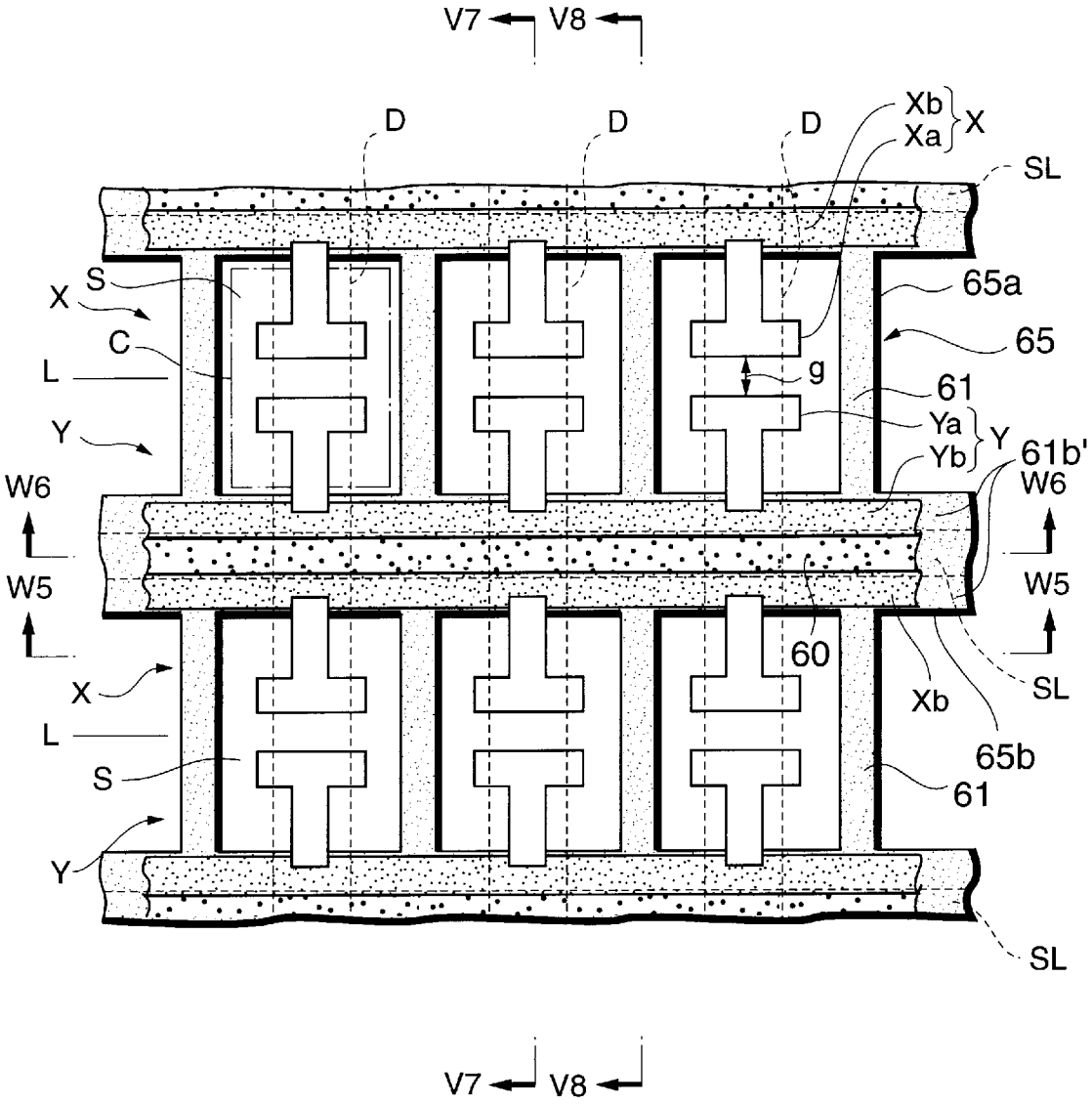
FIG. 22 is a plane view indicating a plasma display panel according to an eleventh embodiment of the present invention.
Figure 24:
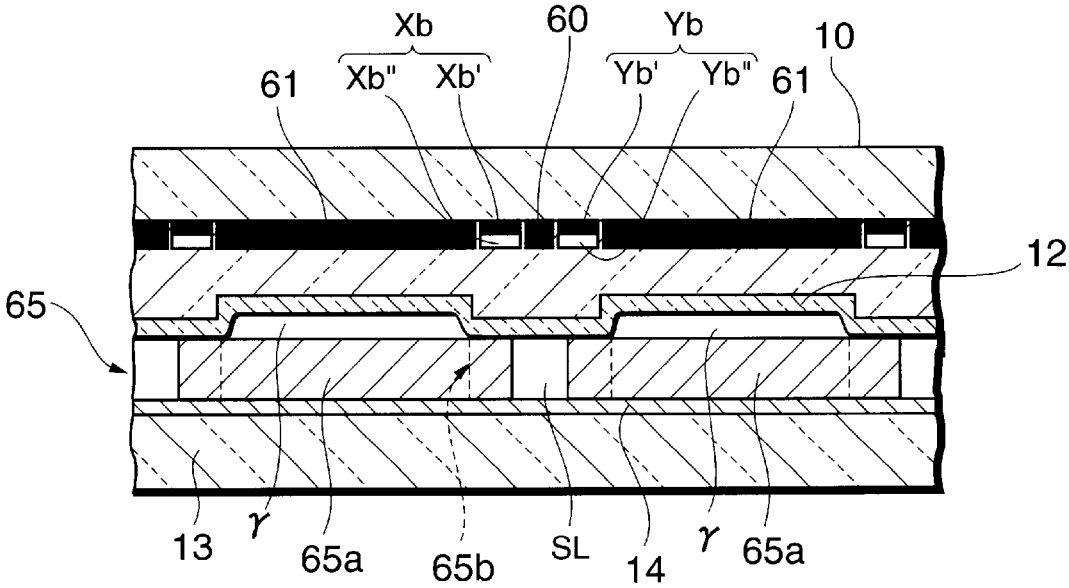
FIG. 24 is a cross sectional view taken along a line V8—V8 in FIG. 22.

In fact, as shown in FIGS. 22–24, each lateral partition wall 65*b* has been divided into two portions 65*b*', 65*b*' separated from each other and an elongated slot SL is formed therebetween. Particularly, each elongated slot SL is located corresponding to a light absorbing strap 60 formed between two mutually adjacent displaying lines L on the inner surface of the front glass substrate 10.

Namely, the partition assembly 65 is formed into a plurality of ladder-like structures each extending in the row direction of the panel. Thus, a plurality of ladder-like structures are in parallel with one another, with an elongated slot SL formed between every two mutually adjacent ladder-like structures.

However, the width of each elongated slot SL is set in a manner such that each of the divided portions 65*b*', 65*b*' of each lateral partition wall 65*b* has the same width as that of each longitudinal partition wall 65*a*.

In a plasma display panel constituted in the above manner, the row electrode pairs (X, Y) are used to form displaying lines L for a matrix display, while the discharge spaces S formed by the ladder-like partition wall assembly 65 are used to serve as discharge cells C.

The operation of the plasma display panel made according to the present embodiment may be performed in the same manner as in the above-discussed prior art.

Namely, at first, an addressing operation is conducted so that an electric discharge is effected selectively among the discharge cells C between the row electrode pairs (X, Y) and the column electrodes D. As a result, a plurality of lit-up cells (discharge cells C where wall charges have been formed in the dielectric layer 11) and a plurality of extinguished cells (discharge cells C where wall charges are not formed in the dielectric layer 11) are distributed on the panel corresponding to a picture to be displayed.

Subsequently, discharge sustaining pulses are simultaneously applied to all the displaying lines L in a manner such that the row electrode pairs (X, Y) will alternatively receive the discharge sustaining pulses. In this manner, surface discharge phenomenon will occur in lit-up cells once the discharge sustaining pulses are applied thereto.

At this moment, since ultraviolet light will be generated due to the surface discharge in the lit-up cells, the fluorescent layer 16 (R, G, B) will be excited to effect light emission, thereby displaying a picture on the plasma display panel.

In this way, since each lateral partition wall 65*b* is divided into two portions 65*b*', 65*b*' separated from each other by an elongated slot SL formed therebetween, and since the width of each elongated slot SL is set in a manner such that each of the divided portions 65*b*', 65*b*' of each lateral partition wall 65*b* has the same width as that of each longitudinal partition wall 65*a*, it is sure to prevent any troubles possibly caused by an expansion of the partition wall assembly 65 during a sintering treatment, therefore preventing warpage of the front glass substrate 10 or the rear glass substrate 13 so as to prevent deformation of the discharge cells C.

In this way, all the portions on the inner surface of the front glass substrate 10 except those facing the discharge spaces S are covered up by the light absorbing straps 60, 61 and the black color electrically conductive layers Xb', Yb' (as in the first embodiment). Therefore, it is sure to prevent a reflection of an external light coming from outside through the front glass substrate 10, thereby improving the contrast of a picture being displayed on the plasma display panel.

Nevertheless, it is also allowed to provide only one sort of the two kinds of the light absorbing straps 60, 61, i.e., it is also possible to provide either the lateral straps 60 or the longitudinal straps 61.

Further, on the inner surface of the front substrate 10, there may be formed many pieces of different color filters (not shown) corresponding to different color portions (R, G, B) of the fluorescent layer 16 (located in the discharge spaces S).

At this time, the two kinds of the light absorbing straps 60, 61 may be located in positions corresponding to slots formed between the different color filters facing the discharge spaces S.

Twelfth Embodiment

Figure 27:
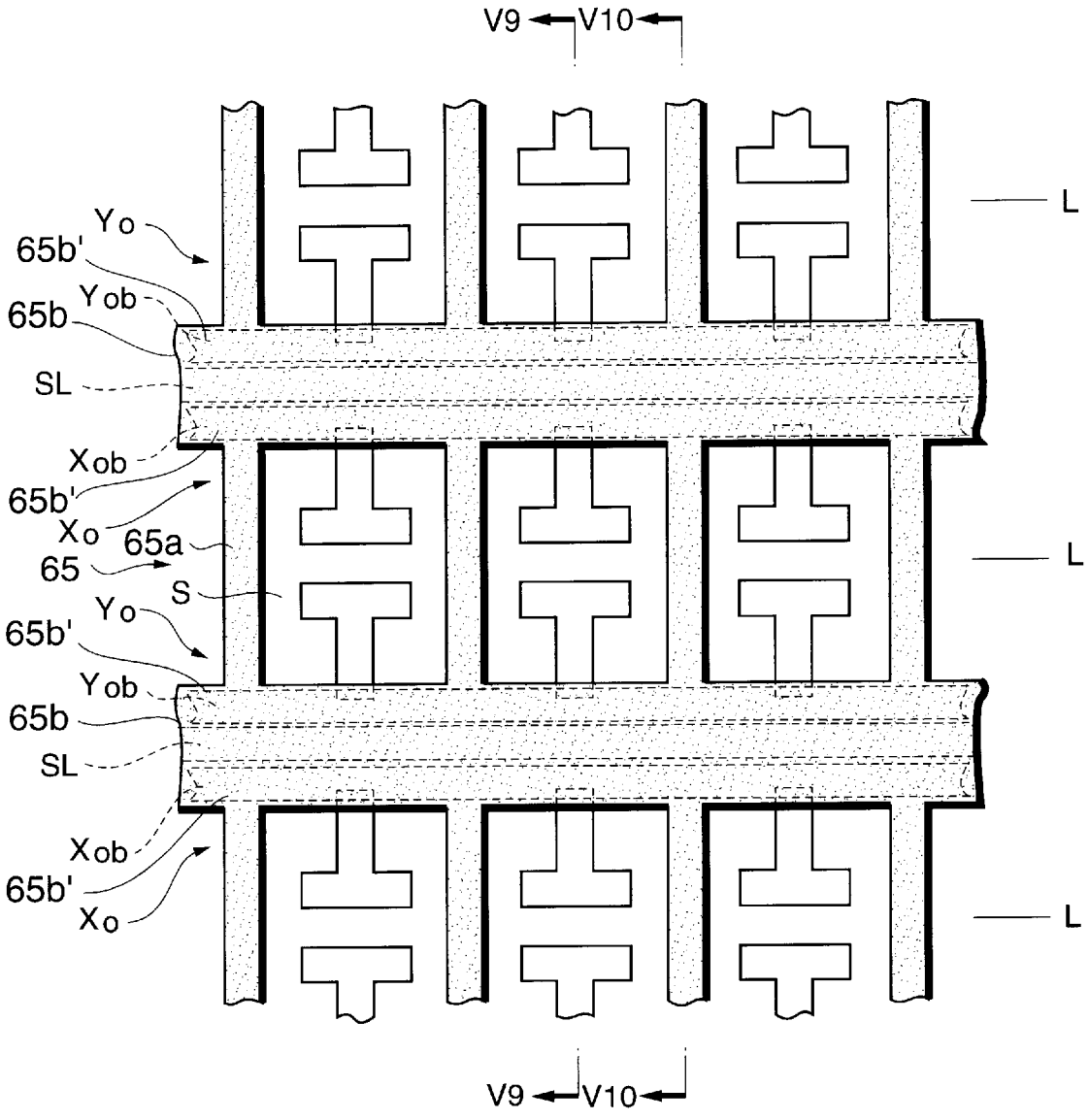
FIG. 27 is a plane view indicating a plasma display panel according to a twelfth embodiment of the present invention.
Figure 28:
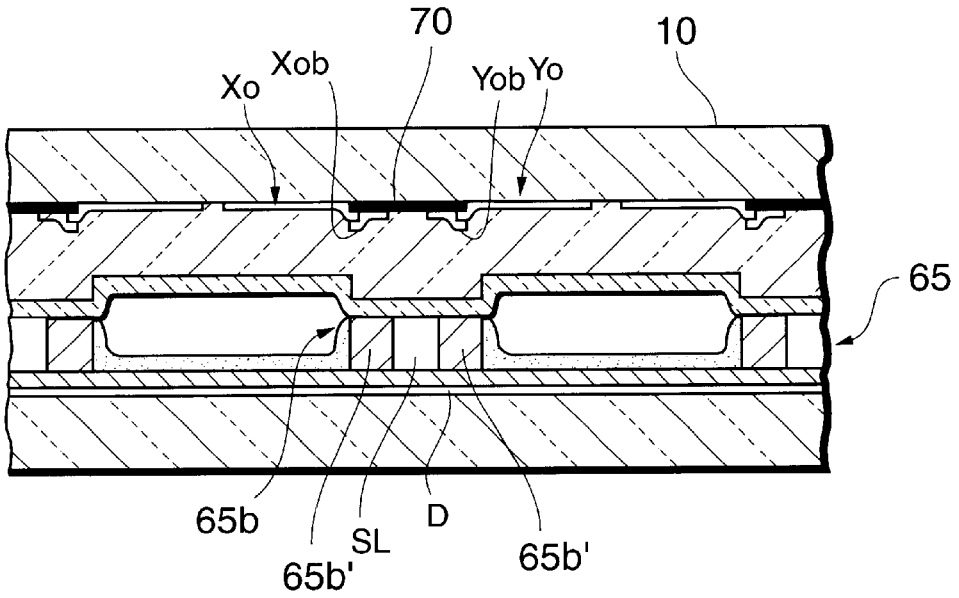
FIG. 28 is a cross sectional view taken along a line V9—V9 in FIG. 27.
Figure 29:
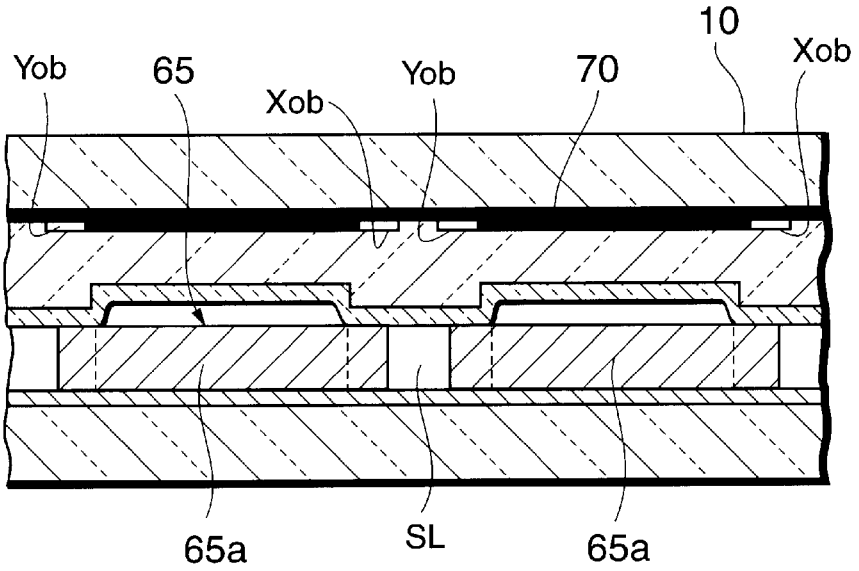
FIG. 29 is a cross sectional view taken along a line V10—V10 in FIG. 27.

A twelfth embodiment of the present invention is illustrated in FIGS. 27–29.

As shown in FIGS. 27–29, a plasma display panel according to the twelfth embodiment has a plurality of row electrodes (Xo, Yo) arranged on the inner surface of the front glass substrate 10 in the same manner as in the above Eleventh embodiment.

Further, on the inner surface of the front glass substrate 10 there are provided a plurality of black color light absorbing straps (light blocking strap) 70 corresponding to longitudinal partition walls 65*a* and lateral partition walls 65*b* of a ladder-like partition wall assembly 65 and slots SL.

As shown in FIG. 28, elongated bus electrodes (Xob, Yob) of each row electrode pair (Xo, Yo) are each formed only of a main electrically conductive layer, and are located under the black color light absorbing straps 70.

Similar to the above eleventh embodiment, each lateral partition wall 65*b* has been divided into two portions 65*b*', 65' separated from each other and an elongated slot SL is formed therebetween.

Particularly, each elongated slot SL is located corresponding to a light absorbing strap 70 formed between two mutually adjacent displaying lines L on the inner surface of the front glass substrate 10.

However, the width of each elongated slot SL is set in a manner such that each of the divided portions 65*b*', 65*b*' of each lateral partition wall 65*b* has the same with as that of each longitudinal partition wall 65*a*.

In this way, since each of the divided portions 65*b*', 65*b*' of each lateral partition wall 65*b* has the same width as that of each longitudinal partition wall 65*a*, it is sure to prevent any troubles possibly caused by an expansion of the partition wall assembly 65 during a sintering treatment, therefore preventing warpage of the front glass substrate 10 or the rear glass substrate 13, so as to prevent deformation of the discharge cells.

Further, in this way, the inner surface of the front glass substrate 10 except those facing the discharge spaces S are covered up by the light absorbing straps 70. Therefore, it is sure to prevent a reflection of an external light coming from outside through the front glass substrate 10, thereby improving the contrast of a picture being displayed on the plasma display panel.

Thirteenth Embodiment

Figure 30:
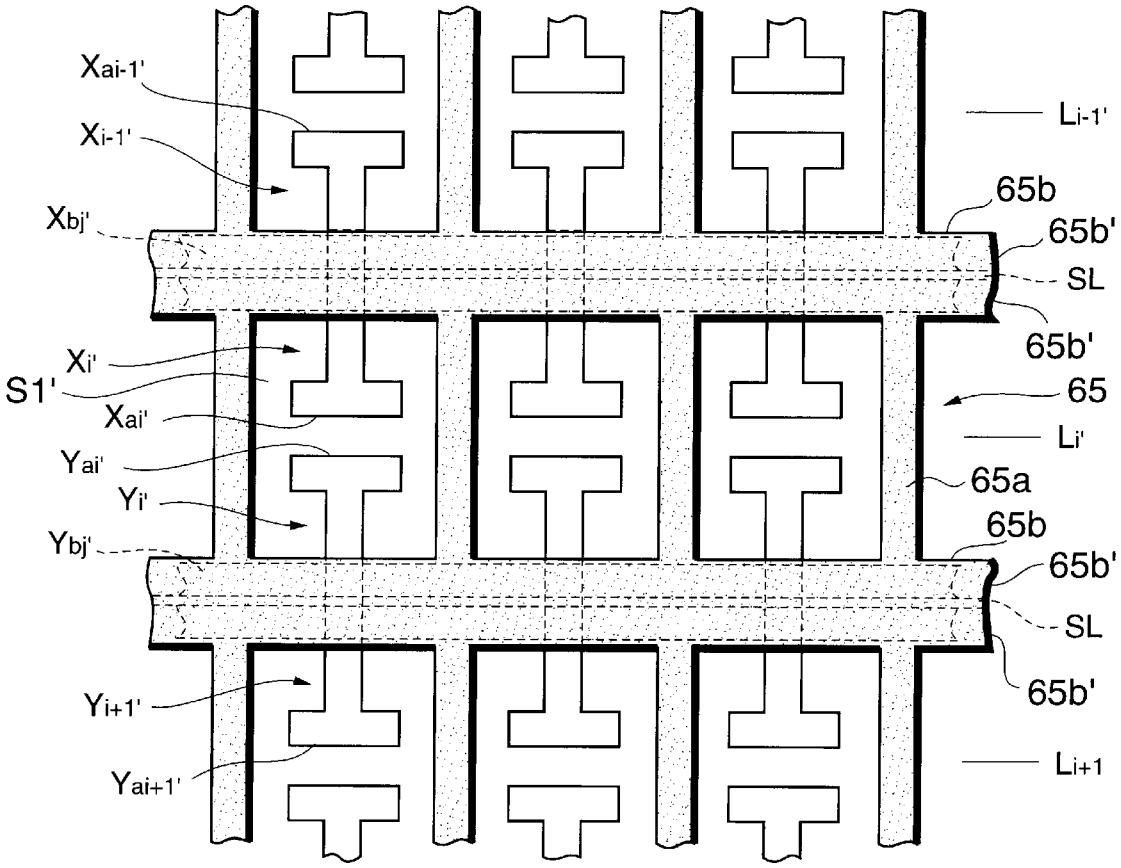
FIG. 30 is a plane view indicating a plasma display panel according to a thirteenth embodiment of the present invention.

A thirteenth embodiment of the present invention is illustrated in FIG. 30.

As shown in FIG. 30, a plasma display panel according to the thirteenth embodiment includes a plurality of displaying lines Li−1', Li, Li+1' . . . , along which there are disposed row electrodes in accordance with an arrangement of (Yi−1', Xi−1), (Xi', Yi'), (Yi+1', Xi+1') . . . in the column direction of the panel.

In fact, T-shaped transparent electrodes (Xai−1', Xai') of mutually adjacent row electrodes (Xi−1', Xi') are integrally connected to each other at base portions thereof. Similarly, T-shaped transparent electrodes (Yai', Yai+i') of mutually adjacent row electrodes (Y1', Y+1') are integrally connected to each other at base portions thereof.

Further, the T-shaped transparent electrodes (Xai−1', Xai') of mutually adjacent row electrodes (Xi−1', Xi') are connected to a common (elongated) bus electrode Xbj', while the T-shaped transparent electrodes (Yai', Yai+i') of mutually adjacent row electrodes (Y1', Y+1') are connected to a common (elongated) bus electrode Ybj'.

Similar to the above eleventh and twelfth embodiments, each lateral partition wall 65*b* has been divided into two portions 65*b*', 65*b*' separated from each other and an elongated slot SL is formed therebetween.

Also, similar to the above eleventh and twelfth embodiments, the width of each elongated slot SL is set in a manner such that each of the divided portions 65*b*', 65' of each lateral partition wall 65*b* has the same width as that of each longitudinal partition wall 65*a*.

In this way, since each of the divided portions 65*b*', 65*b*' of each lateral partition wall 65*b* has the same width as that of each longitudinal partition wall 65*a*, it is sure to prevent any troubles possibly caused by an expansion of the partition assembly 65 during a sintering treatment, therefore preventing warpage of the front glass substrate 10 or the rear glass substrate 13, so as to prevent deformation of the discharge cells.

Further, since the T-shaped transparent electrodes (Xai−1', Xai') of mutually adjacent row electrodes (Xi−1', Xi') are allowed to use a common (elongated) bus electrode Xbi', and since the T-shaped transparent electrodes (Yai', Yai+i') of mutually adjacent row electrodes (YI', Y+1') are allowed to use a common (elongated) bus electrode Ybj', the areas occupied by the elongated bus electrodes Xbj' and Ybj' are allowed to be smaller than those occupied by the elongated bus electrodes in the eleventh embodiment shown in FIGS. 22–26.

In this way, each lateral wall 65*b* of the partition wall assembly 65 is allowed to be narrower in its width than that in the plasma display panel of the eleventh embodiment (FIGS. 22–26), thus ensuring each discharge space S1' to be larger than that in the eleventh embodiment, thereby making it possible to increase total surface area of the fluorescent layer within the discharge spaces S1', thus desirably increasing the brightness of the plasma display panel.

Moreover, with the use of common (elongated) bus electrodes Xbj', Ybi' it is possible to reduce a discharge current during an electric discharge of the plasma display panel. Here, each of the (elongated) bus electrodes Xbj', Ybj' may be formed into a two-layer structure including a black color electrically conductive layer and a main electrically conductive layer. Alternatively, each of the bus electrodes Xbj', Ybi' may be formed into a one-layer structure, while black color light absorbing straps may be interposed between the one-layer bus electrodes Xbj', Ybi' and the inner surface of the front glass substrate 10. In this way, it is sure to prevent a reflection of an external light coming from outside through the front glass substrate 10, thereby improving the contrast of a picture being displayed on the plasma display panel.

Fourteenth Embodiment

Figure 31:
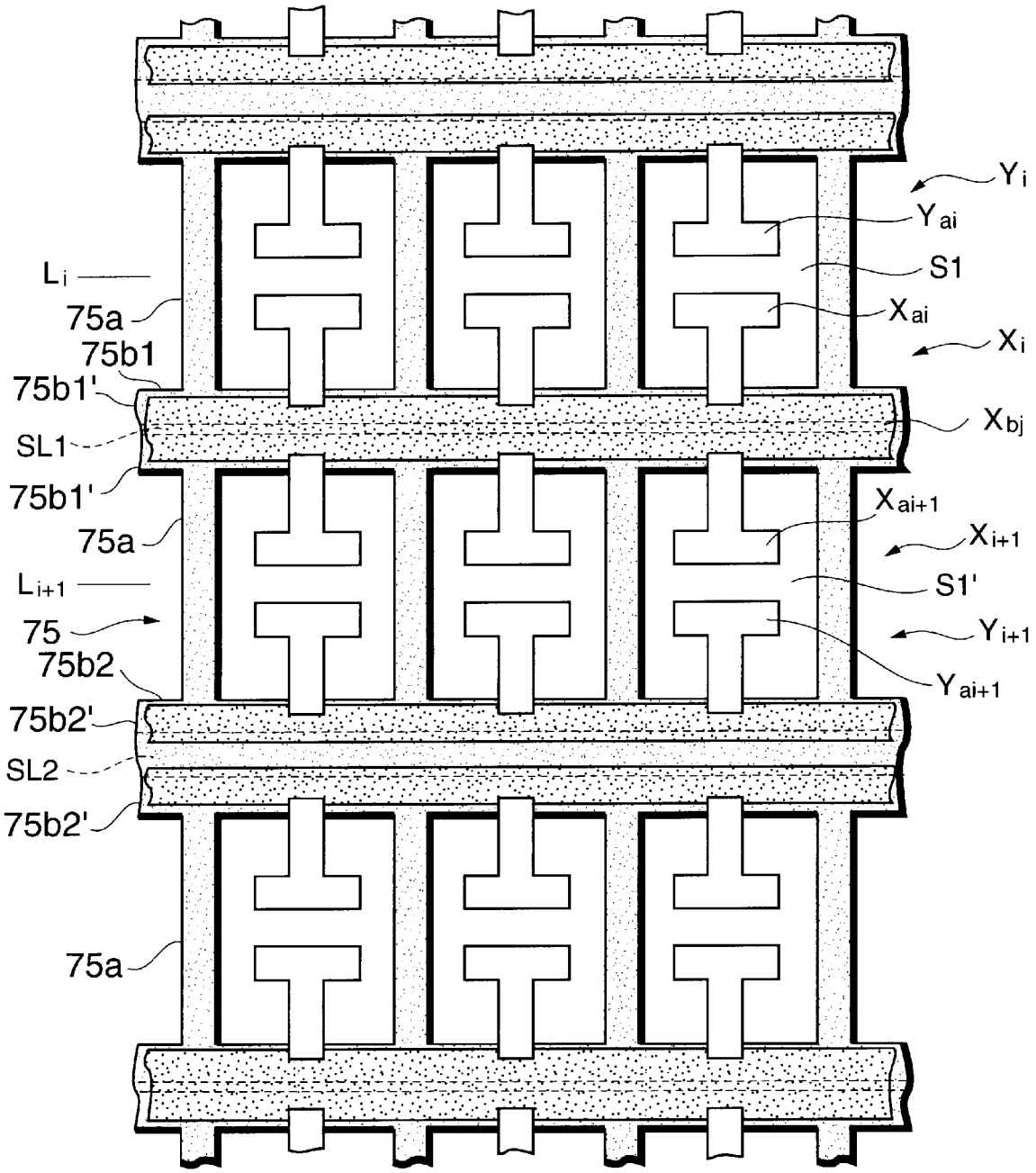
FIG. 31 is a plane view indicating a plasma display panel according to a fourteenth embodiment of the present invention.

A fourteenth embodiment of the present invention is illustrated in FIG. 31.

As shown in FIG. 31, a plasma display panel according to the fourteenth embodiment includes a plurality of displaying lines Li, Li+1 . . . , along which there are disposed row electrodes in accordance with an arrangement (Xi, Yi), (Yi+1, Xi+1) . in the column direction of the panel.

Further, T-shaped transparent electrodes (Xai, Xai+1) of mutually adjacent row electrodes (Xi, Xi+1) are connected to a common (elongated) bus electrode Xbj.

Similar to the above eleventh to thirteenth embodiments, each of lateral partition walls 75b1, 75b2 . . . of a partition wall assembly 75 is divided into two portions (75b1', 75b1'), (75b2', 75b2') separated from each other and elongated slots SL1, SL2 . . . are formed therebetween.

Also, similar to the above eleventh to thirteenth embodiments, the width of each of the elongated slots SL1, SL2 . . . is set in a manner such that each of the divided portions 75b1', 75b2'. . . of the lateral partition walls 75b1, 75b2 . . . has substantially the same width as that of each longitudinal partition wall 75*a*.

In this way, since the divided portions 75b1', 75b2' of the lateral partition walls 75b1, 75b2 . . . of the partition wall assembly 75 have substantially the same width as that of each longitudinal partition wall 75*a*, it is sure to prevent any troubles possibly caused by an expansion of the partition wall assembly 75 during a sintering treatment, therefore preventing warpage of the front glass substrate 10 or the rear glass substrate 13 and a possible damage of the partition wall assembly 75, thereby preventing a deformation of the discharge cells.

Further, since mutually adjacent row electrodes (Xi, Xi+1) are allowed to use common (elongated) bus electrodes Xbj, the area occupied by the bus electrodes Xbj is allowed to be smaller than that occupied by the bus electrodes in the eleventh embodiment shown in FIGS. 22–26.

In this way, lateral walls 75b1, 75b2 . . . of the partition wall assembly 75 are allowed to be narrower in their width than those in the plasma display panel of the eleventh embodiment (FIGS. 22–26), thus ensuring each discharge space S1' to be larger than that in the eleventh embodiment, thereby making it possible to increase total surface area of the fluorescent layer within the discharge spaces S1', thus desirably increasing the brightness of the plasma display panel.

Moreover, with the use of each common (elongated) bus electrode Xbj, it is possible to reduce a discharge current during an electric discharge of the plasma display panel.

Fifteenth Embodiment

A fifteenth embodiment of the present invention is illustrated in FIGS. 32–36.

Referring to FIGS. 32–36, a plasma display panel made according to the fifteenth embodiment has a front glass substrate 10 serving as a displaying surface for the panel, a plurality of row electrode pairs (X,Y) parallelly disposed on the inner surface of the front glass substrate 10.

Each row electrode X includes a plurality of T-shaped transparent electrodes Xa each consisting of a transparent electrically conductive film made of ITO, and an elongated bus electrode Xb consisting of a metal film which is connected with one end of each T-shaped transparent electrode Xa. Similarly, each row electrode Y includes a plurality of T-shaped transparent electrodes Ya each consisting of a transparent electrically conductive film made of ITO, and an elongated bus electrode Yb consisting of a metal film which is connected with one end of each T-shaped transparent electrode Ya.

Further, two row electrodes (X, Y) forming a row electrode pair are arranged in parallel to each other, with a plurality of discharge gaps g formed between the T-shaped transparent electrodes Xa and the T-shaped transparent electrodes Ya, thereby forming one displaying line L for the display panel (matrix display).

The T-shaped transparent electrodes Xa, Ya are formed on the inner surface of the front glass substrate 10 by vapor-depositing ITO thereon, followed by a patterning treatment with the use of a photolithographic method.

On the other hand, each elongated bus electrode Xb includes a black colour electrically conductive layer Xb' (facing the front glass substrate 10) and a main electrically conductive layer Xb". Similarly, each elongated bus electrode Yb includes a black colour electrically conductive layer Yb' (facing the front glass substrate 10) and a main electrically conductive layer Yb".

The elongated bus electrodes Xb, Yb are formed by at first applying a silver paste (in which a black pigment has been mixed) to the inner surface of the front glass substrate 10, followed by a drying treatment, thereby obtaining a dried black color paste layer. Further, a silver paste is applied to the dried black color paste layer, followed by a patterning treatment with the use of a photolithographic method, and further through a sintering treatment, thus forming the elongated bus electrodes Xb, Yb on the inner surface of the front glass substrate 10.

Further, the inner surface of the front glass substrate 10 has formed thereon a plurality of lateral light absorbing straps (light blocking straps) 80 and a plurality of longitudinal light absorbing straps (light blocking straps) 81. In detail, the lateral light absorbing straps 80 are so arranged that each of them is disposed between mutually adjacent elongated bus electrodes Yb, Xb of mutually adjacent row electrodes (X, Y). On the other hand, light absorbing straps 81 are so formed that each of them is facing a longitudinal partition wall 85*a* of a #-like partition wall assembly 85.

Further, a dielectric layer 11' is formed on the inner surface of the front glass substrate 10 in a manner such that it covers up all the row electrode pairs (X,Y).

The dielectric layer 11' may be formed by at first preparing an amount of low melting point glass paste and then forming the paste into several layers of films each having a predetermined thickness, followed by laminating the films and a sintering treatment.

Then, a protection layer 12' consisting of MgO is formed on the exposed surface of the dielectric layer 11'.

On the other hand, the plasma display panel has a rear glass substrate 13 arranged in parallel with and space-apart from the front glass substrate 10. A plurality of column electrodes D are provided on the inner surface of the rear glass substrate 13, and arranged orthogonal to the row electrode pairs (X, Y), in positions corresponding to the T-shaped transparent electrodes Xa, Ya.

The column electrodes D are formed by vapor-depositing an Al alloy (such as Al—Mn alloy) on the inner surface of the rear glass substrate 13, followed by a patterning treatment with the use of a photolithographic method.

Further, a white color dielectric layer 14 is formed on the inner surface of the rear glass substrate 13 so as to cover up all the column electrodes D, a plurality of mutually orthogonal partition walls 85*a*, 85*b* are formed on the dielectric layer 14.

The white color dielectric layer 14 may be formed by applying a glass paste (in which a white pigment has been mixed) to the inner surface of the rear glass substrate 13 and the column electrodes D, followed by a drying treatment.

The partition walls 85*a* are longitudinal partition walls arranged in the column direction of the panel corresponding to the column electrodes D, while the partition walls 85*b* are lateral partition walls arranged in the row direction of the panel, thereby forming a partition wall assembly 85 in contact with the surface of the protection layer 12'.

By virtue of the partition wall assembly 85, an electric discharge space formed between the front glass substrate 10 and the rear glass substrate 13 is divided into a plurality of smaller discharge spaces S (FIG. 32) each enclosing a pair of T-shaped transparent electrodes Xa, Ya between a pair of row electrodes (X, Y).

Figure 32:
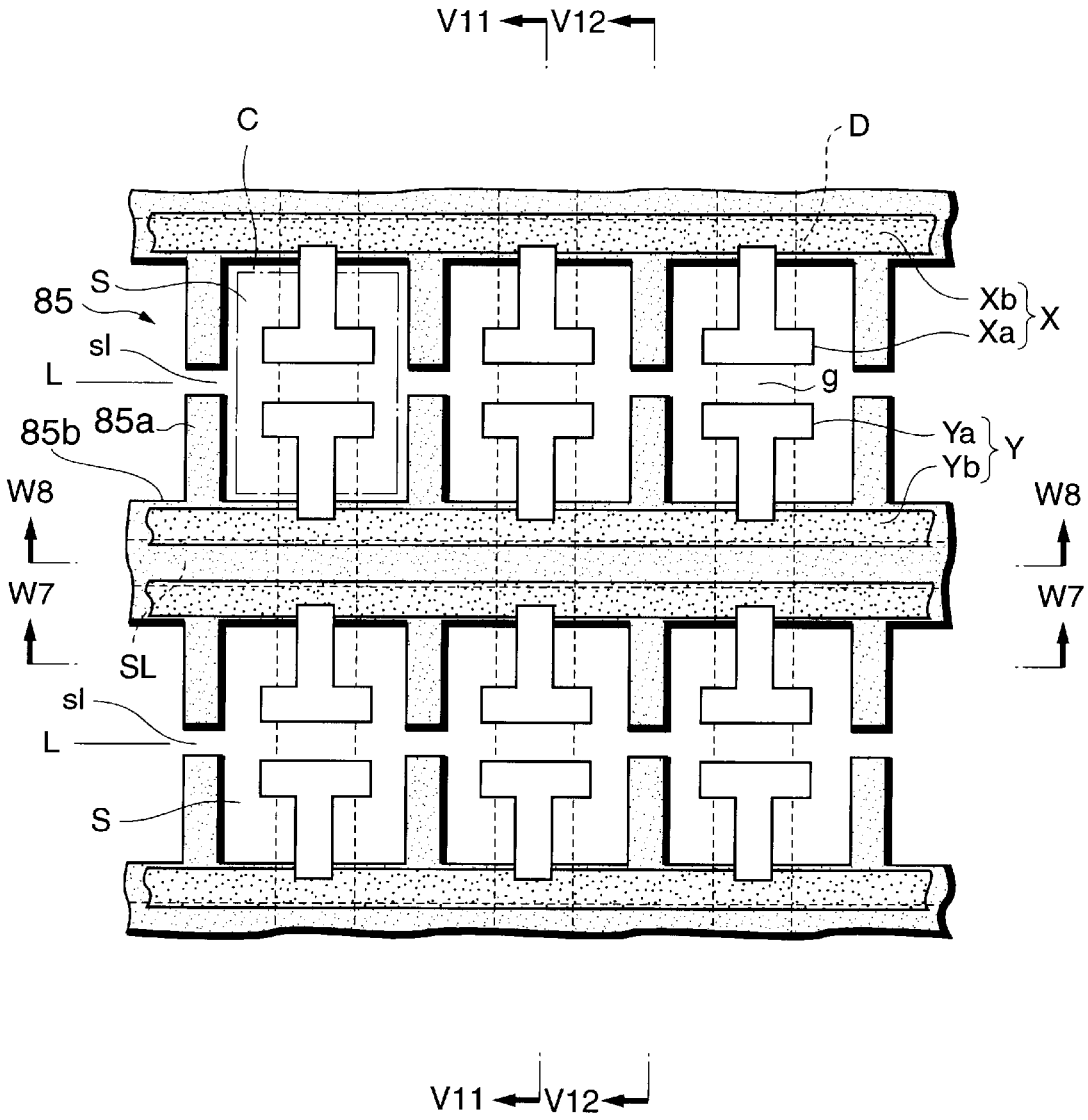
FIG. 32 is a plane view indicating a plasma display panel according to a fifteenth embodiment of the present invention.

Then, as shown in FIG. 32, a plurality of slits S1 are formed on the longitudinal partition walls 85*a* so that every two adjacent discharge spaces S are communicated with each other.

Figure 33:
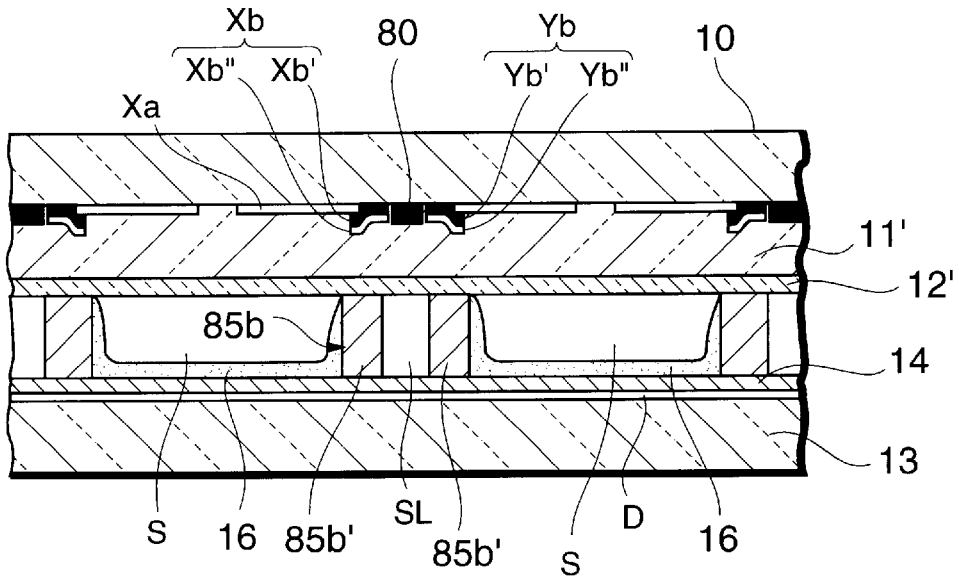
FIG. 33 is a cross sectional view taken along a line V11—V11 in FIG. 32.
Figure 34:
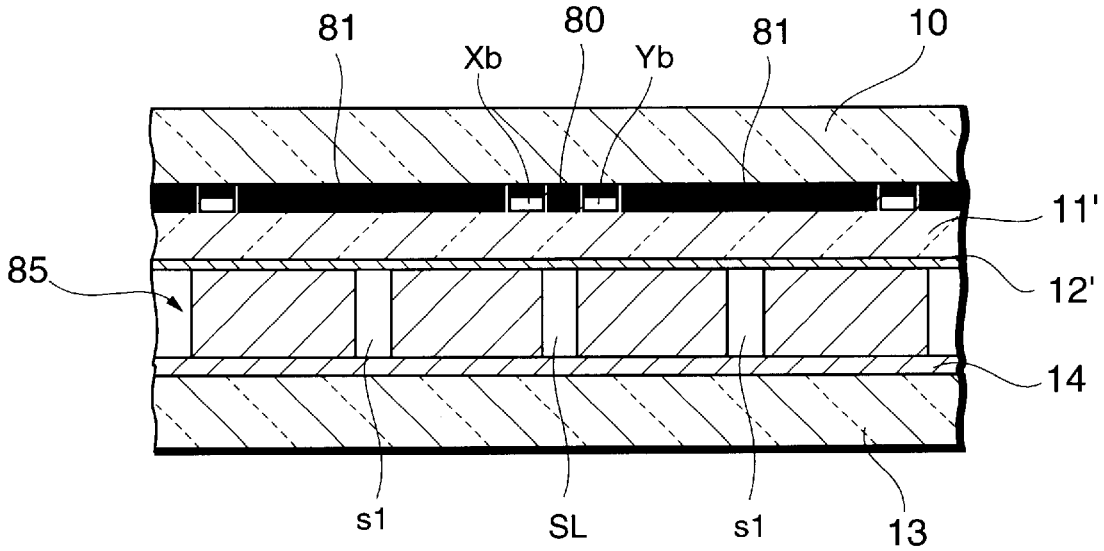
FIG. 34 is a cross sectional view taken along a line V12—V12 in FIG. 32.
Figure 35:
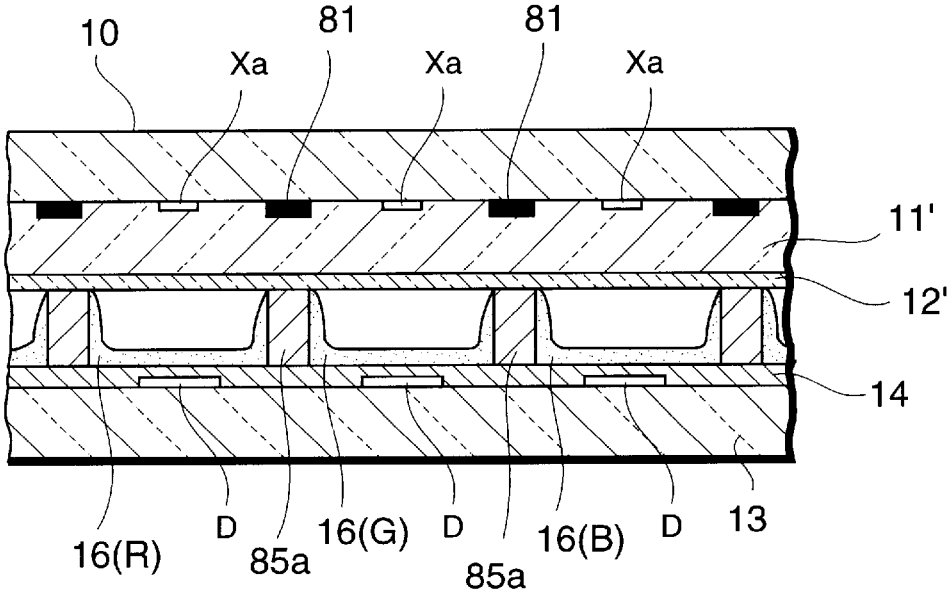
FIG. 35 is a cross sectional view taken along a line W7—W7 in FIG. 32.
Figure 36:
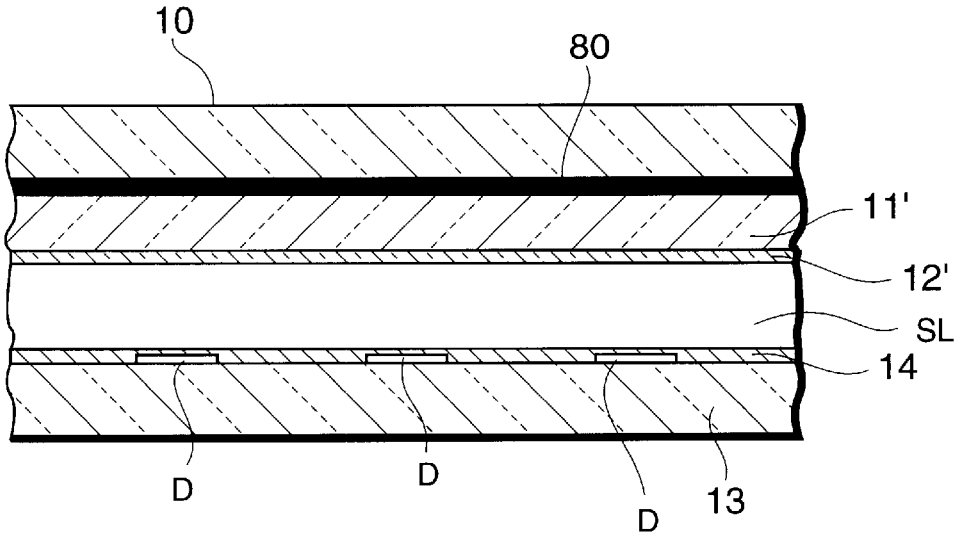
FIG. 36 is a cross sectional view taken along a line W8—W8 in FIG. 32.

In addition, as shown in FIGS. 32–34, each lateral partition wall 85*b* has been divided into two portions 85*b*', 85*b*' separated from each other and an elongated slot SL is formed therebetween. Particularly, each elongated slot SL is located corresponding to a light absorbing strap 80 formed between two mutually adjacent displaying lines L on the inner surface of the front glass substrate 10.

However, the width of each elongated slot SL is set in a manner such that each of the divided portions 85*b*', 85*b*' of each lateral partition wall 68*b* has the same with as that of each longitudinal partition wall 85*a*.

The partition assembly 85 may be formed in the following process. At first, a low melting point glass paste uniformly containing a white color pigment is applied to the dielectric layer 14, followed by a drying treatment. Then, a specifically shaped mask is employed to selectively cut the white glass layer with the use of a sand blast treatment, thereby forming the desired partition wall assembly 85.

A fluorescent layer 16 is formed in a manner such that it covers the side surfaces (facing the discharge spaces S) of the longitudinal partition walls 85*a* and the lateral partition walls 85*b*, further covers the exposed portions (facing the discharge spaces S) of the dielectric layer 14.

However, the colors of the fluorescent layer 16 are so arranged that R, G, B are arranged repeatedly in the discharge spaces S in the row direction of the panel (as shown in FIG.

Then, a noble gas is sealed into the discharge spaces S.

In a plasma display panel constituted in the above manner, the row electrode pairs (X,Y) are used to form displaying lines L for a matrix display, while the discharge spaces S formed by partition wall assembly 85 are used to serve as discharge cells C.

The operation of the plasma display panel made according to the present embodiment may be performed in the same manner as in the previous embodiments.

Namely, at first, an addressing operation is conducted so that an electric discharge is effected selectively among the discharge cells C between the row electrode pairs (X, Y) and the column electrodes D. As a result, a plurality of lit-up cells (discharge cells C where wall charges have been formed in the dielectric layer 11') and a plurality of extinguished cells (discharge cells C where wall charges are not formed in the dielectric layer 11') are distributed on the panel corresponding to a picture to be displayed.

Subsequently, discharge sustaining pulses are simultaneously applied to all the displaying lines L in a manner such that the row electrode pairs (X, Y) will alternatively receive the discharge sustaining pulses. In this manner, surface discharge phenomenon will occur in lit-up cells once the discharge sustaining pulses are applied thereto.

At this moment, since ultraviolet light will be generated due to the surface discharge in the lit-up cells, the fluorescent layer 16 (R, G, B) will be excited to effect light emission, thereby displaying a picture on the plasma display panel.

In use of the plasma display panel, although the upper surface of the partition wall assembly 85 is in tight contact with the inner surface of the protection layer 12', a plurality of slits S1 are formed on the longitudinal partition walls 85*a* so that every two adjacent discharge spaces S are communicated with each other. In this way, the discharging gas and priming particles sealed in one discharge space S is allowed to move to its adjacent discharge space S, thereby producing a priming effect enabling a kind of chain discharge (discharging continuously from one cell to another), thus ensuring a stabilized discharge in the plasma display panel.

Further, since each lateral partition wall 85*b* is divided into two portions 85*b*', 85*b*' separated from each other by an elongated slot SL formed therebetween, and since the width of each elongated slot SL is set in a manner such that each of the divided portions 85*b*', 85*b*' of each lateral partition wall 85*b* has the same width as that of each longitudinal partition wall 85*a*, it is sure to prevent any troubles possibly caused by an expansion of the partition wall assembly 85 during a sintering treatment, therefore preventing warpage of the front glass substrate 10 or the rear glass substrate 13, so as to prevent deformation of the discharge cells.

Sixteenth Embodiment

Figure 37:
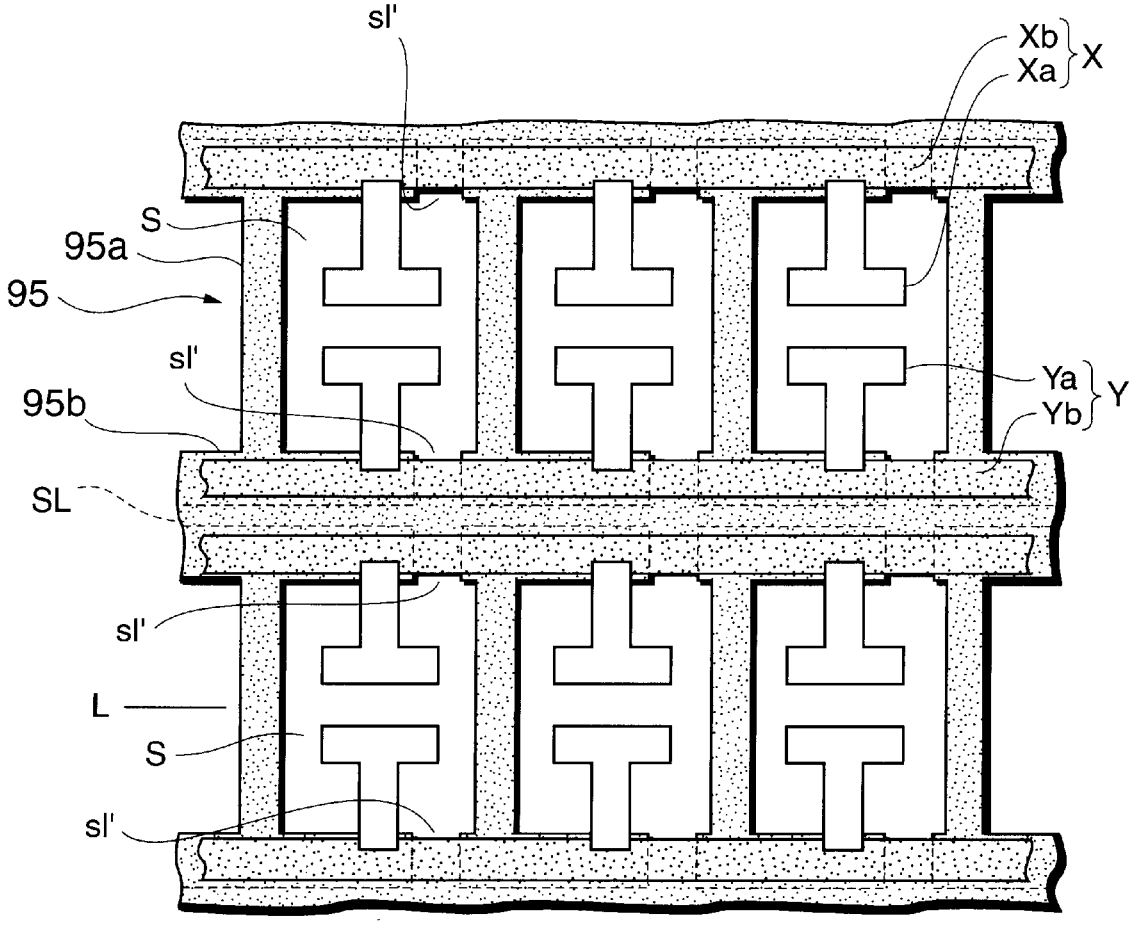
FIG. 37 is a plane view indicating a plasma display panel according to a sixteenth embodiment of the present invention.

A sixteenth embodiment of the present invention is illustrated in FIG. 37.

Referring to FIG. 37, a plasma display panel made according to the sixteenth embodiment is almost the same as that described in the above fifteenth embodiment except that a plurality of slits s1' are formed on lateral partition walls 95*b* of a partition wall assembly 95 in positions not facing. the T-shaped transparent electrodes Xa, Ya, in a manner such that every two discharge spaces S mutually adjacent to each other in the column direction of the panel are communicated with each other.

In this way, since a plurality of slits s1' are formed on lateral partition walls 95*b* of the partition wall assembly 95 in positions not facing the T-shaped transparent electrodes Xa, Ya, a possible spreading phenomenon of discharge may be prohibited by virtue of the lateral partition walls 95*b* of the partition wall assembly 95.

Seventeenth Embodiment

Figure 38:
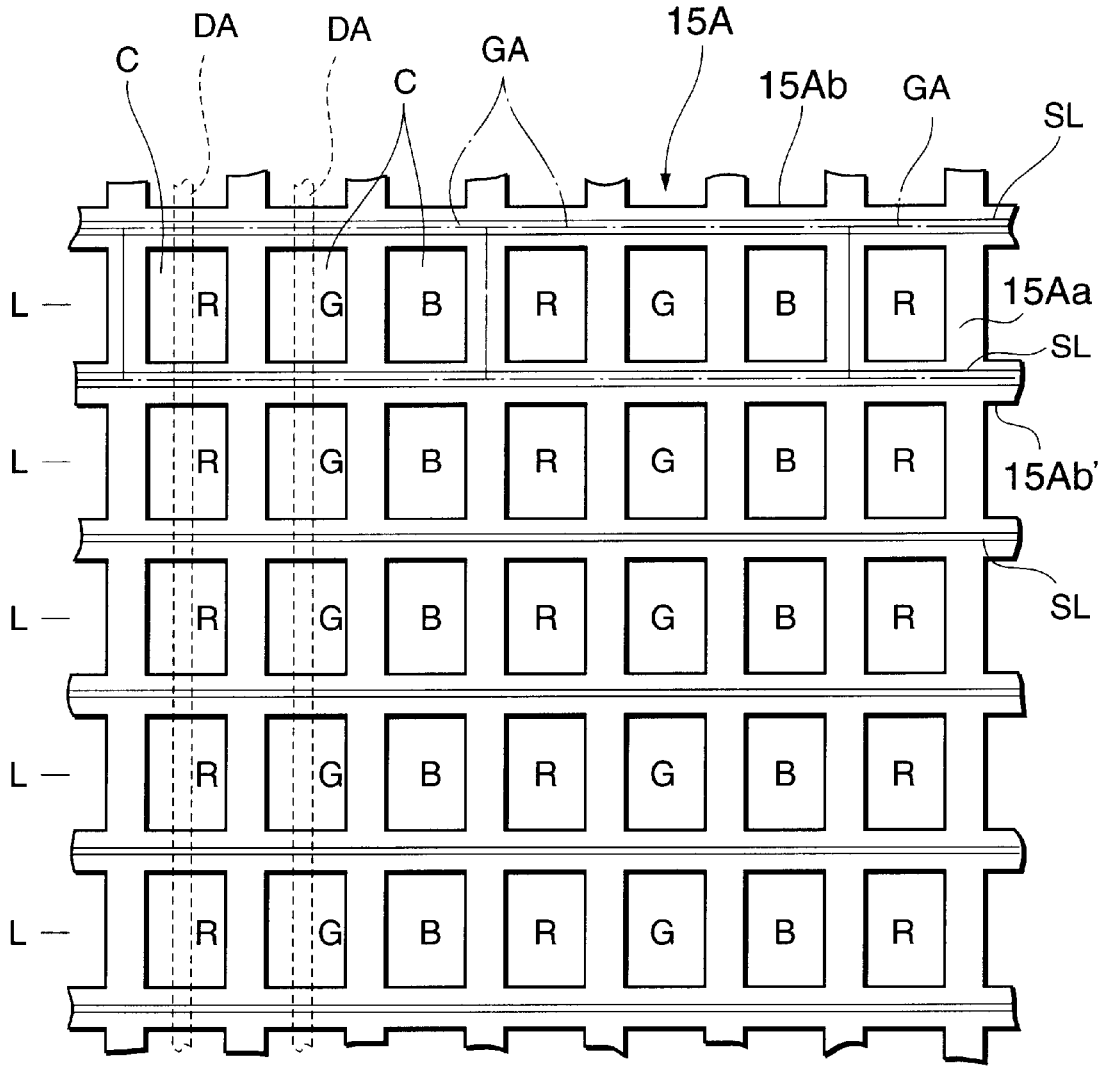
FIG. 38 is a plane view indicating a plasma display panel according to a seventeenth embodiment of the present invention.

A seventeenth embodiment of the present invention is illustrated in FIG. 38.

FIG. 38 is a plane view schematically indicating how a plurality of picture elements GA are formed by virtue of a plurality of discharge cells C including three kinds of colors R, G, B.

As shown in FIG. 38, a plurality of discharge cells C are formed by virtue of a ladder-like partition wall assembly 15A. DA is used to represent column electrodes.

The discharge cells C are arranged in each displaying line L (row direction) in the order of R, G, B repeatedly, and in each column (column direction) there are arranged a plurality of discharge cells belonging to only one kind of color.

In fact, every three discharge cells C (R, G, B) arranged in a display line L will form one picture element GA. Thus, a plurality of picture elements GA are aligned in the column direction.

In this way, since each of lateral partition walls 15A*b* of the partition assembly 15A is divided into two portions 15A*b*', 15A*b*', and since each divided portion 15A*b*' has substantially the same widths as that of each longitudinal partition wall 15A*a*, it is sure to prevent any troubles possibly caused by an expansion of the partition wall assembly 15A during a sintering treatment, therefore preventing warpage of the front glass substrate 10 or the rear glass substrate 13 and a possible damage of the partition wall assembly 15A, thereby preventing a deformation of the discharge cells. Eighteenth Embodiment An eighteenth embodiment of the present invention is illustrated in FIG. 39.

Figure 39:
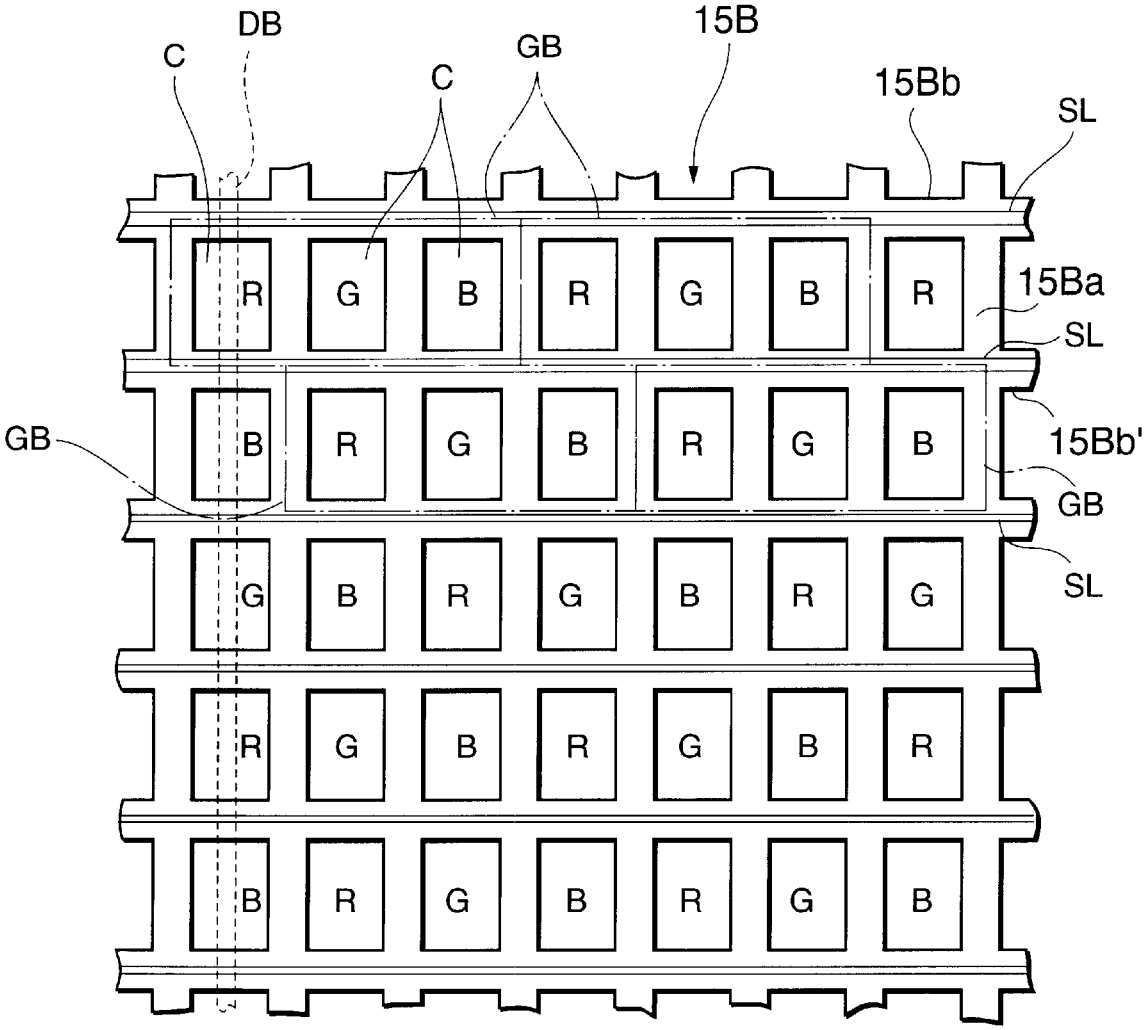
FIG. 39 is a plane view indicating a plasma display panel according to an eighteenth embodiment of the present invention.

FIG. 39 is also a plane view schematically indicating how a plurality of picture elements GB are formed by virtue of a plurality of discharge cells C including three kinds of colors R, G, B.

As shown in FIG. 39, a plurality of discharge cells C are formed by virtue of a ladder-like partition assembly 15B. DB is used to represent column electrodes.

The discharge cells C are arranged in each displaying line L (row direction) in the order of R, G, B repeatedly, but with one displaying line L being deviated from its adjacent (in column direction) displaying line L by one discharge cell C in the row direction.

In fact, every three discharge cells C (R, G, B) arranged in a display line L will form one picture element GB. Thus, when viewed in the column direction, one picture element GB is deviated (in the row direction) from its adjacent (in column direction) picture element GB by one discharge cell C.

In this way, since one picture element GB is deviated (in row direction) from its adjacent (in column direction) picture element GB by one discharge cell C, it is possible to improve the resolution of a picture being displayed on the panel.

Further, since each of lateral partition walls 15B*b* of the partition wall assembly 15B is divided into two portions 15B*b*', 15B*b*', and since each divided portion 15B*b*' has substantially the same width as that of each longitudinal partition wall 15B*a*, it is sure to prevent any troubles possibly caused by an expansion of the partition wall assembly 15B during a sintering treatment, therefore preventing warpage of the front glass substrate 10 or the rear glass substrate 13 and a possible damage of the partition wall assembly 15B, thereby preventing a deformation of the discharge cells.

Nineteenth Embodiment

Figure 40:
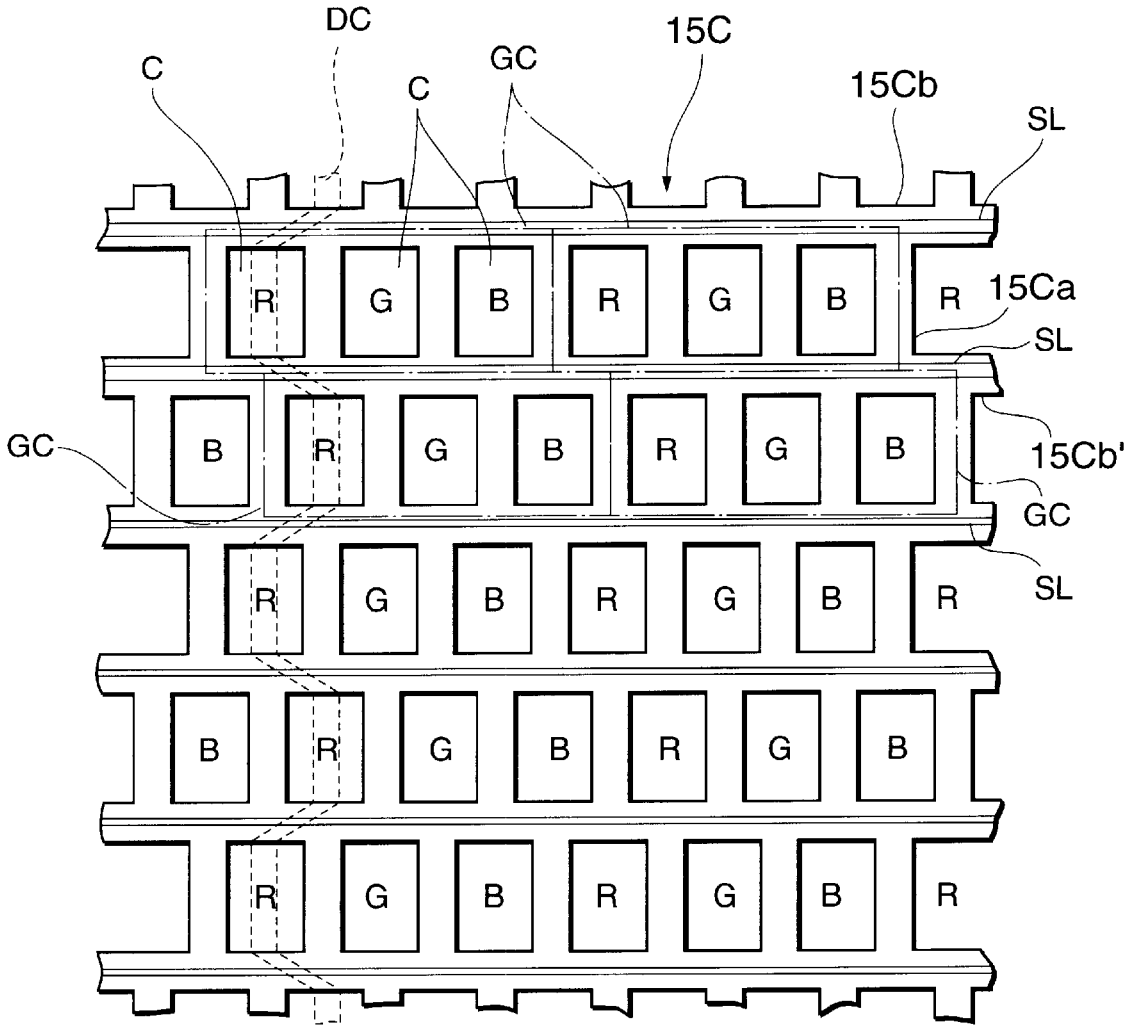
FIG. 40 is a plane view indicating a plasma display panel according to a nineteenth embodiment of the present invention.

A nineteenth embodiment of the present invention is illustrated in FIG. 40.

FIG. 40 is also a plane view schematically indicating how a plurality of picture elements GC are formed by virtue of a plurality of discharge cells C including three kinds of colors R, G, B.

As shown in FIG. 40, a plurality of discharge cells C are formed by virtue of a ladder-like partition assembly 15C. DC is used to represent column electrodes.

In particular, when viewed in the column direction, two mutually adjacent (in column direction) discharge cells C are deviated from each other by half width of one cell C in the row direction.

Accordingly, each of color portions R, G, B of one displaying line L is deviated from a corresponding color portion of an adjacent displaying line L by half width of one cell C in the row direction.

For this reason, the column electrodes DC are formed in a zigzag configuration as shown in FIG. 40, thereby permitting the formation of the above arrangement of discharge cells C shown in FIG. 40.

In this manner, since each picture element GC consists of three discharge cells C (R, G, B) arranged in the row direction, each of color portions R, G, B of one picture element on one displaying line L is deviated (in the row direction) from a corresponding color portion of a corresponding picture element on an adjacent displaying line L by half width of one cell C, it is allowed to further improve the resolution of a picture being displayed on the panel.

Further, since each of lateral partition walls 15C*b* of the partition wall assembly 15C is divided into two portions 15C*b*', 15C*b*', and since each divided portion 15C*b*' has substantially the same width as that of each longitudinal partition wall 15C*a*, it is sure to prevent any troubles possibly caused by an expansion of the partition wall assembly 15C during a sintering treatment, therefore preventing warpage of the front glass substrate 10 or the rear glass substrate 13 and a possible damage of the partition wall assembly 15C, thereby preventing a deformation of the discharge cells.

Twentieth Embodiment

Figure 41:
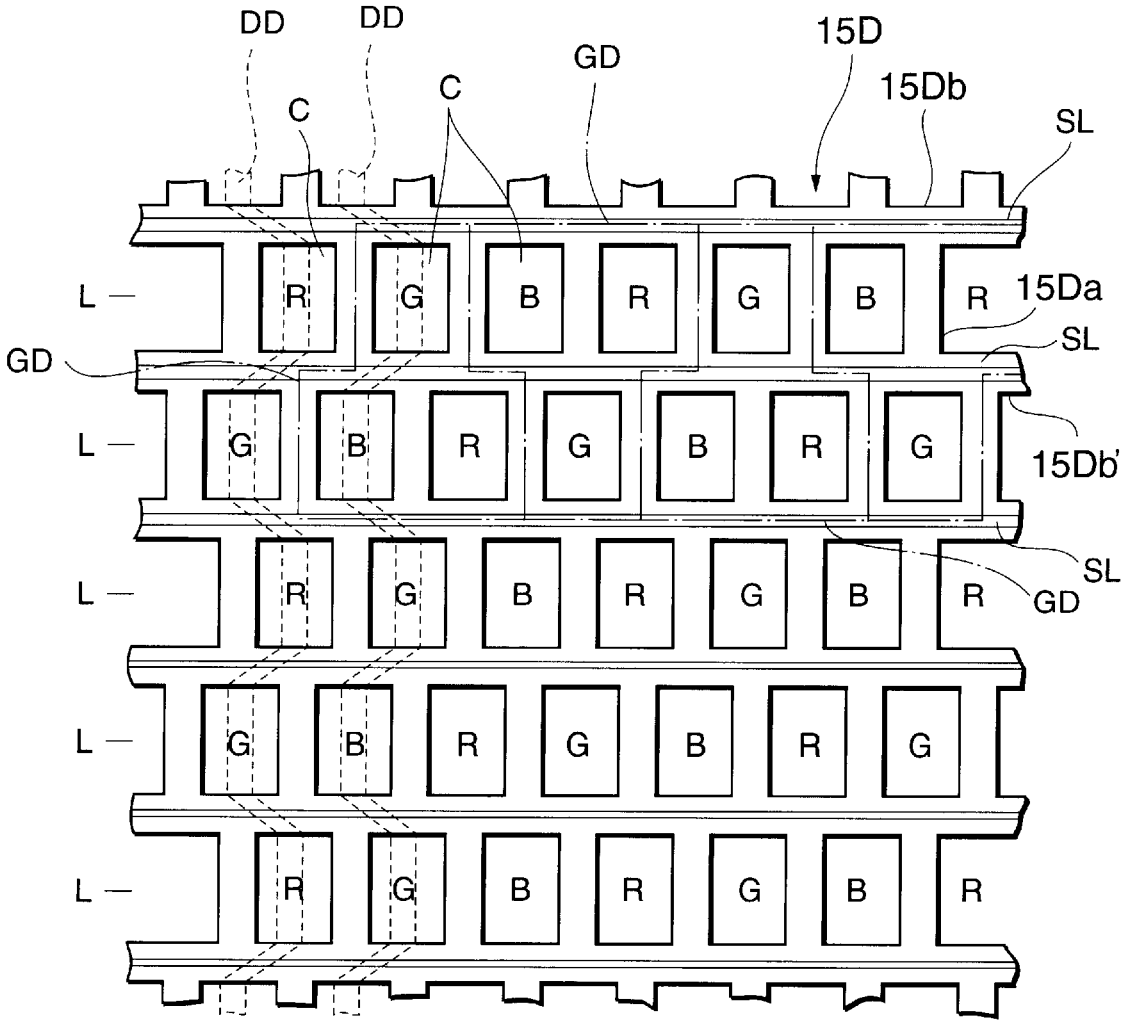
FIG. 41 is a plane view indicating a plasma display panel according to a twentieth embodiment of the present invention.

A twentieth embodiment of the present invention is illustrated in FIG. 41.

FIG. 41 is also a plane view schematically indicating how a plurality of picture elements GD are formed by virtue of a plurality of discharge cells C including three kinds of colors R, G, B.

As shown in FIG. 41, a plurality of discharge cells C are formed by virtue of partition wall assembly 15D. DD is used to represent column electrodes.

In particular, when viewed in the column direction, two mutually adjacent (in column direction) discharge cells C are deviated from each other by half width of one cell C in the row direction.

In more detail, each of color portions R, G, B of one displaying line L is deviated (in the row direction) from a corresponding color portion of an adjacent displaying line L by 1.5 times the width of one cell C.

Accordingly, similar to the nineteenth embodiment, the column electrodes DD are formed in a zigzag configuration as shown in FIG. 41, thereby permitting the formation of the above arrangement of discharge cells C shown in FIG. 41.

In this manner, as shown in FIG. 41, each pitch element GD may also be formed by three discharge cells (R, G, B) which together form a triangular configuration bridging over two mutually adjacent displaying lines L, thereby further improving the resolution of a picture being displayed on the panel.

Further, since each of lateral partition walls 15D*b* of the partition wall assembly 15D is divided into two portions 15D*b*', 15D*b*', and since each divided portion 15D*b*' has substantially the same width as that of each longitudinal partition wall 15D*a*, it is sure to prevent any troubles possibly caused by an expansion of the partition wall assembly 15D during a sintering treatment, therefore preventing warpage of the front glass substrate 10 or the rear glass substrate 13 and a possible damage of the partition wall assembly 15D, thereby preventing a deformation of the discharge cells.

First Additional Embodiment

Figure 42:
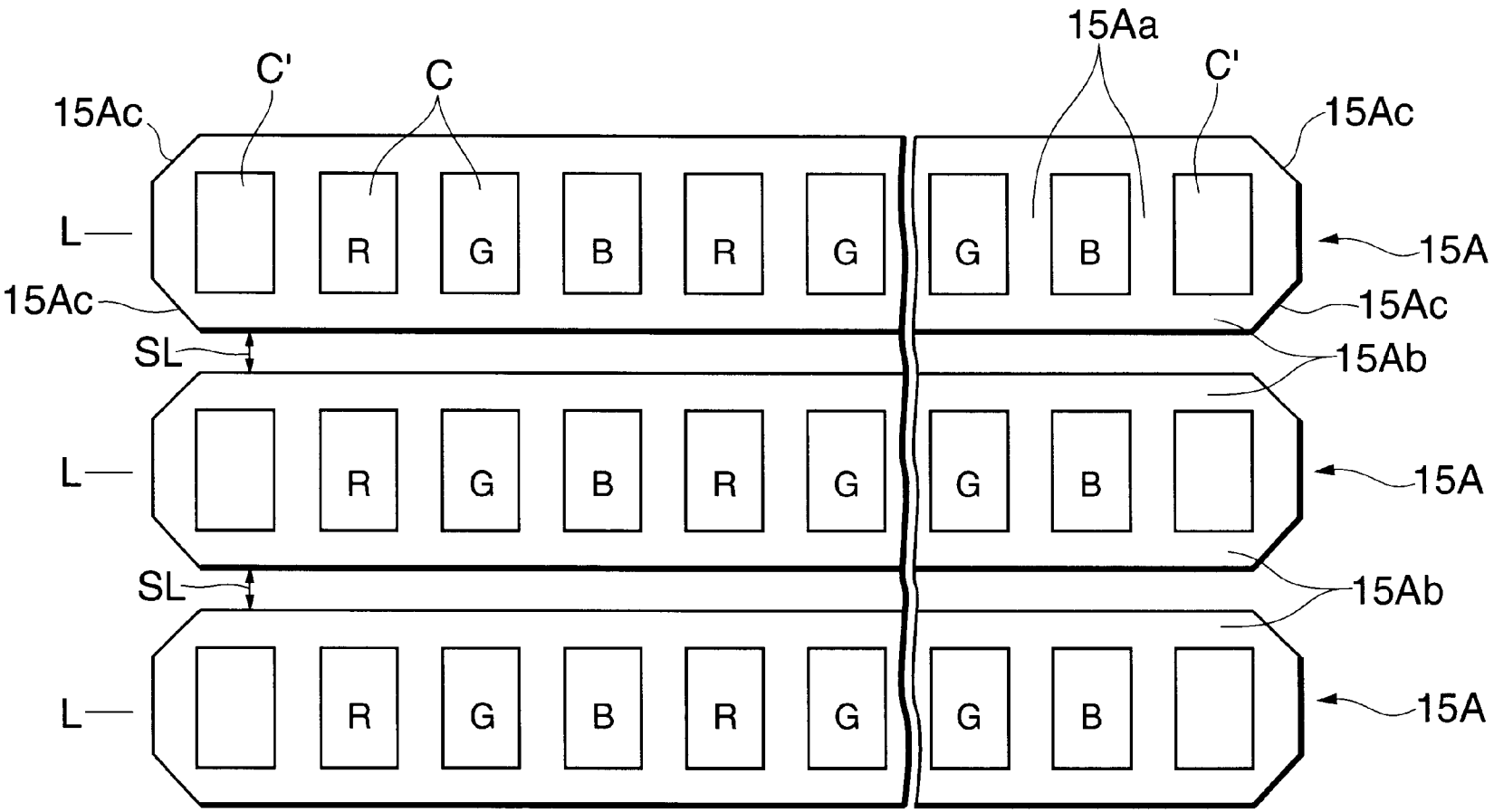
FIG. 42 is a plane view indicating a plasma display panel showing the shape of modified partition wall assembly of the present invention.

FIG. 42 is a plane view indicating a plurality of partition wall assemblies suitable for use in any plasma display panel of the embodiments shown in FIGS. 22–41.

As shown in FIG. 42, each partition wall assembly 15A has a plurality of vertical partition walls 15A*a* and two horizontal partition walls 15A*b*, thereby forming a ladder-like configuration providing a plurality of discharge cells C.

In practice, a plurality of partition wall assemblies 15A are arranged in parallel to one another with a slot SL formed between every two mutually adjacent partition wall assemblies 15A, 15A. In this way, an entire discharge space formed between a front glass substrate 10 and a rear glass substrate 13 may be divided into a plurality of smaller discharge spaces by virtue of several partition wall assemblies 15A.

Further, the leftmost and rightmost discharge cells C' of each partition wall assembly 15A are set to be dummy cells.

The corner portions (on the outside of the dummy cells C') of each partition wall assembly 15A are removed so as to form inclined surfaces 15A*c*.

By removal of the corner portions (on the outside of the dummy cells C') of each partition wall assembly 15A, it is sure to remove any undesired build-up of a material (for forming the partition wall assembly 15A) from these positions.

The reason for the removal of the build-up may be explained as follows.

If any build-up of a material (for forming the partition wall assembly 15A) are not avoided, when the front glass substrate 10 and the rear glass substrate 13 are brought together to form a display panel, the two glass substrates will get in contact with the build-up portions of the partition wall assembly 15 while leaving the other portions thereof in a floating condition. Consequently, a vibration will happen on the substrates when the plasma display panel is being driven. Therefore, by removal of the corner portions (on the outside of the dummy cells C') of each partition wall assembly 15A, it is sure to remove any undesired build-up of a material (for forming the partition wall assembly 15A) from these positions, thereby ensuring that the two glass substrates will be in a uniform contact with the partition wall assembly 15A.

21th Embodiment

A 21th embodiment of the present invention is illustrated in FIGS. 43–46.

As shown in FIGS. 43–46, a plasma display panel according to the 21th embodiment has a partition wall assembly 105 including a plurality of longitudinal partition walls 105*a* and a plurality of lateral partition walls 105*b*. By virtue of the partition wall assembly 105, a discharge space formed between the front glass substrate 10 and the rear glass substrate 13 is divided into a plurality of discharge cells C.

On the inner surface of the front glass substrate 10, there are formed a plurality of row electrodes X each including a plurality of transparent electrodes Xa and an elongated bus electrode Xb, and a plurality of row electrodes Y each including a plurality of transparent electrodes Ya and an elongated bus electrode Yb, thereby forming a plurality of row electrode pairs (X, Y).

Further, a dielectric layer 11 is formed on the inner surface of the front glass substrate 10 in a manner such that the row electrodes (X, Y) are covered up by the dielectric layer 11. In particular, the dielectric layer 11 has a plurality of projection portions 11A located in positions corresponding to every two adjacent bus electrodes Xb, Yb.

Then, a protection layer 12 consisting of MgO is formed to cover the dielectric layer 11.

On the other hand, the plasma display panel has a rear glass substrate 13 arranged in parallel with and space-apart from the front glass substrate 10. A plurality of column electrodes D are provided on the inner surface of the rear glass substrate 13, and arranged orthogonal to the row electrode pairs (X, Y), in positions corresponding to the transparent electrodes Xa, Ya.

Further, a white color dielectric layer 14 is formed on the inner surface of the rear glass substrate 13 so as to cover up all the column electrodes D, and a plurality of ladder-like partition wall assemblies 105 are formed on the dielectric layer 14, extending in the row direction of the plasma display panel.

Figure 43:
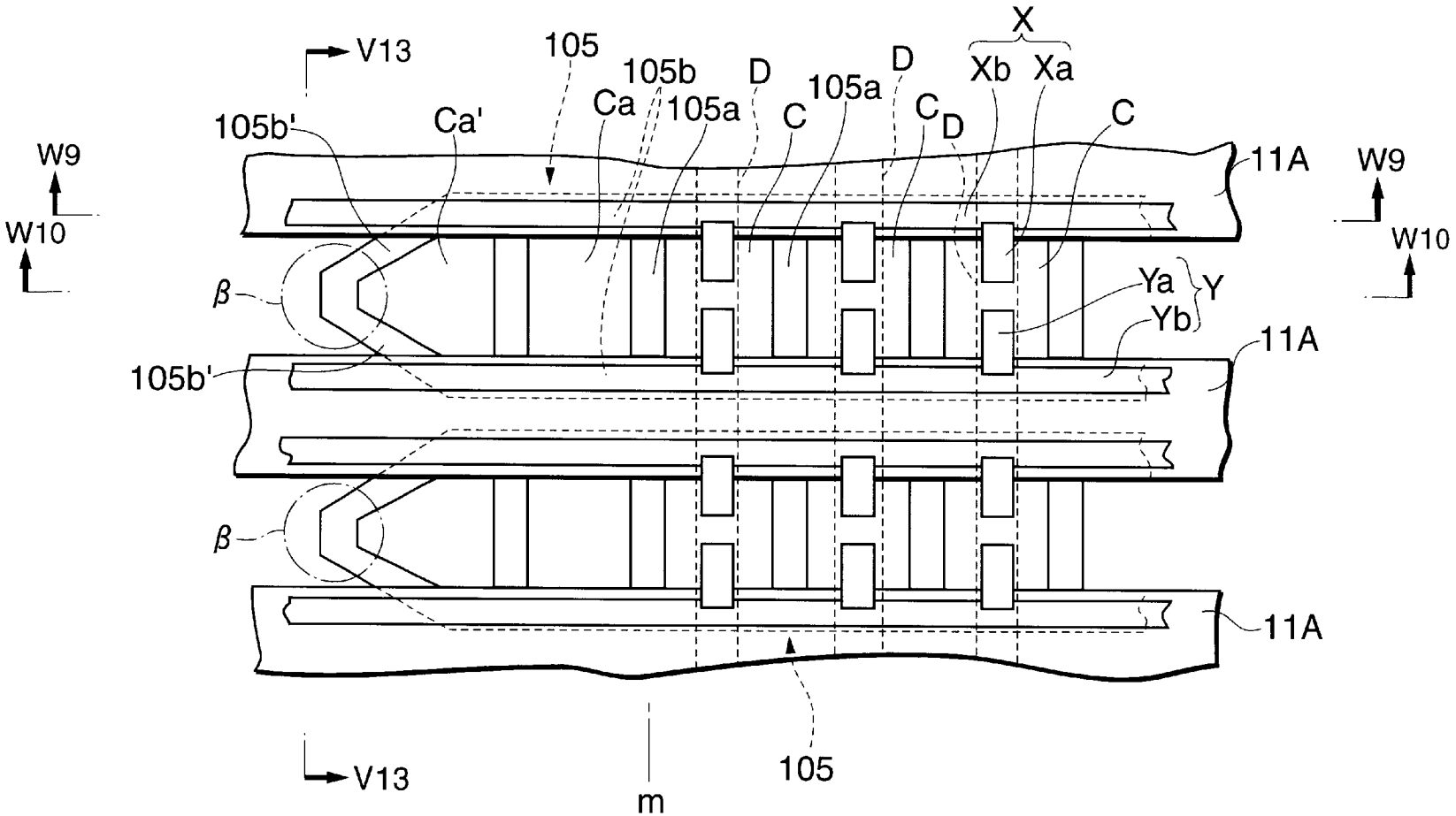
FIG. 43 is a plane view indicating a plasma display panel according to a 21th embodiment of the present invention.
Figure 44:
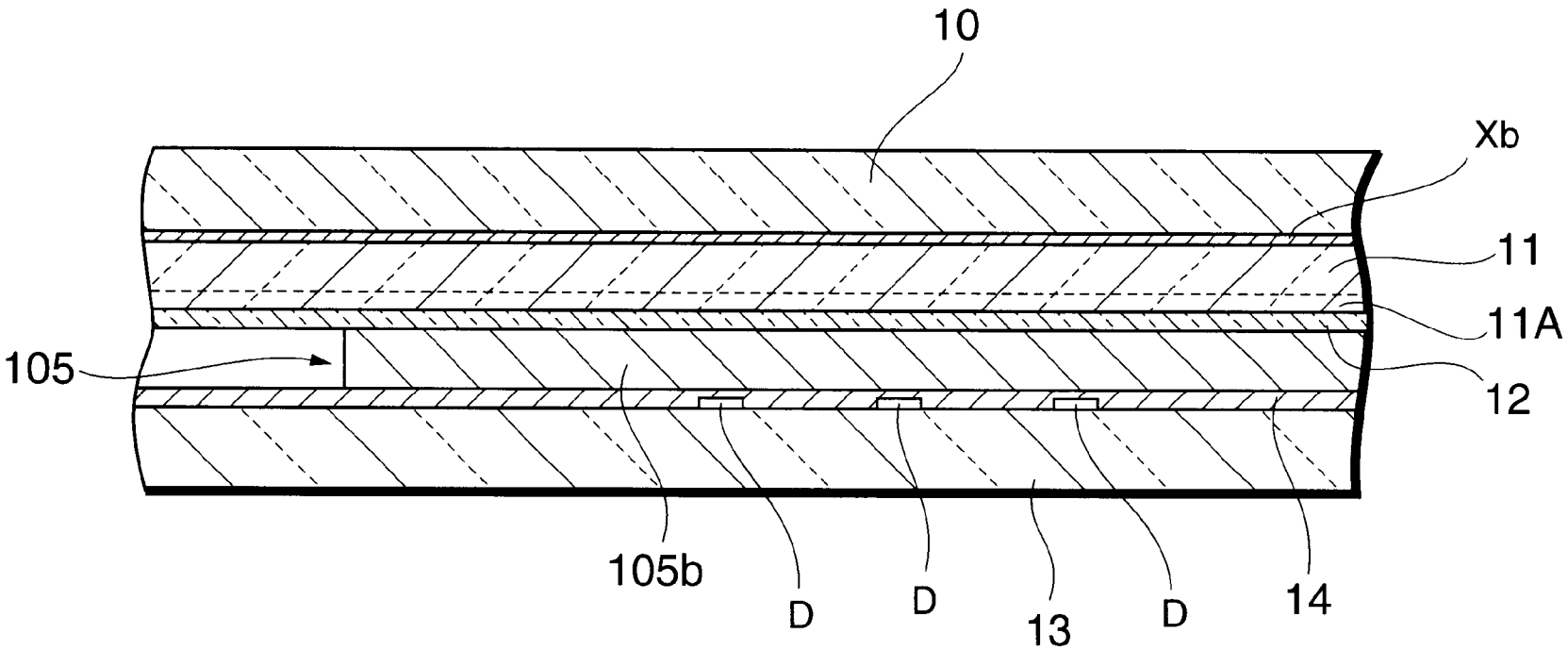
FIG. 44 is a cross sectional view taken along a line W9—W9 in FIG. 43.

Each ladder-like partition wall assembly 105 includes a plurality of short partition walls 105*a* (extending in the column direction of the panel), and a pair of long partition walls 105*b* (extending in the row direction of the panel) corresponding to the projection portions 11A of the dielectric layer 11, thereby forming a ladder-like partition wall assembly 105 (FIG. 43).

By virtue of the plurality of ladder-like partition wall assemblies 105, an electric discharge space formed between the front glass substrate 10 and the rear glass substrate 13 is divided into a plurality of discharge cells C each enclosing a pair of transparent electrodes Xa, Ya between a pair of row electrodes (X, Y).

In FIG. 43, Ca and Ca' are used to represent dummy cells not enclosing row electrodes (X, Y). These dummy cells Ca and Ca' are formed on the outer ends (right and left) of each ladder-like partition wall assembly 105 and are located on the outside of the displaying area of the plasma display panel.

Referring again to FIG. 43, outer portions of the two lateral partition walls 105*b* of each ladder-like partition wall assembly 105, located in the dummy cell Ca' outwardly of the dummy cell Ca which is positioned adjacent to a discharge cell C (located on the right side of line m in the figure, i.e., within the displaying area of the plasma display panel), are bent toward each other so as to form bent portions 105*b*' which are connected with each other at a position between two adjacent projection portions 11A of the dielectric layer 11.

In this way, a plurality of dummy cells Ca' each having a generally triangular shape are formed by virtue of the bent portions 105*b*' of the lateral partition walls 105*b*.

Although not shown in FIG. 43, the structure on the right side of the plasma display panel is just the same as that on the left side thereof.

With the use of the above structure, it is allowed to ensure that even if there is a possibility that undesired build-up β of a material (for forming the partition wall assembly) will occur (shown in FIG. 43) during a sintering treatment for the formation of the ladder-like partition wall assembly 105 (made of a glass), such kind of build-up β can only form in positions not facing the projection portions 11A of the dielectric layer 11.

Figure 45:
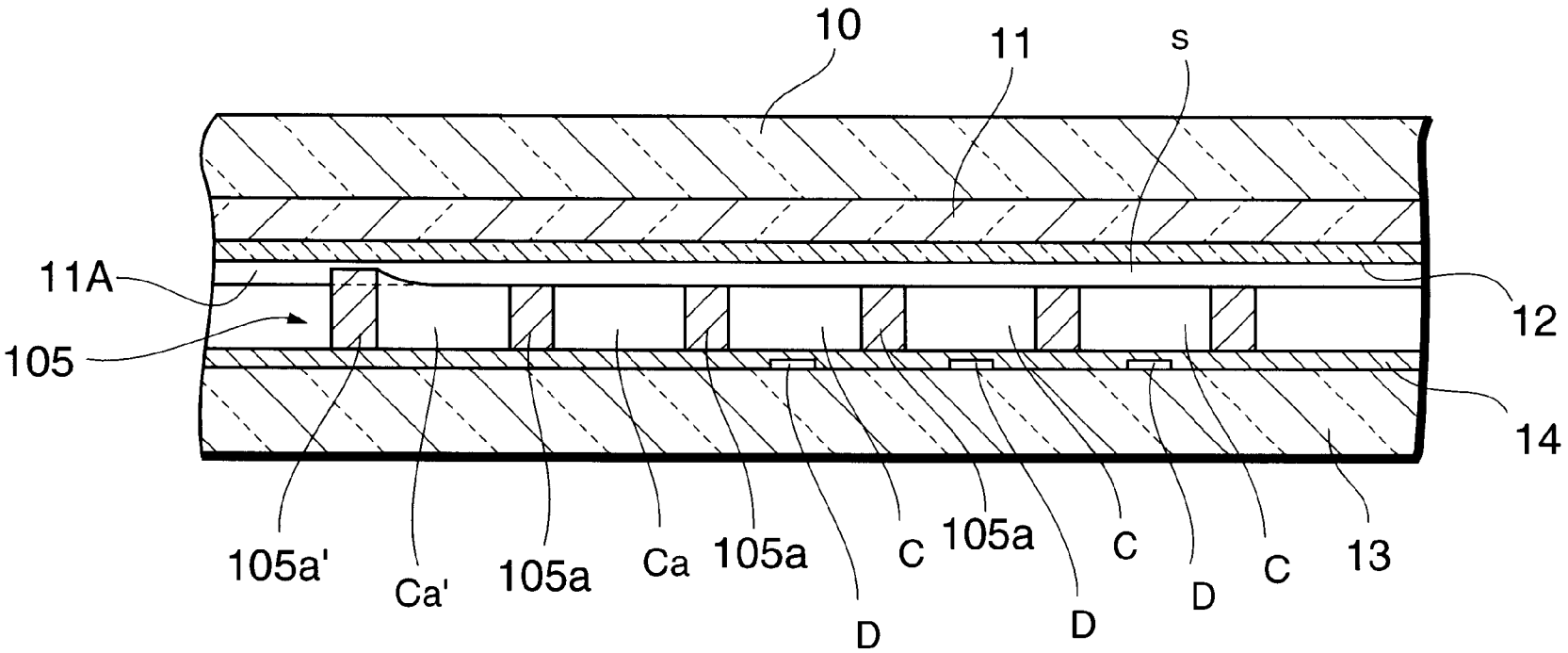
FIG. 45 is a cross sectional view taken along a line W10—W10 in FIG. 43.
Figure 46:
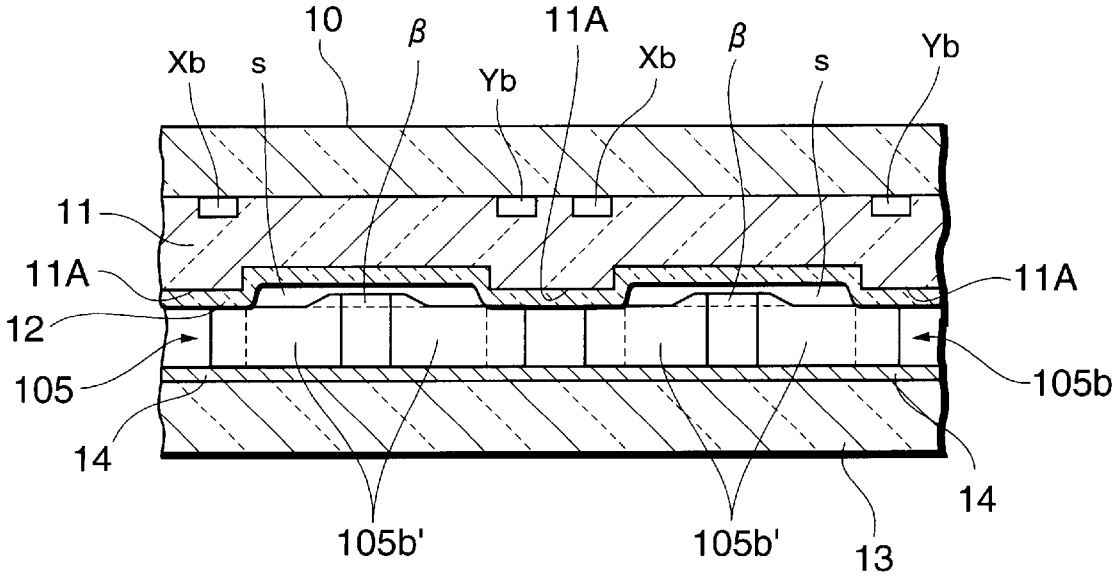
FIG. 46 is a cross sectional view taken along a line V13—V13 in FIG. 43.
Figure 47:
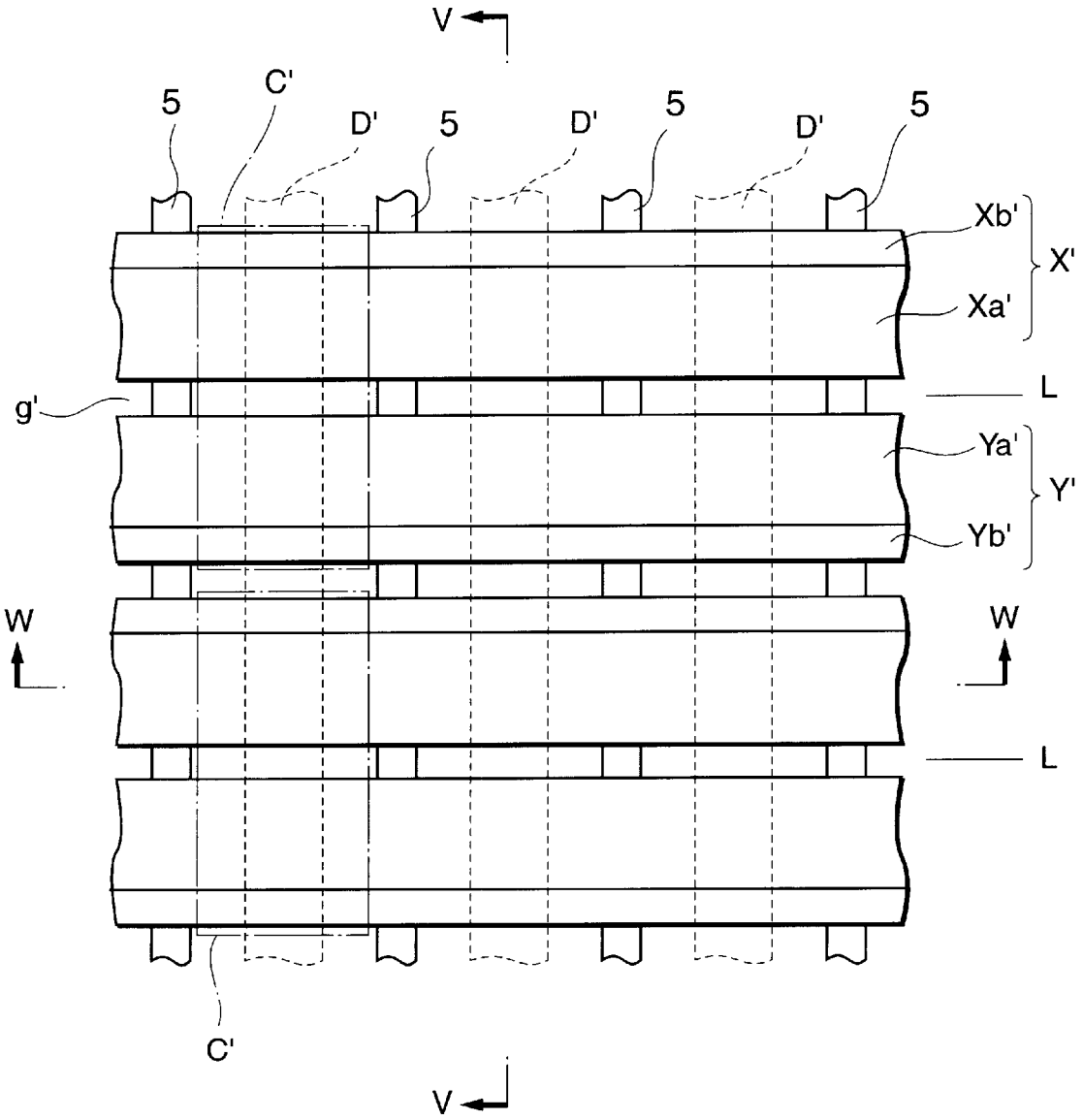
Fig.47 (PRIOR ART)
FIG. 47 is a plane view indicating a plasma display panel according to a prior art.
Figure 48:
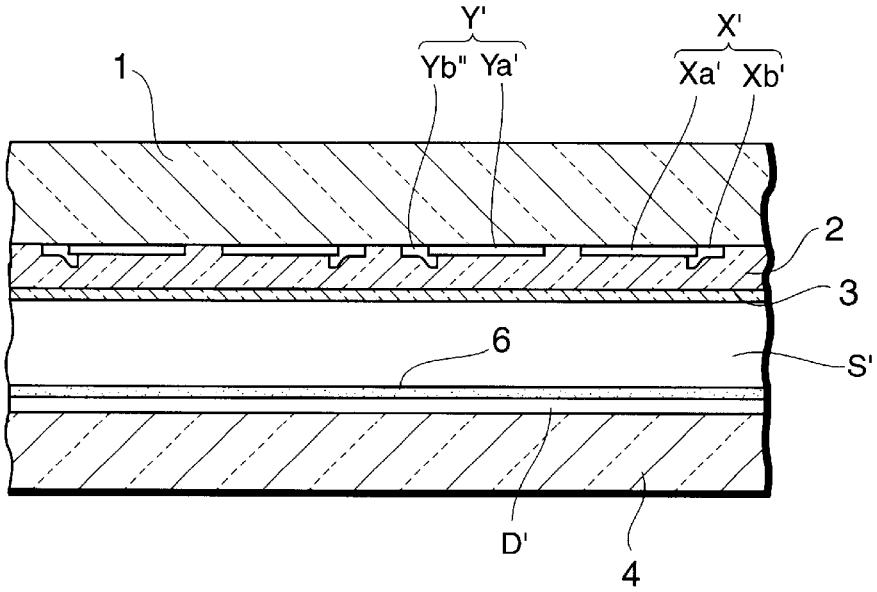
Fig.48 (PRIOR ART)
FIG. 48 is a cross sectional view taken along a line V—V in FIG. 47.
Figure 49:
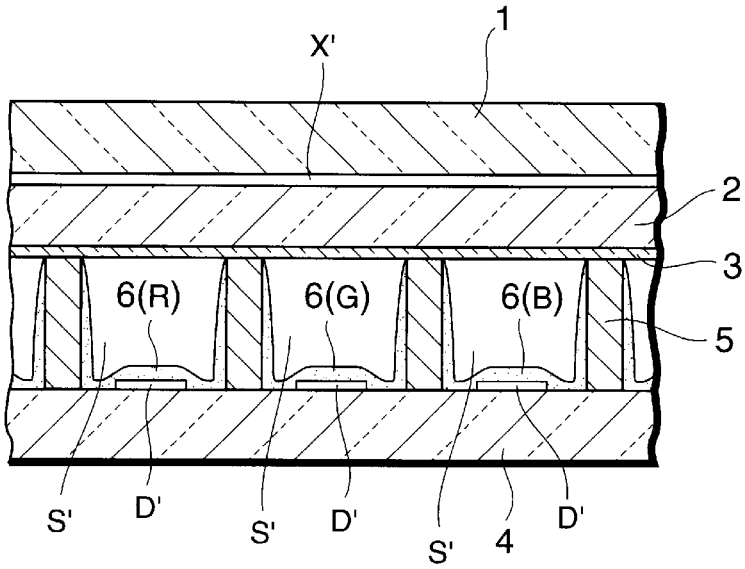
Fig.49 (PRIOR ART)
FIG. 49 is a cross sectional view taken along a line W—W in FIG. 47.

In this way, as shown in FIGS. 45 and 46, since the build-up β can only occur in slots s formed between the partition wall assembly 105 and the dielectric layer 11, when the front glass substrate 10 and the rear glass substrate 13 are brought together to form the plasma display panel, it can be made sure that the build-up β will not get in contact with the projection portions 11A of the dielectric layer 11, thereby avoiding the formation of some unwanted slots between the lateral partition walls 105*b* of the partition wall assembly 105 and the projection portions 11A of the dielectric layer 11.

Second Additional Embodiment

Although it has been described in the above first embodiment (FIGS. 1–5) that the partition wall assembly has a two-layer structure including a black color layer and a white color layer, it is also possible that such a partition wall assembly has a one-layer structure including only a white color layer. Further, the partition wall assembly may also be formed into a light-transmissible structure formed by a low melting point glass not containing any pigment.

By forming the light-transmissible partition wall assembly, a light generated in each discharge cell is allowed to be randomly reflected within the partition wall assembly so as to be widely spread on to the front glass substrate. Therefore, it is possible to improve an apparent numerical aperture so as to increase the brightness of the plasma display panel.

Further, it is also possible that a black color layer (light absorbing layer) may be formed on the upper surface of the light-transmissible partition wall assembly, thereby forming a two-layer structure including a black color layer (light absorbing layer) and a light-transmissible layer (transparent layer).

While the presently preferred embodiments of this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front substrate;

a plurality of row electrode pairs provided on the inner surface of the front substrate, said row electrode pairs being arranged in parallel with one another and extending in the row direction of the panel, with each row electrode pair forming a displaying line;

a dielectric layer provided on the inner surface of the front substrate for coverring the row electrode pairs;

a rear substrate arranged in parallel with and space-apart from the front substrate, forming a discharge space therebetween;

a plurality of column electrodes provided on the inner surface of the rear substrate, said column electrodes being arranged in parallel with one another and extending in the column direction of the panel, in a manner such that at each intersection of a row electrode pair with a column electrode there is formed a light emission unit;

a partition wall assembly provided between the front substrate and the rear substrate, said partition wall assembly including a plurality of longitudinal partition walls and a plurality of lateral partition walls, thereby dividing the discharge space into a plurality of discharge cells;

wherein the dielectric layer has a plurality of projection portions located corresponding to and protruding toward the lateral partition walls of the partition wall assembly, in a manner such that there would be no slots formed between the dielectric layer and the lateral partition walls.

2. The plasma display panel according to claim 1, wherein a slot is formed between the dielectric layer and each longitudinal partition wall of the partition wall assembly.

3. The plasma display panel according to claim 1, wherein a fluorescent layer is formed to cover side faces of the longitudinal partition walls and the lateral partition walls and exposed portions of another dielectric layer formed on the inner surface of the rear substrate.

4. The plasma display panel according to claim 1, wherein the partition wall assembly has a two-layer structure, one of which is a light absorbing layer located closer to the front substrate, and the other of which is a light reflecting layer located closer to the rear substrate.

5. The plasma display panel according to claim 1, wherein each row electrode pair has two row electrodes each having a light absorbing layer facing the front substrate.

6. The plasma display panel according to claim 5, wherein each of the two row electrodes forming one electrode pair has a plurality of protruding portions, forming a plurality of discharge gaps between mutually facing protruding portions of the two row electrodes.

7. The plasma display panel according to claim 1, wherein a mutual positional relationship between two row electrodes of a row electrode pair is alternatively changed from one displaying line to another, two mutually adjacent row electrodes of every two mutually adjacent displaying lines are connected to an identical common electrode main body.

8. The plasma display panel according to claim 6, wherein protruding portions of two mutually adjacent row electrodes of every two mutually adjacent displaying lines are connected with each other.

9. The plasma display panel according to claim 1, wherein there are formed a plurality of lateral light absorbing straps on the inner surface of the front substrate, with each lateral light absorbing strap being positioned between two mutually adjacent row electrodes of every two mutually adjacent displaying lines.

10. The plasma display panel according to claim 1, wherein there are formed a plurality of longitudinal light absorbing straps on the inner surface of the front substrate, with each longitudinal light absorbing strap being positioned corresponding to one longitudinal partition wall.

11. The plasma display panel according to claim 1, wherein a light absorbing layer is formed on the inner surface of the front substrate layer, said light absorbing layer having the same pattern corresponding to the lateral and longitudinal partition walls of the partition wall assembly.

12. The plasma display panel according to claim 1, wherein protruding portions o f two row electrodes forming one displaying line have mutually facing head portions which are inclined with respect to the row direction of the panel.

13. The plasma display panel according to claim 1, wherein each displaying line includes a plurality of discharge cells repeatedly arranged in the order of R, G, B, each column includes a plurality of same color discharge cells, with every three discharge cells (R, G, B) arranged in a display line forming one picture element.

14. The plasma display panel according to claim 1, wherein each displaying line includes a plurality of discharge cells repeatedly arranged in the order of R, G, B, one displaying line being deviated in the row direction from its adjacent displaying line by one discharge cell, with every three discharge cells (R, G, B) arranged in a display line forming one picture element.

15. The plasma display panel according to claim 1, wherein each displaying line includes a plurality of discharge cells repeatedly arranged in the order of R, G, B, one displaying line being deviated in the row direction from its adjacent displaying line by half width of one discharge cell, with every three discharge cells (R, G, B) arranged in a display line forming one picture element.

16. The plasma display panel according to claim 1, wherein each displaying line includes a plurality of discharge cells repeatedly arranged in the order of R, G, B, one displaying line being deviated in the row direction from its adjacent displaying line by 1.5 times the width of one discharge cell, in a manner such that each pitch element may also be formed by three discharge cells (R, G, B) which together form a triangular configuration bridging over two mutually adjacent displaying lines.

17. The plasma display panel according to claim 1, wherein each lateral partition wall of the partition wall assembly is divided into two portions by an elongated slot extending in the row direction of the panel.

18. The plasma display panel according to claim 17, wherein each divided portion of each lateral partition wall has substantially the same width as that of each longitudinal partition wall of the partition wall assembly.

19. The plasma display panel according to claim 17, wherein a plurality of light absorbing straps are formed on the inner surface of the front substrate, in positions corresponding to the elongated slots.

20. The plasma display panel according to claim 17, wherein a plurality of light absorbing straps are formed on the inner surface of the front substrate, in positions corresponding to the longitudinal partition walls of the partition wall assembly.

21. The plasma display panel according to claim 17, wherein at least the longitudinal partition walls of the partition wall assembly have a two-layer structure, one of which is a light absorbing layer facing toward the front substrate, and the other of which is a light reflecting layer facing toward the rear substrate.

22. The plasma display panel according to claim 1, wherein each of two row electrodes of a row electrode pair includes an elongated main body portion extending in the row direction of the panel and a plurality of protruding portions extending in the column direction of the panel, so that a plurality of discharge gaps are formed between mutually facing protruding portions of two elongated main body portions, wherein each elongated main body portion is made by a metal film;

wherein each protruding portion is formed by a transparent electrically conductive film, with its base end connected to an elongated main body portion.

23. The plasma display panel according to claim 22, wherein a light absorbing layer is formed on each elongated main body portion so that said light absorbing layer is interposed between the inner surface of the front substrate and the elongated main body portion.

24. The plasma display panel according to claim 22, wherein one elongated main body portion is shared by two mutually adjacent row electrodes of two mutually adjacent displaying lines.

25. The plasma display panel according to claim 17, wherein the outermost corner portions of each lateral partition wall are removed so as to form inclined surfaces thereon.

26. The plasma display panel according to claim 1 or 17, wherein outer end portions of partition wall assembly are formed in positions not facing the projection portions of the dielectric layer.

27. The plasma display panel according to claim 26, wherein outer end portions of each pair of lateral partition walls are combined with each other in positions not facing the projection portions of the dielectric layer.

28. The plasma display panel according to claim 1, wherein the partition wall assembly is made of a light transmissible material.

* * * * *